US009982373B2

(12) United States Patent
Meir

(10) Patent No.: US 9,982,373 B2
(45) Date of Patent: May 29, 2018

(54) ARTICLE OF FOOTWEAR INCORPORATING AN UPPER WITH A SHIFTED KNIT STRUCTURE

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days. days.

(21) Appl. No.: 15/492,823

(22) Filed: Apr. 20, 2017

(65) Prior Publication Data

US 2017/0215515 A1 Aug. 3, 2017

Related U.S. Application Data

(62) Division of application No. 14/445,835, filed on Jul. 29, 2014, now Pat. No. 9,661,892.

(51) Int. Cl.

| | |
|---|---|
| ***D04B 1/22*** | (2006.01) |
| ***D04B 1/10*** | (2006.01) |
| ***A43B 1/04*** | (2006.01) |
| ***A43B 23/00*** | (2006.01) |
| ***A43B 23/02*** | (2006.01) |

(52) U.S. Cl.

CPC ..... *D04B 1/108* (2013.01); *A43B 1/04* (2013.01); *A43B 23/00* (2013.01); *A43B 23/0245* (2013.01); *D04B 1/22* (2013.01); *D10B 2403/032* (2013.01); *D10B 2501/043* (2013.01)

(58) Field of Classification Search

CPC .. D04B 1/108; D04B 1/22; A43B 1/04; A43B 23/00; A43B 23/0245

See application file for complete search history.

(56) References Cited

U.S. PATENT DOCUMENTS

| | | | |
|---|---|---|---|
| 16,285 | A | 12/1856 | McNary |
| 291,173 | A | 1/1884 | Esty |
| 1,789,494 | A | 1/1931 | Page |
| 1,981,315 | A | 11/1934 | Goodman |
| 2,047,724 | A | 7/1936 | Zuckerman |
| 2,147,197 | A | 2/1939 | Glidden |
| 2,400,692 | A | 5/1946 | Herbert |
| 2,431,204 | A | 11/1947 | Sheppard |
| 2,489,658 | A | 11/1949 | Miller |

(Continued)

FOREIGN PATENT DOCUMENTS

| | | |
|---|---|---|
| EP | 2 901 873 | 8/2015 |
| JP | S47-017429 | 5/1972 |

(Continued)

OTHER PUBLICATIONS

Office Action, and English language translation thereof, in corresponding Japanese Application No. 2017-504369, dated Feb. 15, 2018, 8 pages.

*Primary Examiner* — Danny Worrell
(74) *Attorney, Agent, or Firm* — Brinks Gilson & Lione

(57) ABSTRACT

An article of footwear includes an upper incorporating a knitted component formed of unitary knit construction. The knitted component includes portions having courses aligned along different knitting directions, including a first knitting direction and a second knitting direction. The knitting direction of the courses transitions gradually from the first direction to the second direction. The knitting direction of the courses of the knitted component is configured to be aligned so as to distribute forces acting on the knitted component when the article of footwear is worn during a sport or athletic activity.

20 Claims, 44 Drawing Sheets

(56) References Cited

U.S. PATENT DOCUMENTS

| | | | |
|---|---|---|---|
| 2,613,520 | A | 10/1952 | Schaefer |
| 5,211,035 | A | 5/1993 | Hanson, II |
| 6,000,247 | A | 12/1999 | Takeda et al. |
| 6,272,888 | B1 | 8/2001 | Fujita et al. |
| 6,935,141 | B2 | 8/2005 | Takeda et al. |
| 7,059,156 | B2 | 6/2006 | Takeda et al. |
| 7,131,296 | B2 | 11/2006 | Dua et al. |
| 7,402,174 | B2 | 7/2008 | Dong |
| 7,437,896 | B2 | 10/2008 | Hirao et al. |
| 8,490,299 | B2 | 7/2013 | Dua et al. |
| 2012/0233882 | A1 | 9/2012 | Huffa et al. |
| 2012/0255201 | A1 | 10/2012 | Little |
| 2013/0055590 | A1 | 3/2013 | Mokos |
| 2013/0239625 | A1 | 9/2013 | Meir et al. |
| 2013/0269209 | A1 | 10/2013 | Lang et al. |
| 2013/0269212 | A1 | 10/2013 | Little |

FOREIGN PATENT DOCUMENTS

| | | | |
|---|---|---|---|
| JP | H10-130907 | H | 5/1998 |
| JP | 2014-512911 | A | 5/2014 |
| WO | WO 2008/136186 | A1 | 11/2008 |
| WO | WO 2013/126313 | A2 | 8/2013 |
| WO | WO 2014/050289 | | 4/2014 |

ARTICLE OF FOOTWEAR INCORPORATING AN UPPER WITH A SHIFTED KNIT STRUCTURE

CROSS-REFERENCE TO RELATED APPLICATIONS

The present patent document is a divisional of and claims priority to U.S. patent application Ser. No. 14/445,835, filed on Jul. 29, 2014, which is hereby incorporated by reference in its entirety.

FIELD OF THE INVENTION

The invention generally relates to articles of footwear. More specific aspects of the invention relate to articles of footwear incorporating an upper at least partially formed from knitted textile materials.

BACKGROUND

Conventional articles of footwear generally include two primary elements, an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chamber, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g. textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

BRIEF SUMMARY

In one aspect, an article of footwear includes an upper and a sole structure secured to the upper, the upper incorporating a knitted component. The knitted component includes a first portion, a second portion and a third portion. The first portion including at least one course associated with a first knitting direction. The second portion including at least one course associated with a second knitting direction, the second knitting direction being different than the first knitting direction. The first knitting direction being oriented at an angle of less than ninety degrees from the second knitting direction. A third portion disposed between the first portion and the second portion, the third portion including a plurality of courses, including at least one course associated with the first knitting direction and at least one course associated with the second knitting direction. The plurality of courses of the third portion including multiple courses having varying lengths. The loops of the multiple courses are connected to at least one loop of a common connection course. The common connection course being aligned substantially along the second knitting direction and adjacent to the second portion of the knitted component. The first portion, the second portion, and the third portion being formed of unitary knit construction.

In another aspect, an article of footwear includes an upper and a sole structure secured to the upper, the upper incorporating a knitted component extending through one or more of a forefoot region, a midfoot region, and a heel region of the upper. The knitted component includes a first portion, a second portion, and a third portion. The first portion including at least one course associated with a first knitting direction aligned approximately along a lateral direction across the upper. The second portion including at least one course associated with a second knitting direction, the second knitting direction being different than the first knitting direction. The second knitting direction being oriented at an angle of less than ninety degrees from the lateral direction of the upper. The third portion disposed between the first portion and the second portion, the third portion including a plurality of courses that transition from the first knitting direction at a first location adjacent to the first portion to the second knitting direction at a second location adjacent to the second portion.

In another aspect, a method of knitting a knitted component for incorporating into an upper of an article of footwear includes knitting a first portion, a plurality of transition courses and a second portion. The first portion of the knitted component includes at least one course aligned along a first knitting direction. The plurality of transition courses, include at least one transition course being continuous with at least one course of the first portion. The plurality of transition courses including multiple short-row courses. The second portion of the knitted component includes at least one course aligned along a second knitting direction, the second knitting direction being different than the first knitting direction. The first knitting direction being oriented at an angle of less than ninety degrees from the second knitting direction.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The embodiments can be better understood with reference to the following drawings and description. The components in the Figures are not necessarily to scale, emphasis instead being placed upon illustrating the principles of the embodiments. Moreover, in the Figures, like reference numerals designate corresponding parts throughout the different views.

The foregoing Summary and the following Detailed Description will be better understood when read in conjunction with the accompanying figures.

DETAILED DESCRIPTION OF THE DRAWINGS AND THE PRESENTLY PREFERRED EMBODIMENTS

The following discussion and accompanying figures disclose a variety of concepts relating to knitted components and the manufacture of knitted components. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Footwear Configuration

An article of footwear 100 is depicted in FIGS. 1-5 as including a sole structure 102 and an upper 104. Although article of footwear 100, also referred to hereafter as simply article 100, is illustrated as having a general configuration suitable for running, concepts associated with footwear may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear apply to a wide variety of footwear types.

Figure 1:
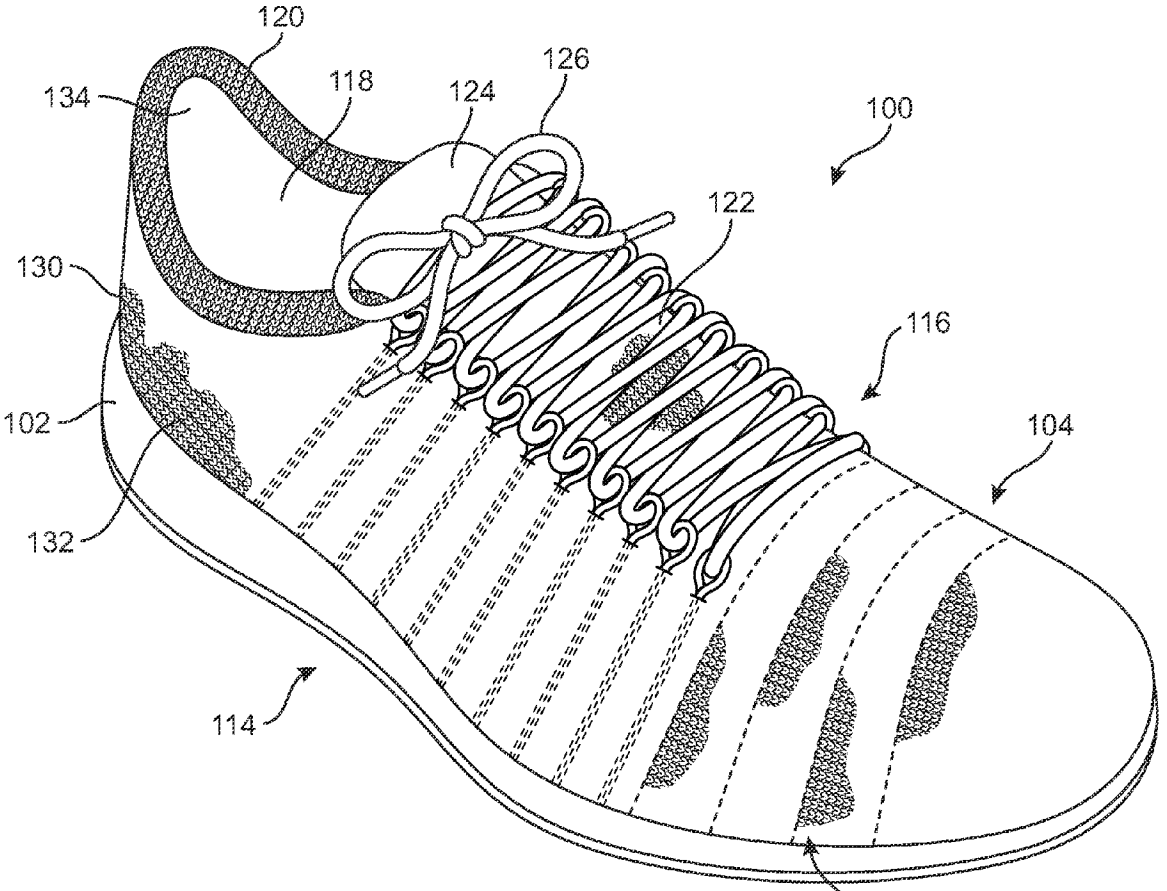
FIG. 1 is an isometric view of an exemplary embodiment of an article of footwear.
Figure 2:
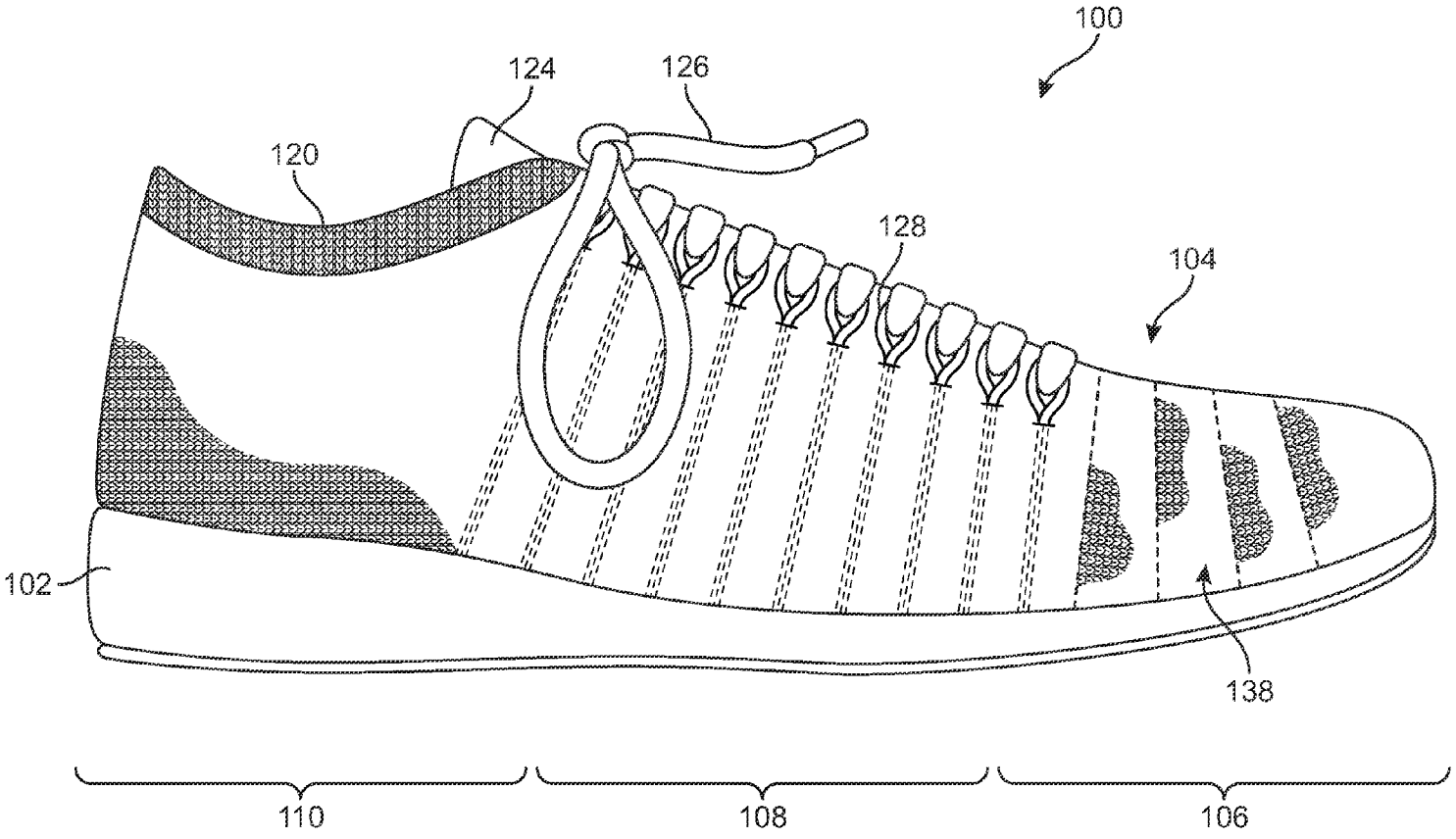
FIG. 2 is a lateral side elevation view of an exemplary embodiment of an article of footwear.
Figure 3:
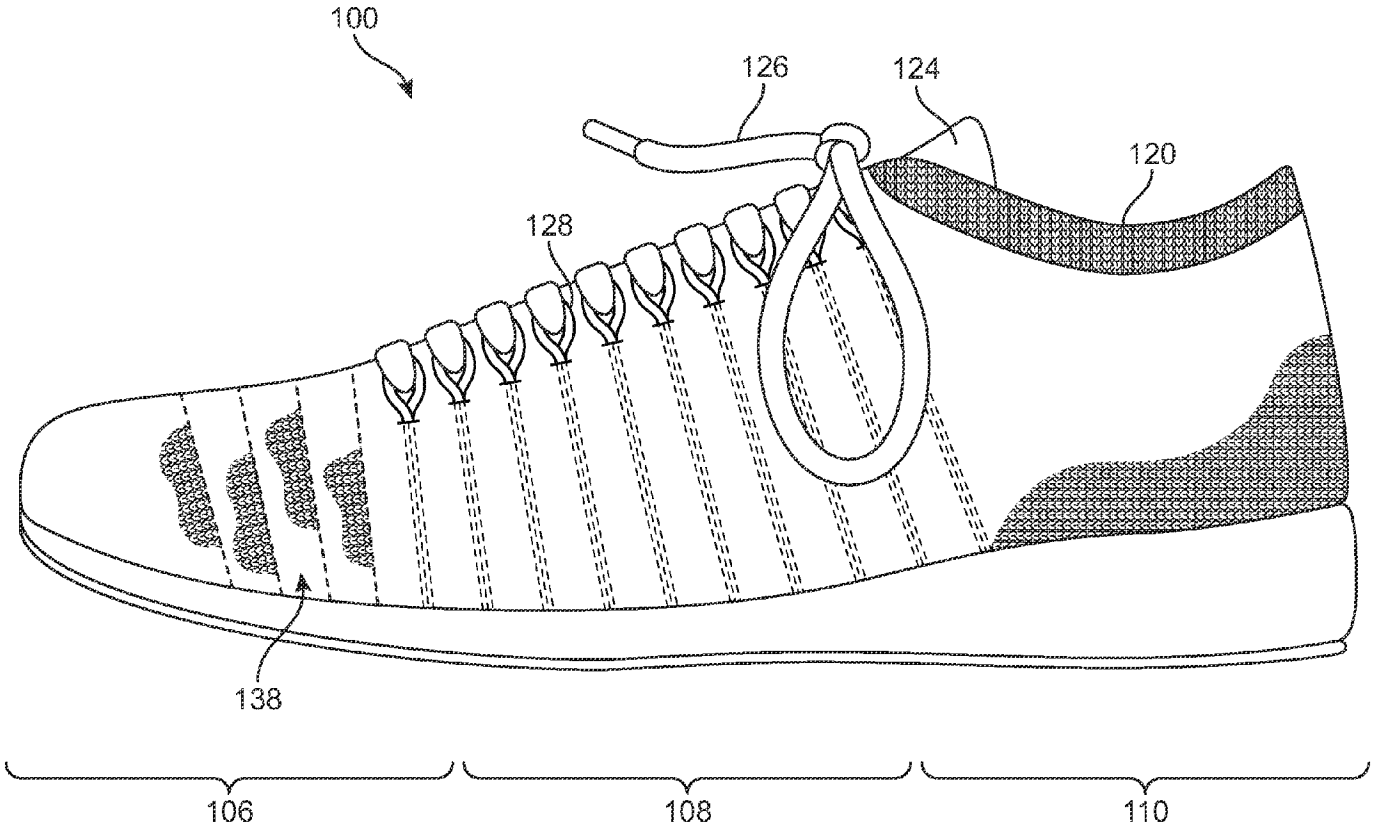
FIG. 3 is a medial side elevation view of an exemplary embodiment of an article of footwear.

As best shown in FIGS. 2-3, article 100 may be divided into three general regions: a forefoot region 106, a midfoot region 108, and a heel region 110. Forefoot region 106 generally includes portions of article 100 corresponding with the toes and the joints connecting the metatarsals with the phalanges. Midfoot region 108 generally includes portions of article 100 corresponding with an arch area of the foot. Heel region 110 generally corresponds with rear portions of the foot, including the calcaneus bone. Article 100 also includes a lateral side 114 and a medial side 116, which extend through forefoot region 106, midfoot region 108, and heel region 110, and correspond with opposite sides of footwear. More particularly, lateral side 114 corresponds with an outside area of the foot, and medial side 116 corresponds with an inside area of the foot (i.e., the surface that faces toward the other foot). Forefoot region 106, midfoot region 108, heel region 110, lateral side 114, and medial side 116 are not intended to demarcate precise areas of footwear. Rather, forefoot region 106, midfoot region 108, heel region 110, lateral side 114, and medial side 116 are intended to represent general areas of article 100 to aid in the following discussion. In addition to article 100, forefoot region 106, midfoot region 108, heel region 110, lateral side 114, and medial side 116 may also be applied to sole structure 102, upper 104, and individual elements thereof.

Further, reference may be made to directional descriptions. "Longitudinal" as used throughout this detailed description and in the claims refers to a direction extending the length of an article or component or portions thereof. In some cases, the longitudinal direction may extend from forefoot region 106 to heel region 110 or portions. The term "lateral" as used throughout this detailed description and in the claims refers to a direction extending a width of an article or portions thereof. In other words, the lateral direction may extend between lateral side 114 and medial side 116 of an article. Furthermore, the term "vertical" as used throughout this detailed description and in the claims refers to a direction generally perpendicular to a lateral and longitudinal direction.

In an embodiment, sole structure 102 is secured to upper 104 and extends between the foot and the ground when article 100 is worn. In some embodiments, the primary elements of sole structure 102 may include a midsole, an outsole, and a sockliner. In an exemplary embodiment, sole structure 102 may include an outsole. In an embodiment, outsole may be secured to a lower surface of upper 104. Outsole may also be secured to a base portion configured for securing sole structure 102 to upper 104. Although the configuration for sole structure 102 provides an example of a sole structure that may be used in connection with upper 104, many other conventional or nonconventional configurations for sole structure 102 may be utilized. Accordingly, the features of sole structure 102, or any sole structure used with upper 104, may vary in other embodiments.

For example, in other embodiments, sole structure 102 may include a midsole and/or a sockliner. The midsole may be secured to a lower surface of an upper and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other configurations, midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of article of footwear 100.

In some embodiments, upper 104 defines a void within article 100 for receiving and securing a foot relative to sole structure 102. The void is shaped to accommodate a foot and extends along the lateral side of the foot, along a medial side of the foot, over the foot, around the heel, and under the foot. Access to the void is provided by an ankle opening 118 located in at least the heel region 110. The foot may be inserted into upper 104 through ankle opening 118 formed by collar 120. The foot may be withdrawn from upper 104 through ankle opening 118 formed by collar 120. In some embodiments, an instep area 122 may extend forward from ankle opening 118 and collar 120 over an area corresponding to an instep of the foot in midfoot region 108 to the forefoot region 106.

In some embodiments, upper 104 may include a tongue portion 124. Tongue portion 124 may be disposed between lateral side 114 and medial side 116 of upper 104 through the instep area 122. Tongue portion 124 may be integrally attached to upper 104. In some embodiments, tongue portion 124 may be formed of a unitary knit construction, which is defined in further detail below, with portions of upper 104. Accordingly, upper 104 may extend substantially continuously across instep area 122 between lateral side 114 and medial side 116. In some embodiments, tongue portion 124 may be attached along lateral side 114 and medial side 116 of instep area 122. In other embodiments, tongue portion 124 may be disconnected along the sides of instep area 122 allowing for tongue portion 124 to be moveable between the sides of instep area 122.

A lace 126 may extend through various lace apertures 128 to enhance the comfort of article 100. Lace 126 may allow for the wearer to modify the dimensions of upper 104 to accommodate proportions of the foot. In some embodiments, lace 126 may extend through lace apertures 128 that are disposed along either side of instep area 122. In some embodiments, lace apertures 128 are integrally formed within upper 104. In some embodiments, an inlaid strand or tensile element may form lace aperture 128. Lace 126 may permit the wearer to tighten upper 104 around the foot. Lace 126 may also permit the wearer to loosen upper 104 to facilitate entry and removal of the foot from the void. In addition, tongue portion 124 of upper 104 in instep area 122 extends under lace 126 to enhance the comfort of article 100. In some embodiments, lace apertures 128 may be formed from another material. In further configurations, upper 104 may include additional elements, such as (a) a heel counter in heel region 110 that enhances stability, (b) a toe guard in forefoot region 106 that is formed of wear-resistant material, and (c) logos, trademarks, and placards with care instructions and material information.

Figure 4:
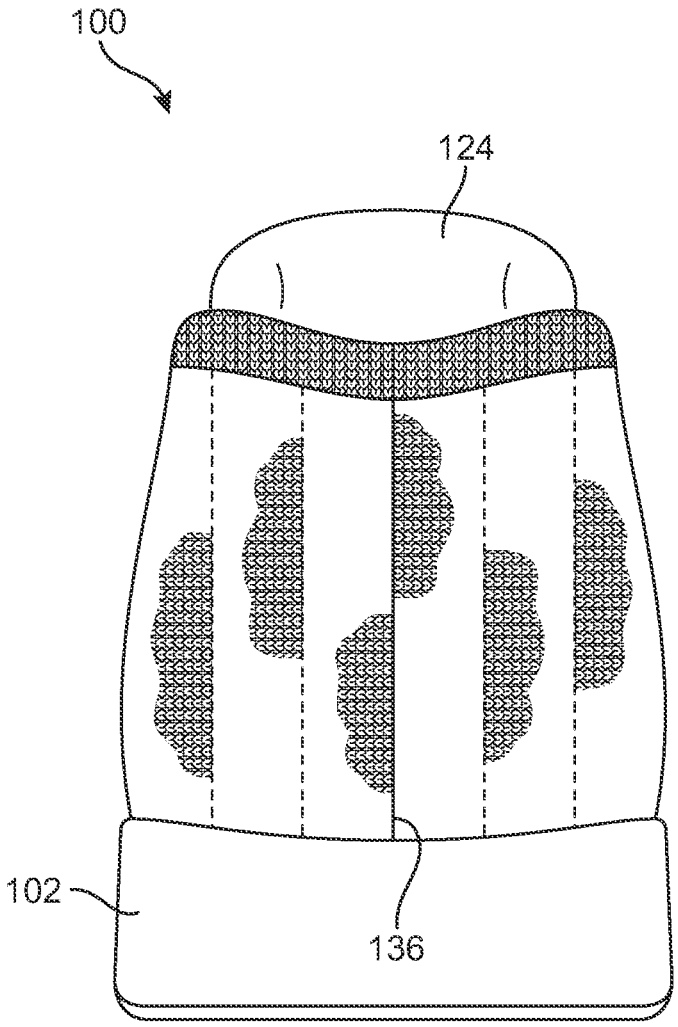
FIG. 4 is a back elevation view of an exemplary embodiment of an article of footwear.
Figure 5:
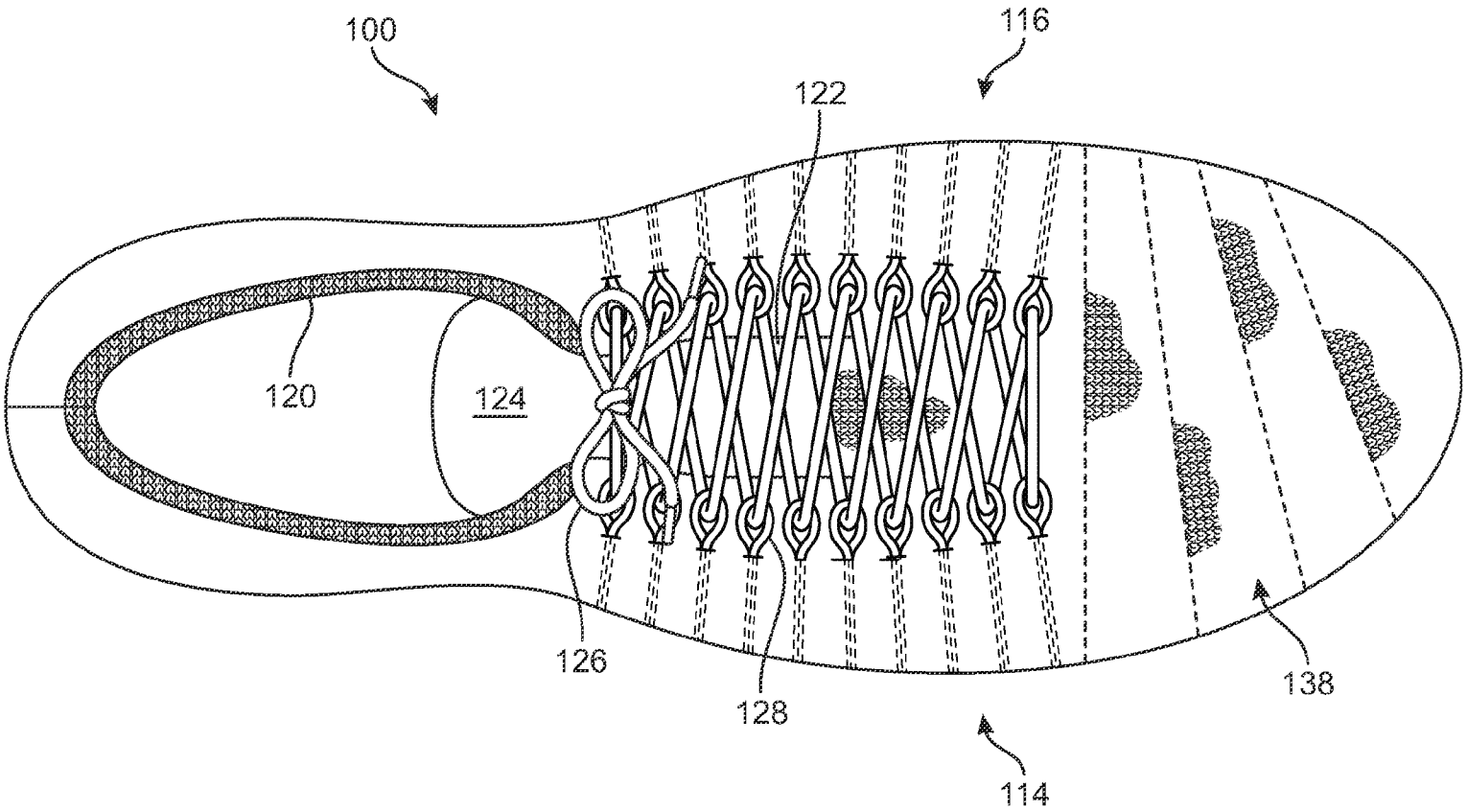
FIG. 5 is a top view of an exemplary embodiment of an article of footwear.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 104 is formed from a knitted component 130, which will be discussed in more detail below. Knitted component 130 may, for example, be manufactured through a flat knitting process and extends through one of more of forefoot region 106, midfoot region 108, and heel region 110 along both lateral side 114 and medial side 116. In an exemplary embodiment, knitted component 130 forms substantially all of upper 104 including exterior surface 132 and a majority or a relatively large portion of interior surface 134 (see FIG. 1) thereby defining a portion of the void within upper 104. In some embodiments, knitted component 130 may also extend under the foot. In other embodiments, however, a strobel sock or thin sole-shaped piece of material is secured to knitted component 130 to form a base portion of upper 104 that extends under the foot for attachment with sole structure 102. In addition, a seam 136 may extend vertically through the heel region 110, as depicted in FIG. 4, to join edges of knitted component 130.

Although seams may be present in knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

Knitted component 130 may incorporate various types of yarn that impart different properties to separate areas of upper 104. That is, one area of knitted component 130 may be formed from a first type of yarn that imparts a first set of properties, and another area of knitted component 130 may be formed from a second type of yarn that imparts a second set of properties. In this configuration, properties may vary throughout upper 104 by selecting specific yarns for different areas of knitted component 130. The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knitted component 130 may affect the properties of upper 104. For example, a yarn forming knitted component 130 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 104. Accordingly, both the materials forming the yarn and other aspects of the yarn may be selected to impart a variety of properties to separate areas of upper 104.

Some embodiments may include provisions to distribute forces that may act upon a knitted component. In some embodiments, force distribution may be achieved by providing courses of a knitted component that are pre-aligned in a manner corresponding to the typical forces that may be exerted on a knitted component incorporated into an upper for an article of footwear. Typical forces are forces that may occur in an article of footwear that is used for a particular purpose, for example an article of footwear configured for a sport or other athletic activity. The typical motions for a player or participant of a sport or athletic activity cause force to be exerted on an upper of the article of footwear in certain areas and at certain orientations. In some cases, a sport or athletic activity may include typical motions that exert significant lateral forces on the article of footwear, and, accordingly, to the knitted component. For example, sports such as soccer or football often include cutting motions that exert lateral forces on the article of footwear from the foot of the wearer.

In some embodiments, a knitted component may be configured to distribute the typical forces from a sport or athletic activity. In an exemplary embodiment, a knitted component may be provided with a shifted knit structure that changes the orientation of the knitting direction of the knitted component to assist with distributing the typical forces associated with a particular sport or athletic activity. Knitting direction, as discussed throughout the description and claims, refers to the orientation of interlooped yarns or strands forming a course or row of loops that are being joined to successive courses through a knitting process. The knitting direction may be generally defined relative to the direction of the knit material being formed during the knitting process. For example, during a flat knitting process, successive courses of interlooped yarns are joined together to form a knit element by manipulating a yarn through knitting a course or row along a generally horizontal direction to increase the size of the knitted component along a generally vertical direction.

In some embodiments, transition zones, including one or more groups of gores, may be utilized in order to change the knitting direction of a knitted component. The structure and function of transition zones, which change the knitting direction of the knitted component, are discussed in further detail below. With this configuration, the orientation of the knitting direction of the knitted component may be altered or changed to align one or more courses of the knitted component along the direction of the typical forces associated with a particular sport or athletic activity. By substantially aligning the orientation of the knitting direction of the knitted component to correspond with the direction of the typical forces, the forces may be substantially reduced or mitigated in the article of footwear when used by the wearer.

In some embodiments typical forces may be directed along the knitting direction of a knitted component. As forces from a sport or athletic activity may occur on average in the same area of an article of footwear and along the same direction, the knitting direction may be altered in certain areas of the knitted component. In some embodiments, the knitting direction of a knitted component may be altered in one or more of the heel region 110, midfoot region 108, and forefoot region 106. In some embodiments, the knitting direction of a knitted component may be altered to accommodate lateral forces or longitudinal forces in forefoot region 106. In some embodiments, the knitting direction of a knitted component may be altered to accommodate a combination of lateral forces and longitudinal forces acting in the forefoot region 106 of a knitted component. For example, a participant in an athletic activity may use a cutting motion. While a particular athlete may cut in many different directions, the general area and overall direction may be similar. In an exemplary embodiment, the knitting direction of a knitted component may be altered to accommodate the typical forces acting upon the knitted component due to the cutting motion. In some cases, the knitting direction of a knitted component may be configured so as to be substantially aligned or generally parallel with the direction of forces from the sport or athletic activity. For example, as the direction of forces associated with a cutting motion is generally not a perfect lateral force (that is the force generally includes a longitudinal component), gores may be utilized in some embodiments to alter the knitting direction of a knitted component to substantially align with the forces that are not in a perfect lateral direction. This configuration may allow for specific distribution of force throughout the knitted component in multiple directions associated with the athletic activity.

Knitted Component Configuration

Figure 6:
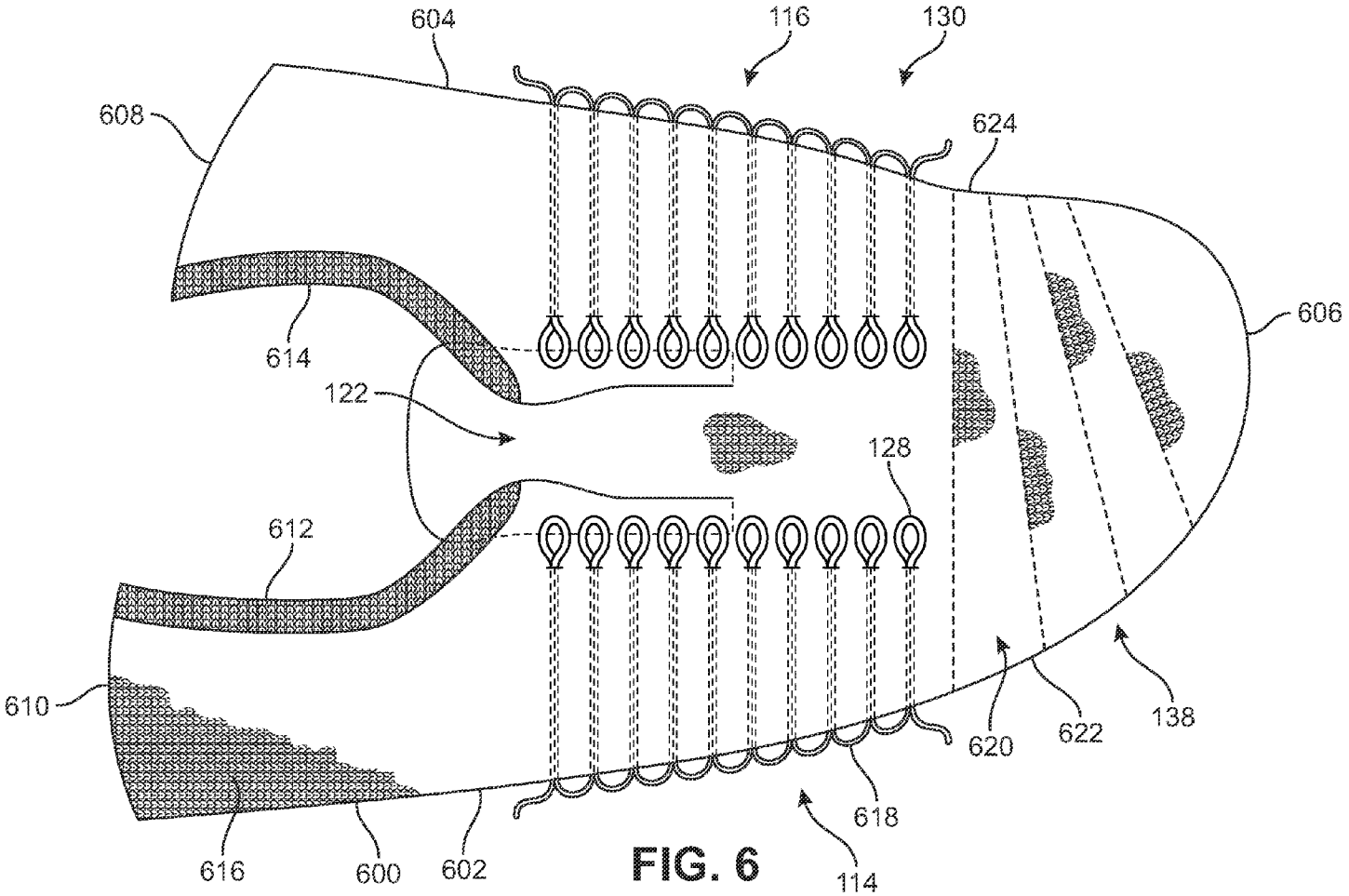
FIG. 6 is a top view of an exemplary embodiment of a knitted component.

Referring to FIG. 6, an exemplary embodiment of knitted component 130 is shown in a planar or flat configuration. Knitted component 130 is generally configured in an augmented U-shape. Knitted component 130 is outlined by an outer perimeter edge 600. Outer perimeter edge 600 includes lateral edge 602, medial edge 604, forefoot edge 606, heel edge 608 and heel edge 610. Knitted component 130 may further include a lateral inner edge 612 and a medial inner edge 614. When incorporated into an article of footwear, outer perimeter edge 600 may lay against an upper surface of sole structure 102. In addition, heel edge 608 and heel edge 610 may be joined to each other and extend vertically in heel region 110. In other embodiments, knitted component 130 may be joined to a strobel sock or sockliner for attachment to sole structure 102.

Knitted component 130 may include instep area 122 that is formed of unitary knit construction with the remaining portion of upper 104, as described above. In some embodiments, instep area 122 includes plurality of lace apertures 128 disposed in knitted component 130. Lace apertures 128 may extend through knitted component 130 from exterior surface 132 to interior surface 134 (see FIG. 1). Lace apertures 128 may be formed directly into the knitted component 130 by knitting. In other embodiments, lace apertures 128 may be created by a separate yarn or inlaid strand. Lace apertures 128 may be configured to accept lace 126. In some cases, lace apertures 128 may accept lace 126 without requiring lace 126 to pass through the surface of knitted component 130, as shown in the Figures discussed above.

A primary element of knitted component 130 may be knit element 616. Knit element 616 may be formed from at least one yarn that is manipulated (e.g., with a knitting machine) to form a plurality of intermeshed loops that define a variety of courses and wales. That is, knit element 616 has the structure of a knit textile. In some embodiments, an inlaid tensile element 618 may be utilized. Inlaid tensile element 618 may extend through knit element 616 and pass through various loops within knit element 616. Inlaid tensile element 618 may generally extend along the courses within knit element 616; however, in some embodiments, inlaid tensile element 618 may extend along the wales within knit element 616. Inlaid tensile element 618 may impart stretch resistance in certain areas within article 100.

In some embodiments, inlaid tensile element 618 may be incorporated such that inlaid tensile element 618 interacts with lace 126. In some embodiments, inlaid tensile element 618 may extend in the vertical direction from sole structure 102 to instep area 122. In some embodiments, inlaid tensile element 618 may be used to form lace aperture 128. A portion of inlaid tensile element 618 may form a loop in order to create lace aperture 128. In some cases, inlaid tensile element 618 may exit knit element 616. In some cases, the exposed portions of inlaid tensile element 618 may interact with sole structure 102 and lace 126. The interaction with lace 126 and/or sole structure 102 may assist with securing upper 104 around the foot.

In an exemplary embodiment, knitted component 130 may have an asymmetric shape. For example, in some embodiments, lateral edge 602 may have a different length or shape than medial edge 604. In some embodiments, medial edge 604 may include fewer courses than lateral edge 602. The presence of fewer courses may cause medial edge 604 to be shorter in length than lateral edge 602. Medial edge 604 may have a generally concave shape due to including fewer courses along medial edge 604 than lateral edge 602. Lateral edge 602 may have a generally convex shape due to including more courses along the lateral edge 602 than the medial edge 604. Forefoot edge 606 along the lateral side 114 of knitted component 130 may be biased toward medial side 116. Medial side 116 of forefoot edge 606 may be biased toward medial side 116 of knitted component 130. The configuration of medial edge 604 and lateral edge 602 may cause knitted component 130 to have an irregular shape. In some embodiments, heel region 110 of lateral side 114 of knitted component 130 may be longer than heel region 110 of medial side 116. In some embodiments, forefoot region 106 of knitted component 130 may be biased toward medial side 116 of knitted component 130.

Some embodiments may include provisions to shape knitted component 130. In an exemplary embodiment, knitted component 130 may include provisions to shift the knitting direction of knit element 616. In one embodiment, a group of gores 138 may be provided to shape knitted component 130 or shift the knitting direction of knit element 616 forming knitted component 130. Group of gores 138 may comprise regions or zones where some characteristic of the knitted component changes, such as the orientation of the knitting direction. In some embodiments, group of gores 138 may be located in the forefoot region 106. The construction and shape of the group of gores 138 may alter the shape of the knitted component 130. In some cases, the end or the final course of knitted component 130 may be located along medial edge 604 or lateral edge 602 depending on the orientation of the group of gores 138. In some cases, the end of the knitted component 130 may align with the tip or end of article 100. Tip or end of article 100 refers to the area in forefoot region 106 that is the farthest distance from heel region 110. In other embodiments, the final course or end of knitted component 130 may be located at an area other than the tip or end of article 100.

Knitting Direction

In some embodiments, transition zones or gores may be used to facilitate changes in the knitting direction within knitted component 130. Gores may be composed of multiple courses. Gores may utilize short-row knitting, also known as flechage, in order to facilitate changes in knitting direction of the knit element. Each course within a gore may include a different number of loops. In some cases, a later-created course, composed of fewer loops, may be shorter in length than an earlier-created course composed of more loops. In this sense, a later-created course may be composed of less yarn than a earlier-created course. Upon completion of a gore, the courses within the gore may be connected by a final course. The final course may be at an angle with respect to other courses and may effectively change the angle of the knitting direction of the knit element.

In different embodiments, gores may be located in various areas within knitted component 130. In some embodiments, gores may be confined to the forefoot region. In other embodiments, gores may be utilized throughout knitted component 130. In some embodiments, gores may extend across the width of knitted component 130. In other embodiments, gores may be utilized over a partial width of knitted component 130. Some embodiments may utilize gores in midfoot region 108. In some instances, gores may extend from midfoot region 108 into forefoot region 106.

In some embodiments, a gore may be largely defined by the edges of the gore. In some embodiments, the edges of a gore may be located on opposite sides of a knitted component. For example, a triangular or wedge-shaped gore, for example first gore 620, may have an expanded edge 622 and a narrow edge 624. Expanded edge 622 and narrow edge 624 thereby define a portion of first gore 620. Expanded edge 622 may have a first width. Narrow edge 624 may have a second width. The first width of expanded edge 622 may be larger than the second width of narrow edge 624. The difference in width of expanded edge 622 and narrow edge 624 on either side of gore 620 may thereby define a triangular shaped gore.

In some embodiments, the size of gores may vary depending on location within knitted component 130. In some embodiments, gores may extend from one side of instep area 122 and continue on the other side of instep area 122. A gore may be disjointed or disconnected from one portion of article of footwear 100 to another portion. Narrow edge 624 may be located on medial side 116 of instep area 122, near lateral edge 602 of knitted component 130. As first gore 620 extends from medial side 116 toward lateral side 114 first gore 620 may start to expand or widen. In some cases, a gore may encounter medial inner edge 612. In some cases, a gore may terminate at this location. In other cases, a gore may continue along lateral inner edge 612 toward lateral side 114. In some cases, a gore may continue even though there may be an open space formed by instep area 122. In other cases, the gore may include a break that runs through the gore. The break may separate the gore into more than one discreet portions. While the gore may include more than one discreet portions, the portions of the gore may still be of unitary knit construction with the knitted component. In some cases, the gore may include a notch or indent that may augment the shape of the gore in the area of the notch. Although the gore may be a continuous portion, the gore may include areas that are uneven, such as a notched portion.

In different embodiments, gores may be created in different forms and shapes. In some embodiments, the different shapes of the gores may be used in order to align courses within gores with typical forces that may be experienced by the knitted component. Gores may generally take a wedge or triangular shape. In some cases, gores may include straight edges. In other cases, gores may include curved edges. The shape of a gore may be used to orient the direction of courses forming knit element 616 of knitted component 130. With this configuration, the orientation of the courses of knit element 616 may distribute forces that may be exerted on knitted component 130.

Figure 7:
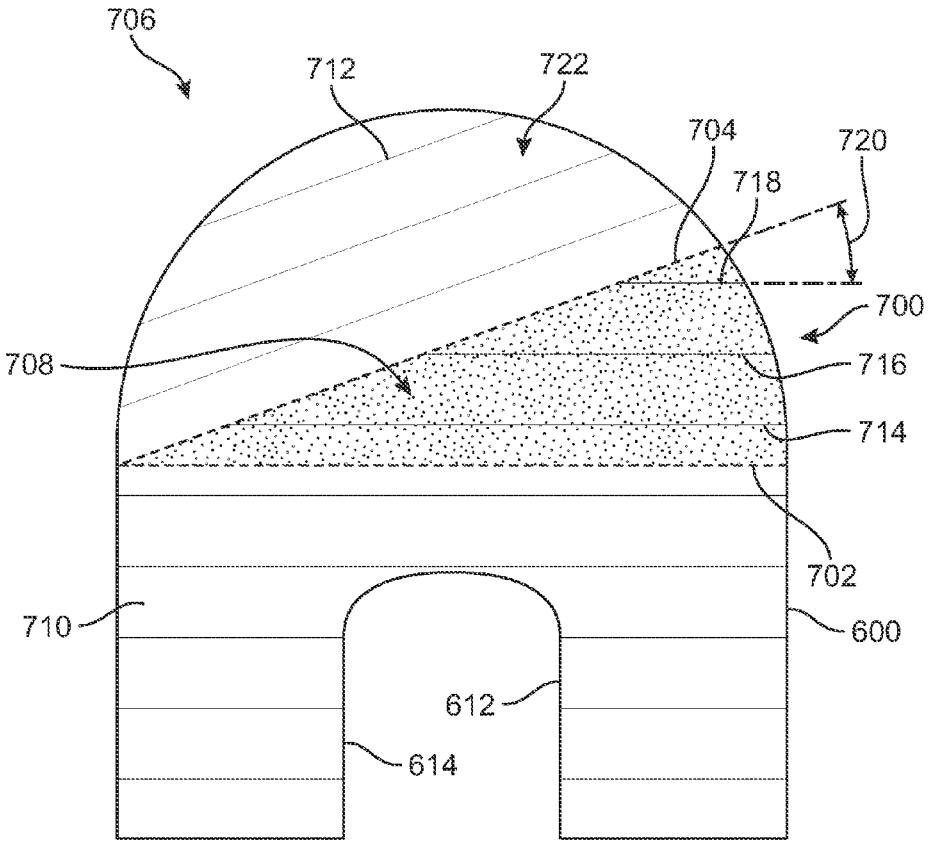
FIG. 7 is a representation of an alternate embodiment of a knitted component utilizing two different knitting directions.

Generally, the shape and size of gores may be determined by parts within gores, as discussed in relation to FIG. 7. As shown in this embodiment, the shape of gore 700 may be defined by initial course 702 and a final course 704. Further, gore 700 may be defined by outer perimeter edge 600. In some cases, gore 700 may also be defined by lateral inner edge 612 and/or medial inner edge 614. Although depicted as a thicker line in the Figures, initial course 702 and final course 704 may be of similar thickness or width to other courses within knitted component 706. In some cases, the courses within knitted component 706 may be thicker or thinner than others. A course may be thicker if the yarn from which the course is created has a higher weight than other courses in knitted component 706. Also, the appearance of a thick or thin course may depend on the stitch density along each course. Additionally, multiple courses may be knit tightly together which may give the appearance of a thicker course.

Additionally, the shape of gore 700 may be further impacted by transition courses 708. Transition courses 708 may include courses that are located between the initial course 702 and final course 704. Transition courses 708 may interact with initial course 702. Transition courses 708 may be used to shape gore 700 and determine the angle at which final course 704 will be at with relation to initial course 702 and transition courses 708.

Referring to FIG. 7, a representation of knitted component 706 is shown having two knitting directions. The knitting direction refers to the orientation of interlooped yarns or strands forming a course or row of loops that are being joined to successive courses through a knitting process. The knitting direction may be generally defined relative to the direction of the knit material being formed during the knitting process. A first knitting direction 710 of knitted component 706 is shown from the heel region 110 into the forefoot region 106. First knitting direction 710 of knitted component 706 may be in the same direction as transition courses 708. A second knitting direction 712 of knitted component 706 is shown in the forefoot region 106 of knitted component 706. Second knitting direction 712 of knitted component 706 may be different than first knitting direction 710 of knitted component 706. In an exemplary embodiment, gore 700 may be used to alter the knitting direction of knitted component 706 from first knitting direction 710 to second knitting direction 712.

Initial course 702 may be of varying length and shape. In some embodiments, the initial course 702 may extend from medial edge 604 to lateral edge 602. In other embodiments, initial course 702 may be of different length such that initial course 702 extends a partial distance from medial edge 604 to lateral edge 602.

In some cases, the length of initial course 702 may be related to transition courses 708. Initial course 702 may interact with transition courses 708. Transition courses 708 may utilize short-row knitting. In the embodiment shown, there are three transition courses. The number of transition courses shown may not be typical and is used in order to clearly show the transition courses. The first transition course 714 may be of a shorter length than initial course 702. Although first transition course 714 is shorter than initial course 702, knitted component 706 may be of unitary knit construction. First transition course 714 may be created by interacting with initial course 702. In some cases, first transition course 714 may be referred to as being "built upon" initial course 702. Built upon, in this sense, indicates that the loops of initial course 702 may interact with the loops of first transition course 714. The loops of first transition course 714 may pass through the loops of initial course 702 such that the first transition course 714 is "built upon" initial course 702. As discussed in more detail below, during the knitting process some needles used to form initial course 702 hold the yarn or loops from initial course 702 and may not accept yarn from first transition course 714. The process which involves needles that do not accept yarn from first transition course 714, may cause first transition course 714 to be of shorter length than initial course 702.

First transition course 714 may interact with a second transition course 716. Second transition course 716 may be built upon first transition course 714 in a similar manner as described above. Second transition course 716 may be of a shorter length than first transition course 714. In some cases, the difference in length between the length of second transition course 716 and the length of first transition course 714 may be the same as the difference in length between the length of first transition course 714 and the length of initial course 702. In other cases, the difference between course lengths may vary. Second transition course 716 may further interact with a third transition course 718. Third transition course 718 may be built upon second transition course 716 in a similar manner as described above. In some embodiments, third transition course 718 may be of a shorter length than second transition course 716. In some cases, the difference in length between the length of third transition course 718 and the length of second transition course 716 may be the same as the difference in length between the length of second transition course 716 and the length of first transition course 714.

As depicted in the Figures, the shape that the transition courses form is a generally triangular shape. It should be recognized that transition courses 708 may not extend in linear fashion and that the shape of the gore 700 may be augmented based on the length of transition courses 708 and thereby deviate from the generally triangular shape to a different shape. Further, although as depicted each successive transition course is smaller than the transition course created just prior, the transition courses may be larger than the one previously created. For example, the outer perimeter edge 600 of the knitted component 706 may bend or bulge at certain locations within gore 700 depending on the desired shape of an article of footwear. In such cases, transition courses may not necessarily continually shorten in length throughout gore 700 as the bulge in the knitted component 706 may be created by longer transition courses in certain areas.

The shape of gore 700 may be determined by the length of the transition courses within gore 700. By varying the length of transition courses within a gore, a greater number of courses are disposed on one side of a knitted component than on the other side of a knitted component. For example, initial course 702 of gore 700 fully extends from outer perimeter edge 600 on medial side 114 to outer perimeter edge 600 on lateral side 116 of knitted component 706. First transition course 714, second transition course 716, and third transition course 718 extend from outer perimeter edge 600 on lateral side 116 toward medial side 114; however, first transition course 714, second transition course 716, and third transition course 718 do not reach outer perimeter edge 600 of knitted component 706 on medial side 114. There are therefore more courses that form gore 700 on outer perimeter edge 600 on lateral side 116 than are on outer perimeter edge 600 on medial side 114 of knitted component 706. The number of courses on outer perimeter edge 600 on lateral side 116 of knitted component 706 effectively increases the width or size of gore 700 along lateral side 116 of outer perimeter edge 600 of knitted component 706, such that the width of gore 700 along outer perimeter edge 600 on lateral side 116 is greater than the width of gore 700 along outer perimeter edge 600 on medial side 114 of knitted component 706.

Once the desired shape of the gore has been created, final course 704 may be formed. Final course 704 may interact with transition courses 708 previously created. In some cases, final course 704 may extend from, and interact with, the last transition course (in this case third transition course 718) through first transition course 714. As such, final course 704 may be built upon transition courses 708 as well as initial course 702. In some embodiments, final course 704 may also interact with initial course 702. In other embodiments, final course 704 may interact with some, but not all, of the transition courses. In such embodiments, the transition courses may extend partially through gore 700.

Final course 704 may be considered the end of gore 700. Final course 704 may further interact with secondary courses 722. Final course 704 may determine the knitting direction at which further courses that are built upon final course 704 are oriented. For example, the knitting direction of final course 704 may be the same knitting direction as the knitting direction of secondary courses 722. The knitting direction of transition courses 708 may be different than the knitting direction of final course 704. The difference between the knitting directions of transition courses 708 and secondary courses 722 may form an angle. The angle may be used to measure the relative position of transition courses 708 to secondary courses 722.

The shape of gores may determine the relative angle at which the knitting direction of secondary courses 722 is to the knitting direction of transition courses 708. In particular, transition courses 708 within gore 700 may be used to influence the angle of secondary courses 722. In some cases, transition courses 708 may slightly decrease in length as each course is created from initial course 702. For instance, first transition course 714 may be 90% the length of initial course 702. Second transition course 716 may be 80% the length of initial course 702. Third transition course 718 may be 70% the length of initial course 702. Final course 704 may interact with transition courses 708, thereby establishing a second knitting direction 712. The angle of final course 704 may be relatively steep due to the relatively small change in percentage length through transition courses 708.

Final course 704 may also establish a relatively moderate angle. For instance, first transition course 714 may be 75% the length of initial course 702. Second transition course 716 may be 50% the length of initial course 702. Third transition course 718 may be 25% the length of initial course 702. Final course 704 may interact with transition courses 708, thereby establishing a second knitting direction 712. The angle of final course 704 may be relatively moderate compared with other gores that utilize courses with smaller changes in length compared to initial course 702 or other courses within transition courses 708. As such, the more gradual change in the length of transition courses 708 throughout gore 700, the greater the angle that is formed by final course 704. Likewise, the more drastic or dramatic the change in the length of transition courses 708 throughout gore 700, the less the angle that is formed by final course 704.

Final course 704 may vary in shape. As depicted, final course 704 is oriented in a generally straight line in comparison to knitted component 706. Although final course 704 is at an angle with respect to initial course 702 and others, final course 704 as depicted does not curve or bend. As discussed above, however, the shape of final course 704 may be determined by transition courses 708 which may vary in length. Final course 704 may be depicted throughout the description in a straight or even manner for ease of explanation and reference.

Gore 700 may be associated with a gore angle 720. Gore angle 720 may be defined as the angle between initial course 702 and final course 704. Other embodiments may incorporate different shapes and orientations than those depicted that may cause gore angle 720 to be an uneven or irregular shape. For the reasons above, straight line courses are illustrated throughout the Figures. For purposes of clarity, transition courses 708 are shown to be in the same orientation as initial course 702 and in an even line. Gore angle 720 may determine the change in orientation that the courses experience from initial course 702 to final course 704. In some embodiments, transition courses 708 may be at the same orientation as initial course 702. In embodiments with transition courses 708 at the same orientation as initial course 702, the angle from the transition courses 708 to final course 704 may define gore angle 720. Secondary courses 722 that interact with final course 704 may be at an orientation equal or substantially similar to the gore angle 720 with respect to initial course 702.

Knitted component 706 in FIG. 7 is an exemplary embodiment of the orientation of courses within a knitted component. In some cases, the courses of a knit element formed using a certain knit stitch may have associated properties due to the type of knit stitch used. In some cases, courses may have stretchable properties. In other cases, courses may have more rigid or durable properties. When oriented in a certain direction, a knitted component may take advantage of these associated properties due to the type of knit stitch used to form the courses of the knit element.

In some embodiments, a knitted component may be configured to have relatively inelastic properties along the course direction. As shown in FIG. 7, knitted component 706 includes one or more courses configured to have relatively inelastic properties along the course direction. The layout depicted in FIG. 7 may be used to limit or restrict stretching of a knitted component when a force is exerted on the knitted component along two different axes. The more closely that first knitting direction 710 and second knitting direction 712 are aligned along a corresponding direction with a force, the more the inelastic properties of the knit stitch may be utilized. Therefore, multiple different knitting directions may be used to accommodate forces directed along multiple angles. Various embodiments of knitted components with different orientations of knitting directions are discussed below.

Figure 8:
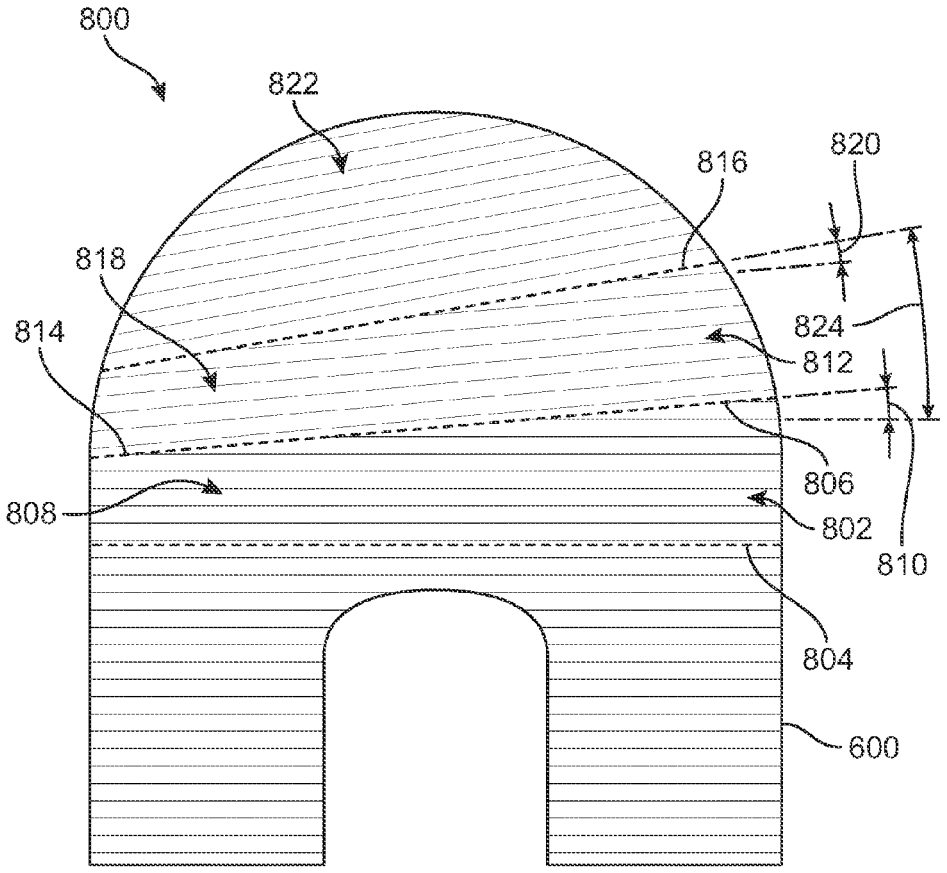
FIG. 8 is a representation of an alternate embodiment of a knitted component with three knitting directions utilizing the same transition angle between the knitting directions.

In some embodiments, multiple gores may be utilized to achieve more than two knitting directions of courses within a knitted component. The various knitting directions of courses may allow for the courses of a knitted component to more precisely align with typical forces as discussed previously in the description. By aligning the courses of a knitted component more precisely with typical forces exerted on the knitted component the forces may be readily accommodated and distributed throughout the knitted component. Referring now to FIG. 8, an embodiment of a knitted component 800 is depicted with three knitting directions, and incorporates two gores. As depicted throughout the description, gores may appear to have many transition courses that are the same length as the initial courses. The drawings are merely representative and may be drawn in this manner in order to illustrate the change in angle in courses, over a series of courses. In the embodiment shown, first gore 802 may be defined by initial course 804, outer perimeter edge 600, and final course 806. As in knitted component 706 of FIG. 7, transition courses 808 may define the angle of final course 806, first gore angle 810. In this embodiment, another gore, second gore 812, is created at the end of first gore 802. Second gore 812 may be defined by initial course 814, outer perimeter edge 600, and final course 816. Transition courses 818 further may define the angle of final course 816, second gore angle 820. In the embodiment depicted, final course 806 and initial course 814 may be the same course. In the instance described, second gore angle 820 is the angle from initial course 814 (or final course 806), to final course 816. Second gore 812 may begin immediately upon the completion of first gore 802. Upon completion of second gore 812, secondary courses 822 may be constructed.

Secondary courses 822 may be located at an angle with respect to an unaltered course. In knitted component 800 of FIG. 8, an unaltered course may be initial course 804. The angle from knitting direction of final course 816 to knitting direction of the initial course 804 may be a course angle 824. In the embodiment shown in FIG. 8, course angle 824 is the sum of first gore angle 810 and second gore angle 820. The course angle may be used to determine the angle of courses with respect to an unaltered course when multiple gores have been utilized. Course angle 824 may depict the overall effect that first gore 802 and second gore 812 have on the courses within a knitted component. In other embodiments more or less gore angles may be present in the knitted component. In some embodiments, the gore angle may be substantially the same as the course angle. In such cases, there may be a single gore which is utilized in a knitted component.

The gore angles discussed below are not meant to be an exact representation of what is shown in the Figures. The exemplary amounts of degrees of the angles are merely representative to generally discuss what may be accomplished in embodiments of knitted component 800. In some embodiments, gore angles may be small. Knitted component 800 in FIG. 8, for example, first gore angle 810 may be approximately five degrees. Second gore angle 820 may also be approximately five degrees. In this case, course angle 824 may be approximately ten degrees, which may be calculated by adding the degrees of first gore angle 810 and second gore angle 820. Secondary courses 822 may be positioned at an angle of ten degrees with respect to unaltered courses.

Figure 9:
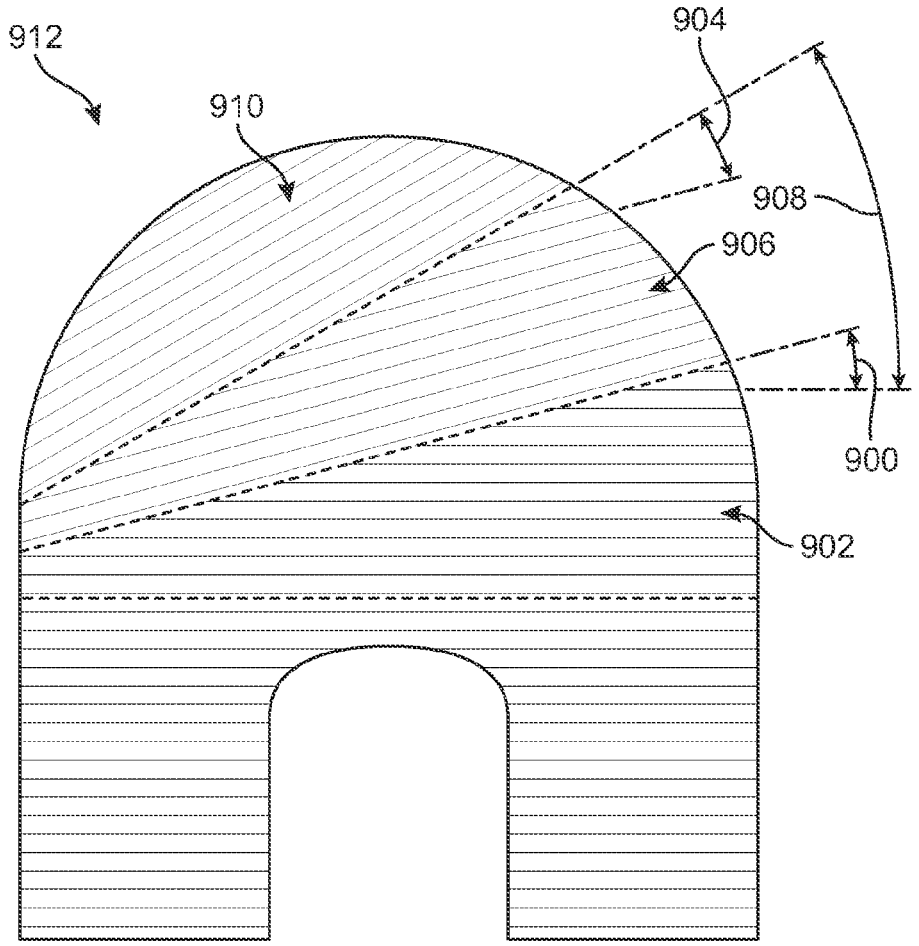
FIG. 9 is a representation of an alternate embodiment of a knitted component with three knitting directions utilizing the same transition angle between the knitting directions.

In some embodiments, the gore angles may be greater than the gore angles discussed in FIG. 8. In FIG. 9, for example, first gore angle 900 of first gore 902 may be approximately fifteen degrees. Second gore angle 904 of second gore 906 may also be approximately fifteen degrees. In this case, course angle 908 may be approximately thirty degrees calculated by adding first gore angle 900 of fifteen degrees and second gore angle 904 of fifteen degrees. Secondary courses 910 may run at an angle of approximately thirty degrees with respect to unaltered courses. Differently spaced and angled gores may be utilized depending on the nature, direction, and/or magnitude of force to which knitted component 912 may be subjected.

Figure 10:
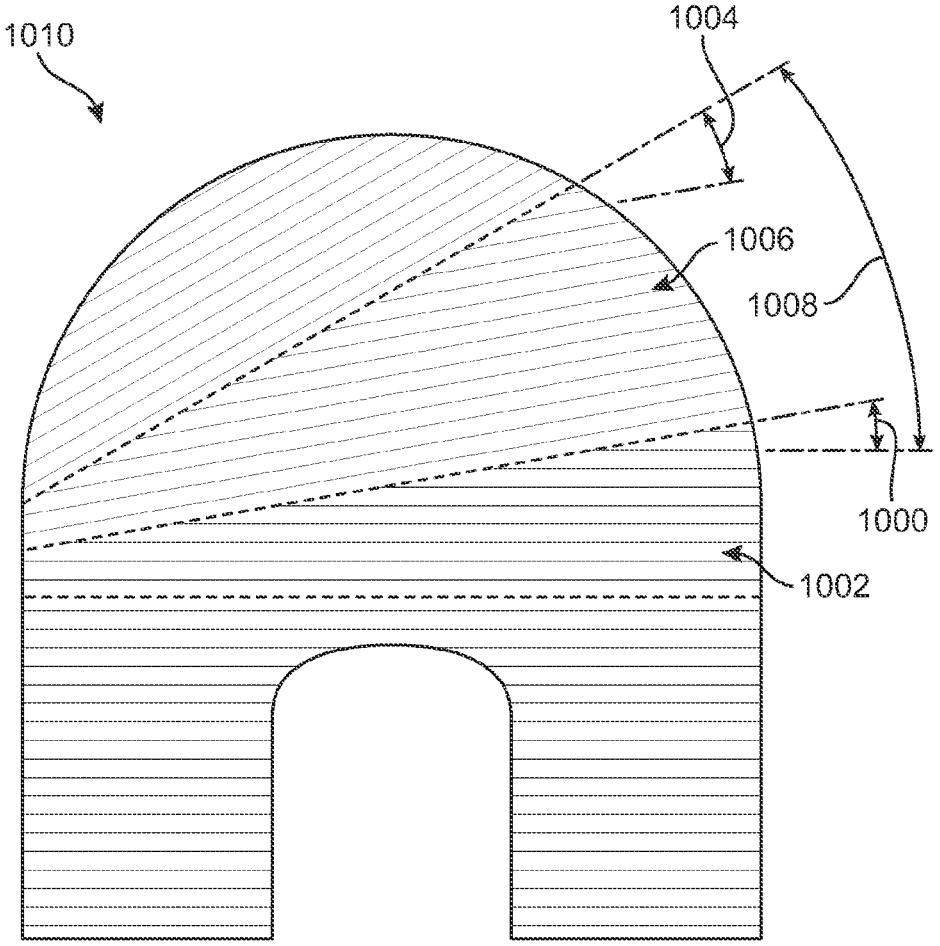
FIG. 10 is a representation of another alternate embodiment of a knitted component with three knitting directions utilizing different transition angles between the knitting directions.
Figure 11:
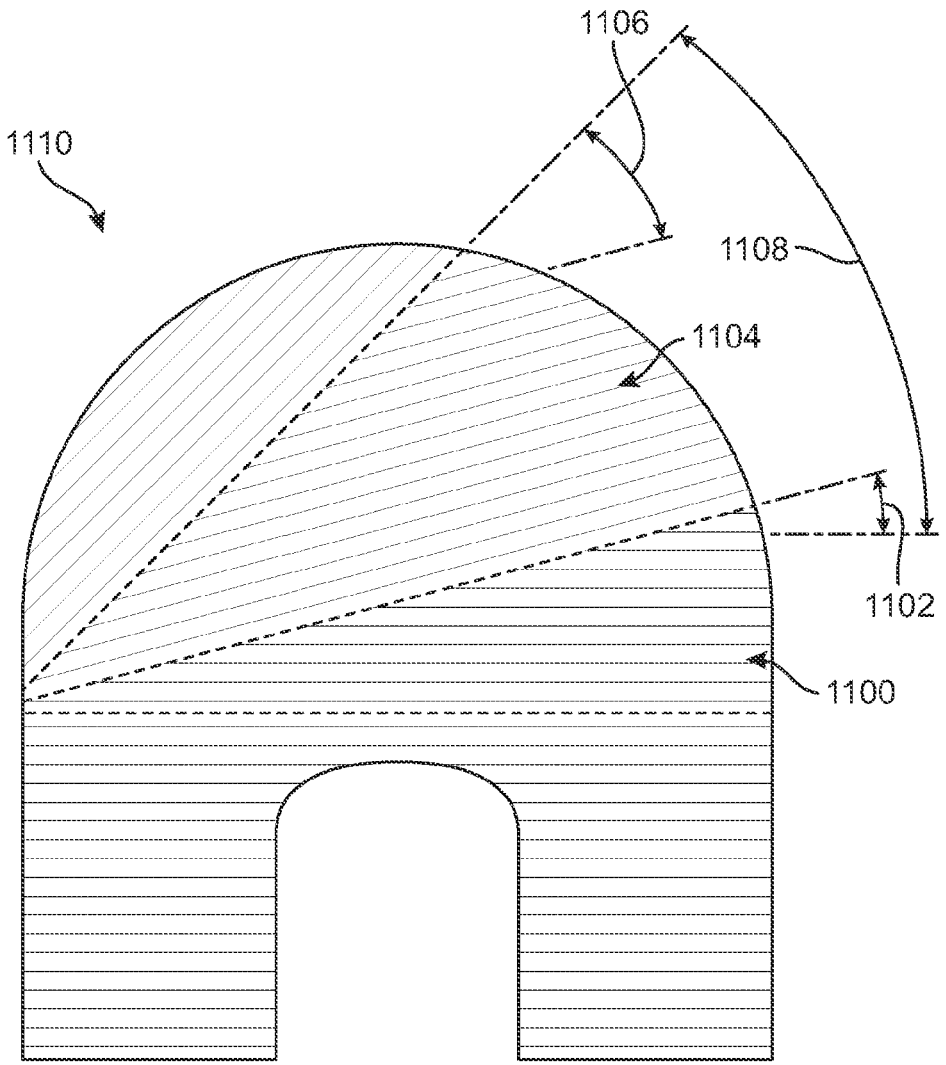
FIG. 11 is a representation of another alternate embodiment of a knitted component with three knitting directions in which the course angle is steep.
Figure 12:
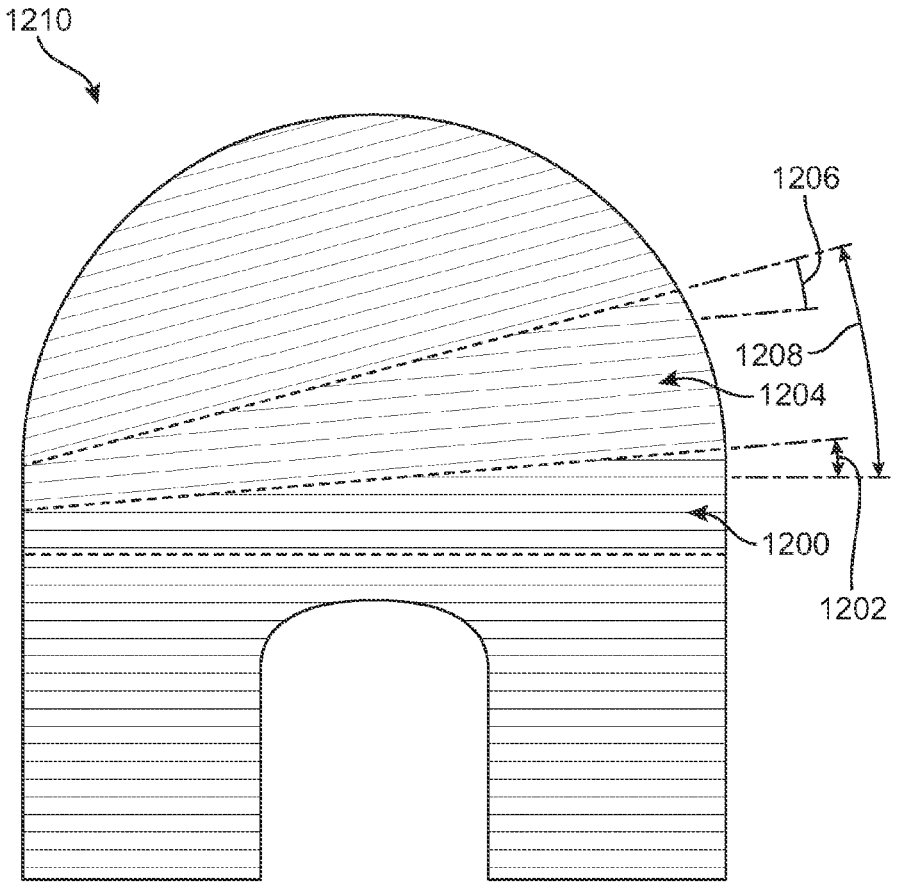
FIG. 12 is a representation of another alternate embodiment of a knitted component with three knitting directions in which the course angle is moderate.

In some embodiments, the gore angles associated with each gore may be different from one another throughout the knitted component. Referring to FIGS. 10-12, various knitted components may include gores oriented to create two or more different gore angles within the respective knitted component. Referring to knitted component 1010 in FIG. 10, first gore angle 1000, formed by first gore 1002, may be approximately ten degrees. Second gore angle 1004, formed by second gore 1006, may be a greater angle such as approximately forty degrees. In this case, course angle 1008 may be approximately fifty degrees which is calculated by adding first gore angle 1000 of ten degrees to second gore angle 1004 of forty degrees.

The gore angles within the knitted component may be changed in a more gradual or steep fashion as needed to accommodate typical forces within article of footwear 100. Some embodiments may require steep gore angles and course angles. Steep gore angles and course angles may be desired in certain configurations due to the typical forces that the article of footwear may be exposed to. For example, some articles of footwear may be utilized in an activity that may typically result in force being exerted substantially along the longitudinal direction of an article of footwear. The steep gore angles may orient the courses of a knitted component in such a manner as to distribute the substantially longitudinal forces. In such cases, the gore angles may be steeper than in articles of footwear utilized in activity that may typically result in a force being exerted in a substantially lateral direction along an article of footwear. Comparing FIG. 11 and FIG. 12, first gore 1100 of knitted component 1110 may be associated with a first gore angle 1102 that is larger than first gore angle 1202 associated with first gore 1200 of knitted component 1210. Further, second gore 1104 may be associated with a second gore angle 1106 that is larger than second gore angle 1206 associated with second gore 1204. The larger gore angles of knitted component 1110 in FIG. 11 may be associated with a course angle 1108 that is greater than course angle 1208 of knitted component 1210 in FIG. 12. The different angles shown may be utilized dependent on the forces likely to be experienced by each knitted component. For example, knitted component 1110 in FIG. 11 may be designed to distribute forces along different angles than the knitted component 1210 in FIG. 12. As shown, knitted component 1110 may be designed in order to accommodate force in a more longitudinal direction than knitted component 1210.

Figure 13:
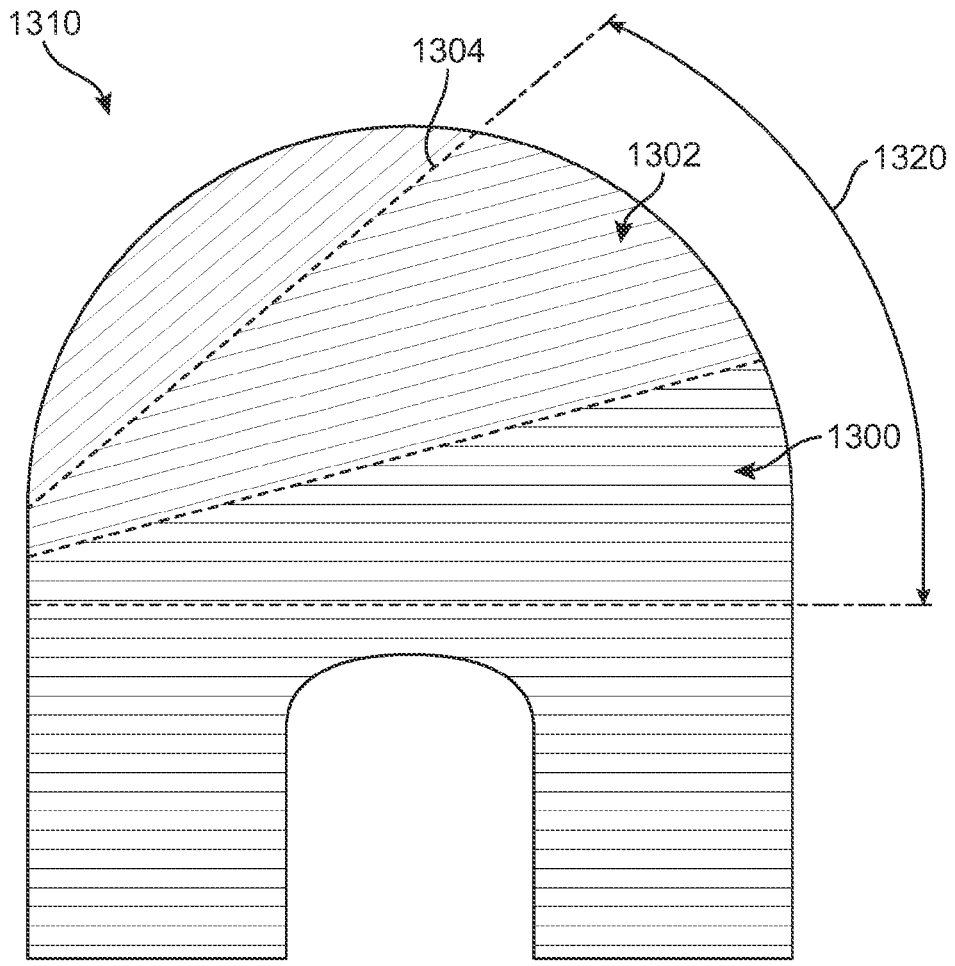
FIG. 13 is a representation of another alternate embodiment of a knitted component with three knitting directions.
Figure 14:
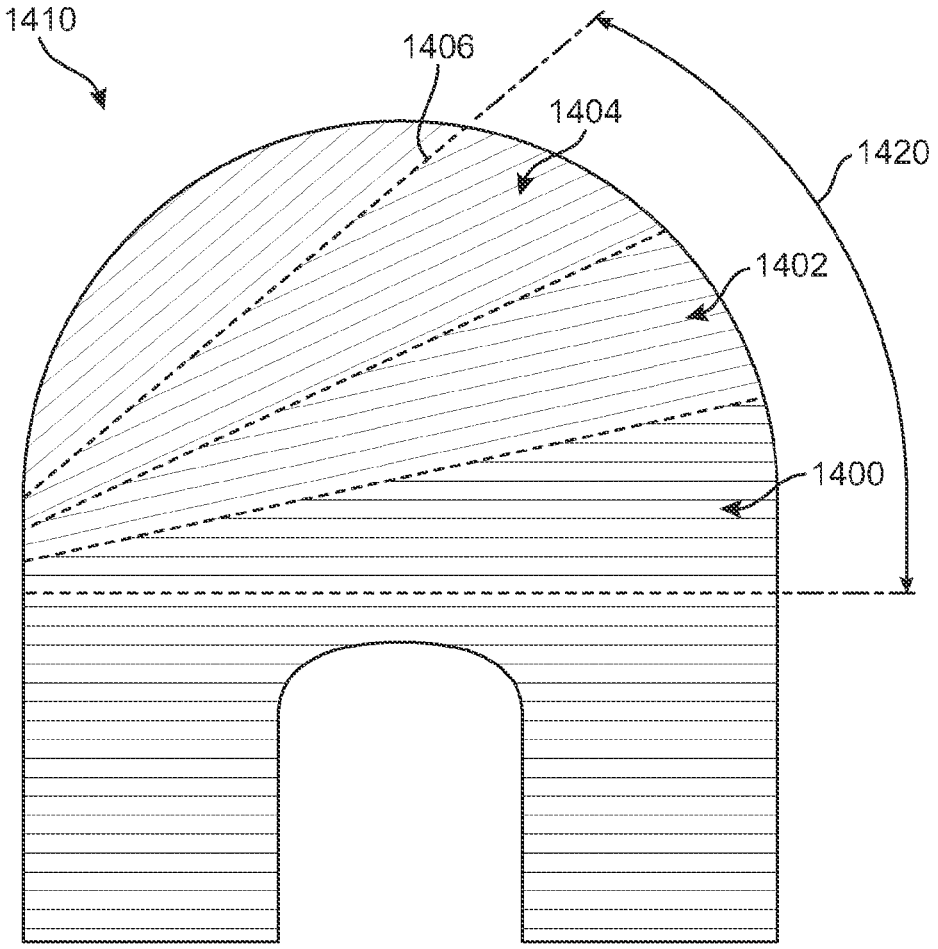
FIG. 14 is a representation of another alternate embodiment of knitted a component with four knitting directions.

Different course angles may be achieved using different numbers of gores. As depicted in FIGS. 13 and 14, different numbers of gores may be arranged in each knitted component such that the same course angle may be achieved. Knitted component 1310 in FIG. 13 includes two gores (gore 1300, gore 1302), while knitted component 1410 in FIG. 14 includes three gores (gore 1400, gore 1402, gore 1404). Final course 1304 and final course 1406 may be located at the same relative position within each of the knitted components shown. Both configurations of gores within knitted component 1310 and knitted component 1410 achieve the same course angle, depicted as course angle 1320 and course angle 1420, however, each utilizes a different number of gores. Accordingly, FIGS. 13 and 14 illustrate that more or less gores may be used to achieve a certain desired course angle in a knitted component. By using three gores in knitted component 1410, a more gradual shift of the courses may occur throughout knitted component 1410 than the shift in courses within knitted component 1310. The use of three gores may be used in some embodiments to more evenly distribute force exerted on knitted component, and will be discussed in further detail in the description. While three gores are shown in knitted component 1410, it should be recognized that many gores may be used in order to achieve an even more gradual shift in knitting direction of the courses, and therefore a more even force distribution, within each knitted component.

Figure 15:
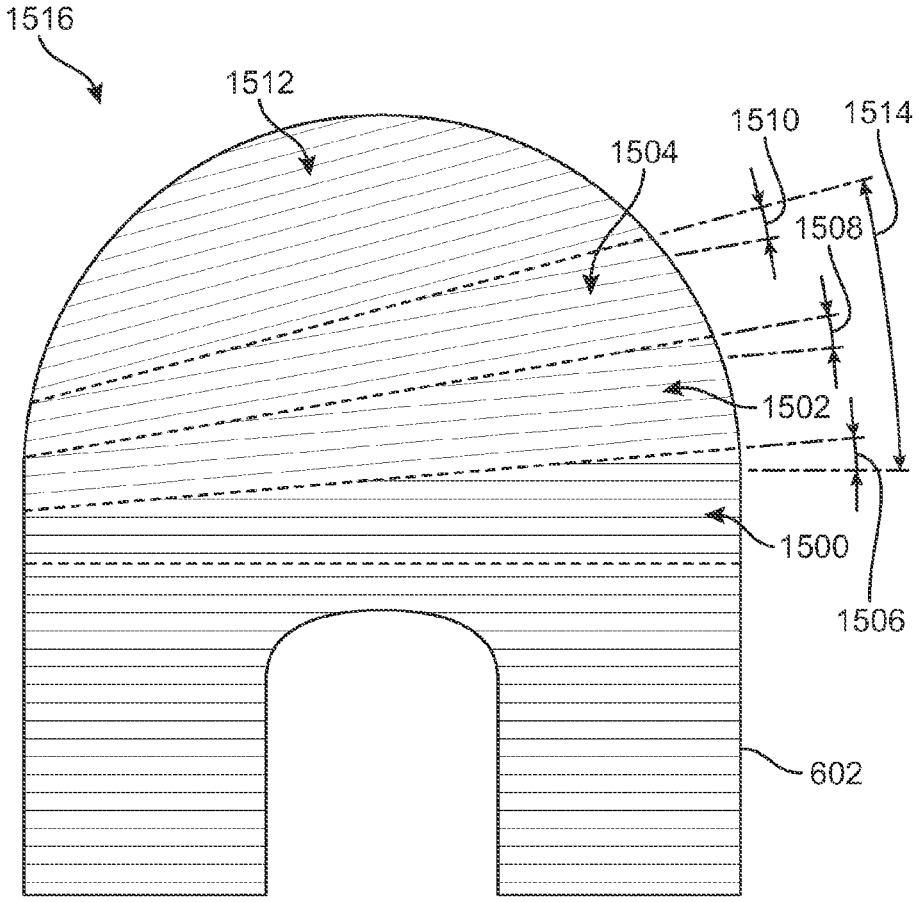
FIG. 15 is a representation of another alternate embodiment of a knitted component with four knitting directions utilizing the same transition angle between the knitting directions.
Figure 16:
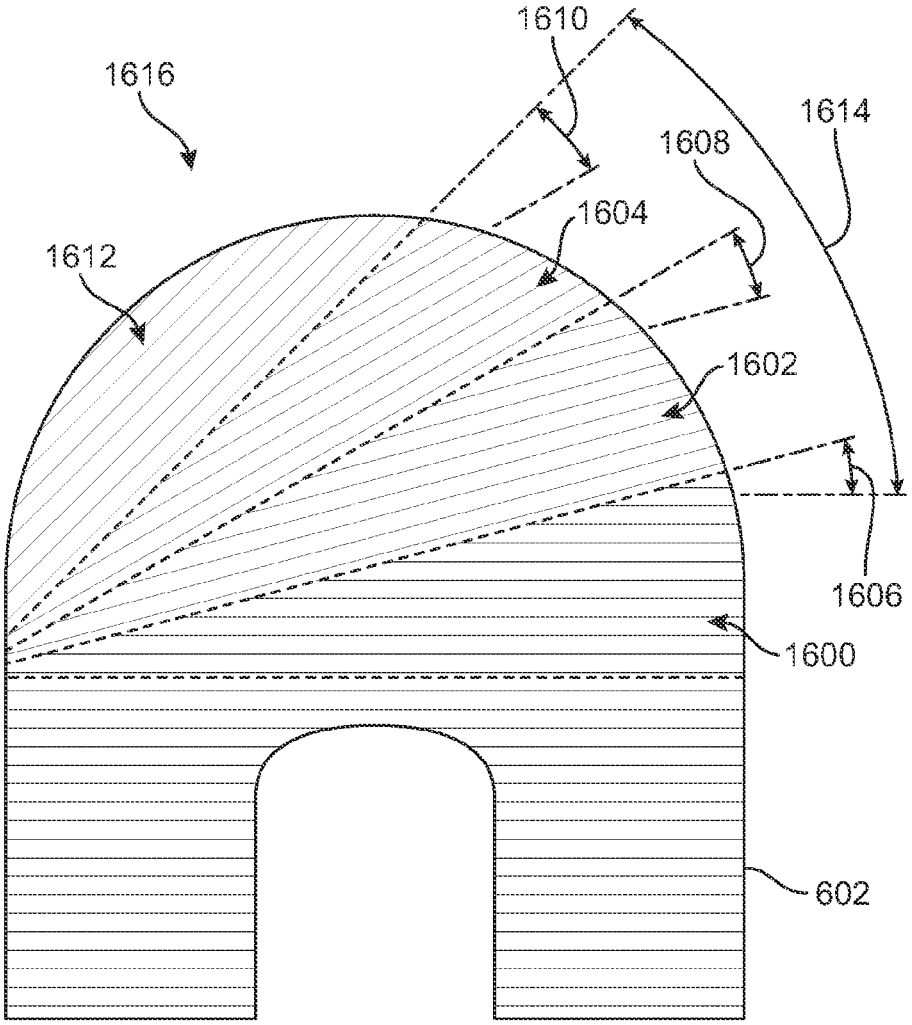
FIG. 16 is a representation of another alternate embodiment of a knitted component with four knitting directions utilizing the same transition angle between the knitting directions.

FIGS. 15 through 20 illustrate different embodiments of knitted components utilizing three gores. These different embodiments demonstrate the customizable arrangement and number of the gores within each knitted component. For example, FIGS. 15 and 16 illustrate a knitted component utilizing three gores with the same gore angle. In knitted component 1516 of FIG. 15, the gores (first gore 1500, second gore 1502, and third gore 1504) may be formed in such a manner that the gore angle of each gore is substantially the same. In knitted component 1516, the gore angles (first gore angle 1506, second gore angle 1508, and third gore angle 1510) are all approximately five degrees. In knitted component 1616 of FIG. 16, the gores (first gore 1600, second gore 1602, and third gore 1604) may be formed in such a manner that the gore angle of each is the same. The gore angles (first gore angle 1606, second gore angle 1608, and third gore angle 1610) of knitted component 1616 are all approximately fifteen degrees. Secondary courses 1512 of knitted component 1516 may be at course angle 1514 of approximately fifteen degrees, which is the sum of the gore angles of knitted component 1516. Secondary courses 1612 of knitted component 1616 may be at course angle 1614 of approximately forty-five degrees, which is the sum of the gore angles of knitted component 1616. In this case, the gore angle of each gore located on knitted component 1616 is the same as course angle 1514 of knitted component 1516.

Not only are the angle of secondary courses 1512 and secondary courses 1612 different, but the amount of the knitted component affected by the secondary courses is different. In knitted component 1516 secondary courses 1512 run from lateral edge to medial edge. Secondary courses 1512 further largely encompass the toe area of knitted component 1516. In comparison to secondary courses 1612, secondary courses 1512 may cover a larger area of the knitted component.

The amount of the knitted component affected by gores and transition courses may also vary from knitted component 1516 to knitted component 1616. In knitted component 1616, each gore may encompass a larger portion of lateral edge 602 than in knitted component 1516. Larger gores may indicate that the knitting direction of the transition courses within each gore may be maintained over a larger area of the lateral portion of knitted component 1616 than in knitted component 1516. In some cases, the knitting direction of the transition courses may be maintained in order to distribute varying forces over a large portion of knitted component 1616. In knitted component 1516, the knitting direction at course angle 1514 may be retained over a smaller portion of the knitted component 1516. That is, secondary courses 1512 cover, or extend over, a smaller longitudinal portion of knitted component 1516 than do secondary courses 1612 of knitted component 1616. Smaller gores may indicate that the knitting direction of the transition courses within each gore may be maintained over a smaller area of the lateral portion of knitted component 1516 than in knitted component 1616. In some cases, the knitting direction of the transition courses may be maintained in order to distribute varying forces over a small portion of knitted component 1516.

Figure 17:
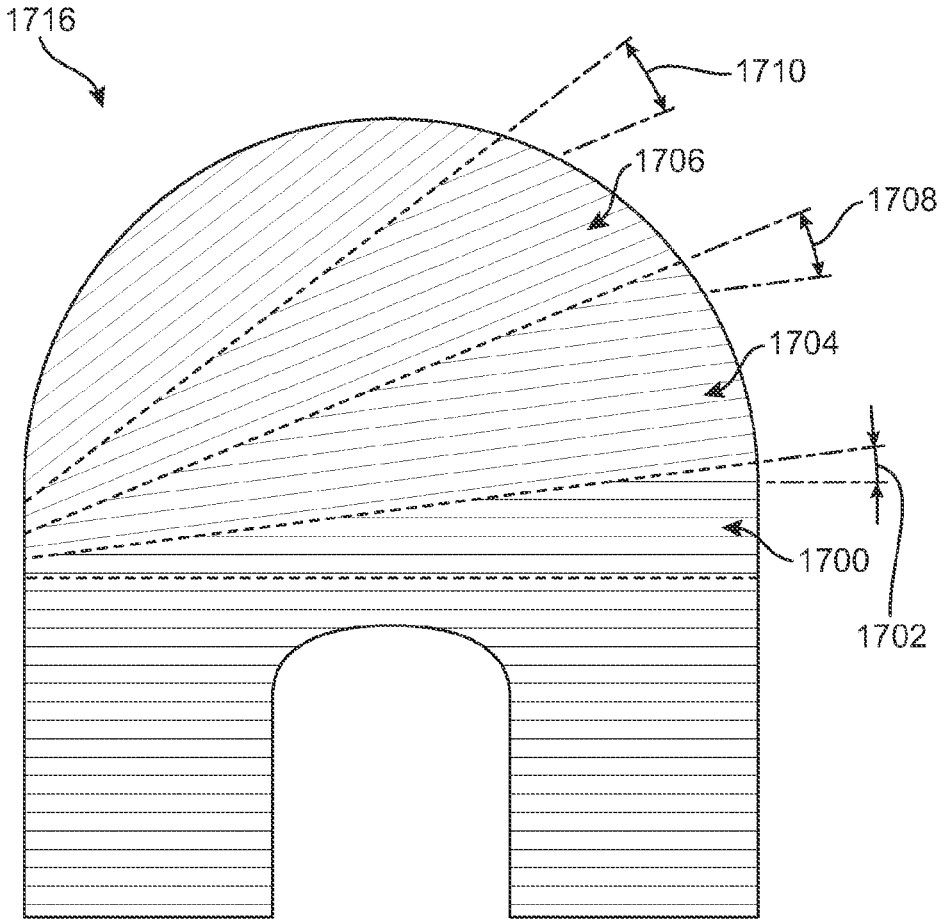
FIG. 17 is a representation of another alternate embodiment of a knitted component with three larger transition angles and one smaller transition angle.
Figure 18:
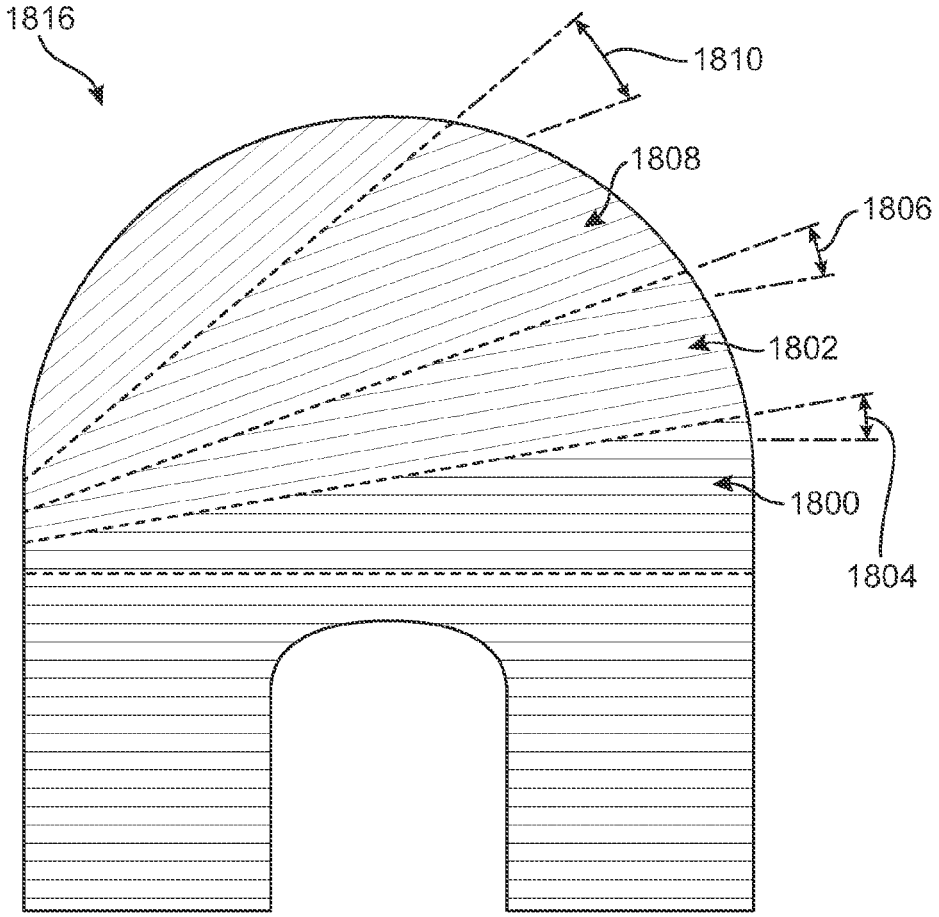
FIG. 18 is a representation of another alternate embodiment of a knitted component with two smaller transition angles and two larger transition angles.

Referring to FIGS. 17 and 18, different combinations of gore angles may be utilized to vary the knitting direction of courses to distribute forces that may act on each knitted component. Referring to FIG. 17, knitted component 1716 may utilize a first gore 1700 with a first gore angle 1702 of approximately ten degrees, and two other gores, second gore 1704 and third gore 1706, with angles (second gore angle 1708 and third gore angle 1710) of approximately twenty degrees. Further, as shown in FIG. 18, knitted component 1816 may include two gores (first gore 1800 and second gore 1802) that utilize gore angles (first gore angle 1804 and second gore angle 1806) of approximately ten degrees while a third gore 1808 utilizes a third gore angle 1810 of approximately twenty degrees. The Figures illustrate the ability of the gores to be combined with gores of other angles in order to achieve certain purposes, such as distribution of forces. In some cases, the force exerted in a direction along the courses may be different along the edges of the knitted component. In some cases, the different angles of gores may be used in order to accommodate the different forces acting along different directions of a knitted component.

Figure 19:
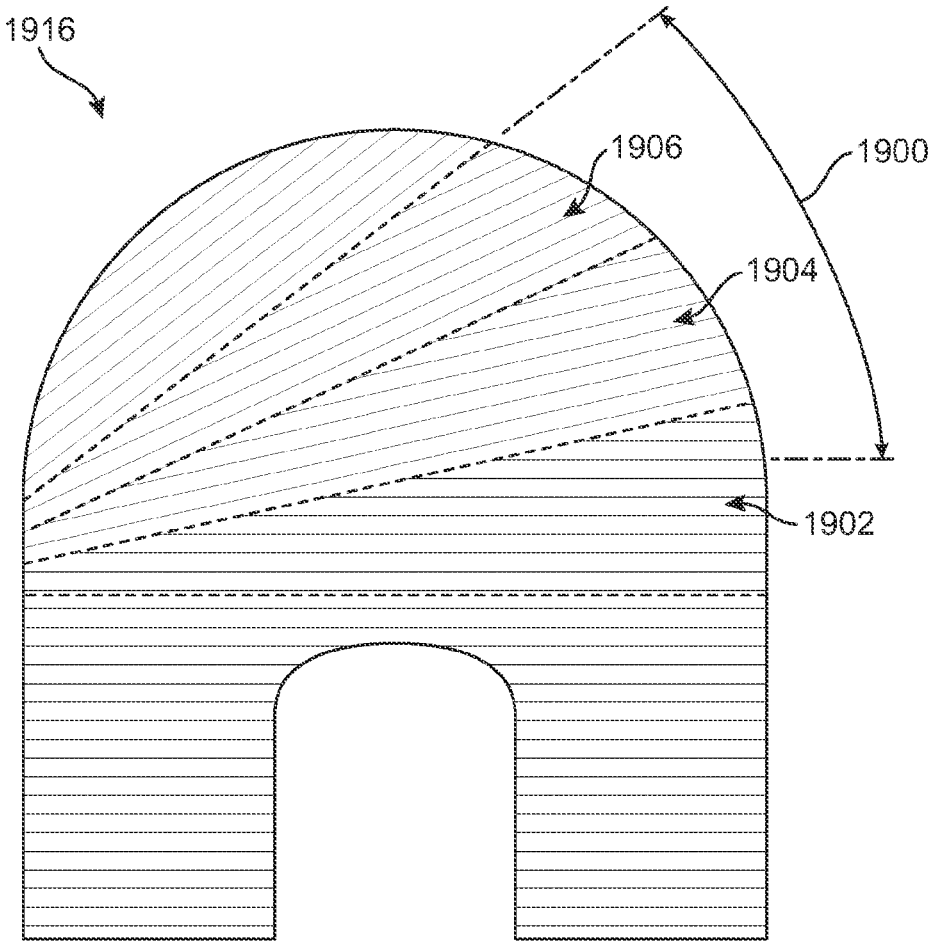
FIG. 19 is a representation of another alternate embodiment of a knitted component with four knitting directions in which the final course angle is steep.
Figure 20:
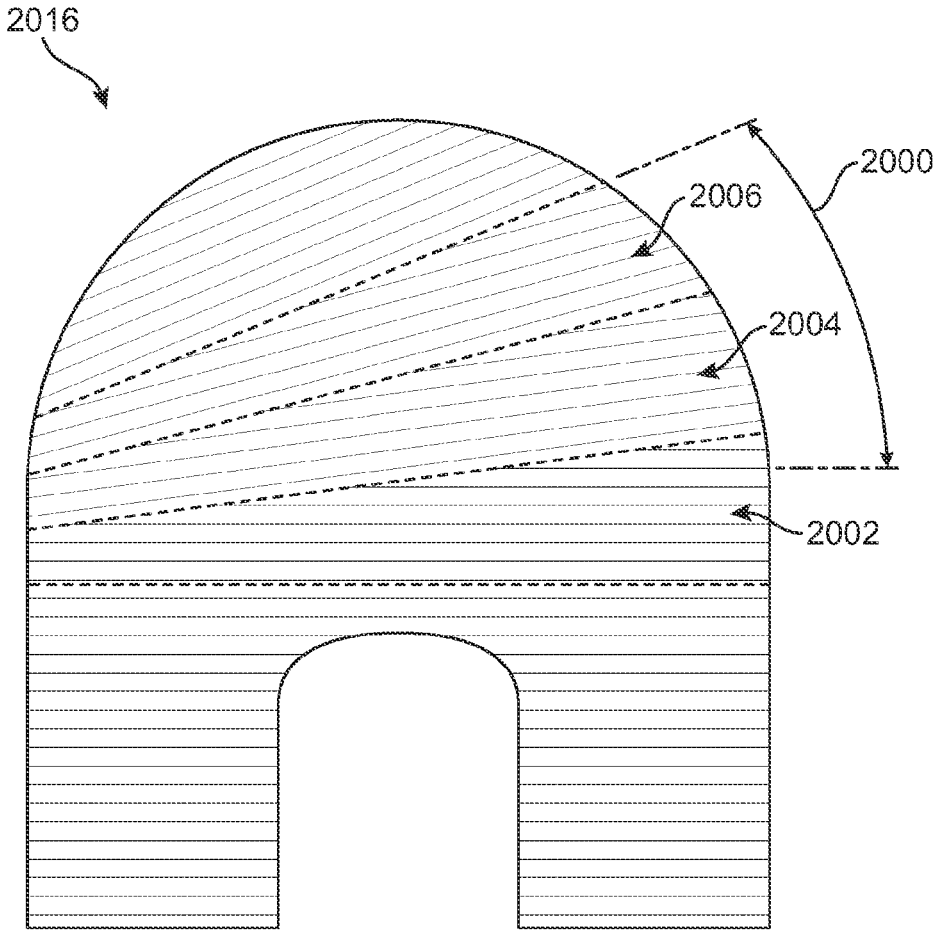
FIG. 20 is a representation of another alternate embodiment of a knitted component with four knitting directions in which the final course angle is moderate.

Referring to FIGS. 19 and 20, different course angles may be utilized in order to vary the knitting direction of courses so that forces that may act on different areas within each knitted component may be distributed through the courses. Referring to knitted component 1916 in FIG. 19, three gores (first gore 1902, second gore 1904, and third gore 1906) are utilized in order to achieve course angle 1900. Referring to knitted component 2016 in FIG. 20, three gores (first gore 2002, second gore 2004, and third gore 2006) are utilized in order to achieve course angle 2000. Although the same number of gores are utilized in both knitted component 1916 and knitted component 2016, course angle 1900 may be greater than course angle 2000. In some cases, a greater change in course angle may be used in order to accommodate forces acting within a knitted component. For example, knitted component 1916 may be designed in order to accommodate more of a force in the tip or end of knitted component 1916 that is directed more closely along a longitudinal direction from heel region 110 to forefoot region 106 than knitted component 2016 is designed to accommodate. With this arrangement, gores, secondary courses, and transition courses may be utilized in different manners in order to accomplish force distribution in a knitted component.

Knit Construction

Figure 21:
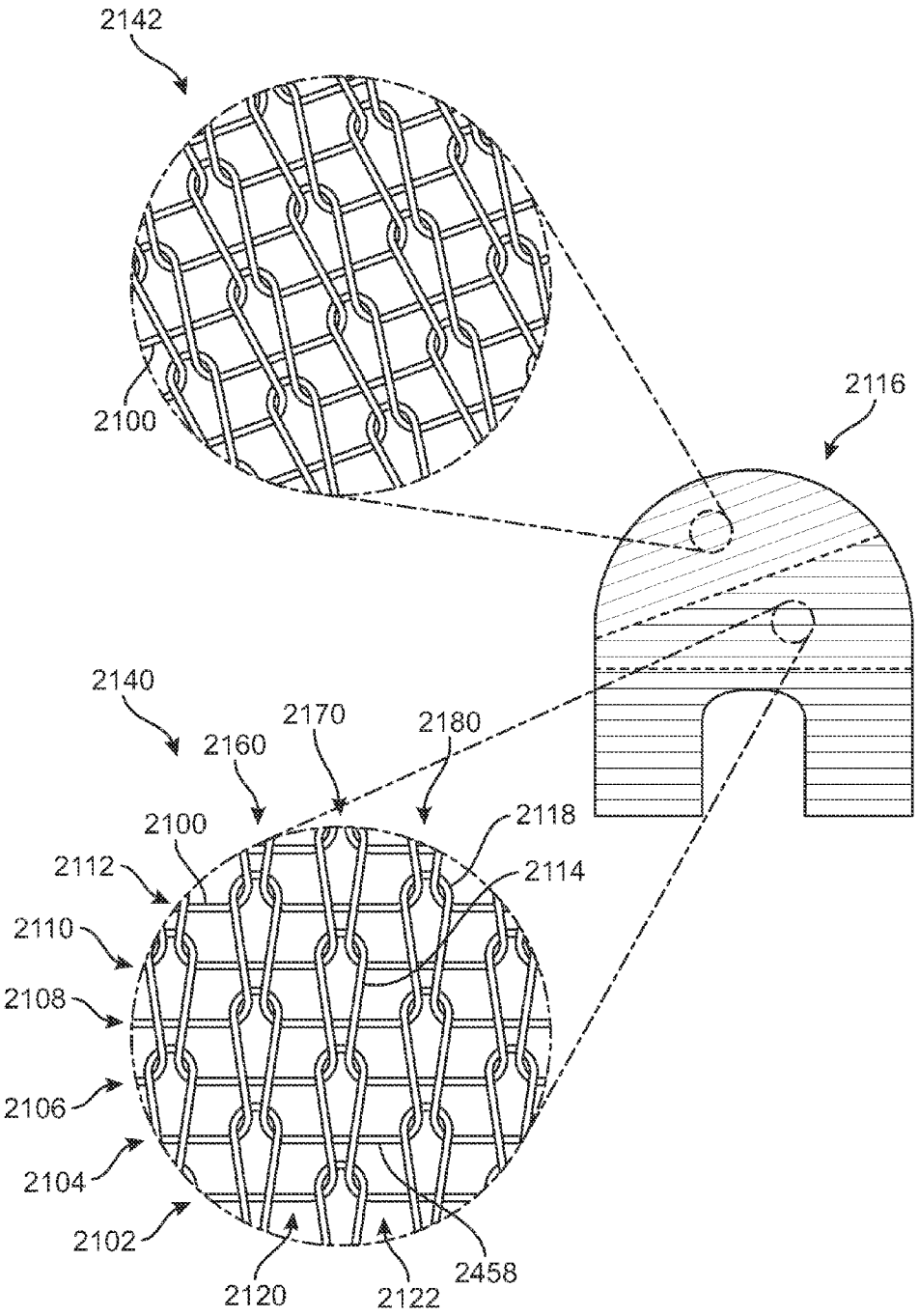
FIG. 21 is a representation of another alternate embodiment of a knitted component with an enlarged view of the alternating float loop as utilized in an embodiment.

Articles of footwear may include provisions to increase rigidity, strength, or durability. Some embodiments may utilize more than one yarn. Referring to FIG. 21, yarn 2100 may further be formed from at least one of a thermoset polymer material and natural fibers (e.g. cotton, wool silk) or may be formed from a thermoplastic polymer material. Generally, a thermoplastic polymer material melts when heated and returns to a solid state when cooled. In particular, the thermoplastic polymer material transitions from a softened or liquid state when subjected to sufficient heat, to a solid state when sufficiently cooled. The change in properties may be used to join two objects or elements together. The bonded elements may increase strength, stability, and durability within article 100. Further, the thermoplastic material may be utilized without exposing the thermoplastic material to heat to increase strength, stability and durability.

In some embodiments, certain stitches may be used to achieve strength, stretchability, comfort, elasticity or appearance, among other properties within a knitted component. In some cases, a stitch may be used for its properties in the course and wale direction. In other cases, a stitch may be chosen for its properties in the course direction. In further cases, a stitch may be chosen for its properties in the wale direction. In some cases, a jersey stitch may be utilized. In other cases, a rib stitch may be utilized. In further cases, a purl stitch may be utilized. In still further cases, float loops and held loops may be utilized. In an exemplary embodiment, a stitch using alternating float loops may be utilized. The different stitches may be utilized in various areas of knitted component. For example, a stitch with stretchable properties may be utilized in an area of a knitted component where stretch is desired. Other areas of a knitted component may utilize a non-stretchable stitch where strength and rigidity are desired. In some cases, the properties of the stitch may be realized along the course or wale direction. In some cases, the knitting direction of the courses of the knitted component may be altered in order to realize the properties of each stitch.

A knitted component may include provisions to increase strength and decrease stretchability. A knitted component may include a knit element. A knit element may be formed using one or more types of knit structures. A knit structure may be formed by interlooped yarns arranged into courses and wales with a particular knit stitch configuration. Referring to FIG. 21, an embodiment of a knitted component 2116 utilizing an alternating float loop knit stitch is depicted. An alternating float loop, as discussed throughout the description refers to a stitch utilizing a float loop in alternating wales of a knit structure. For example, FIG. 21 shows columns of a knit structure 2140. Knit structure 2140 may be used to form a portion of a knitted component 2116. The columns may be referred to as wale 2160, wale 2170, and wale 2180. Further disclosed are rows formed by knit structure 2140. The rows may be referred to as course 2102, course 2104, course 2106, course 2108, course 2110, and course 2112. Referring to wale 2170, a float loop may be demonstrated. Referring to loop 2114, the interaction of a float loop may be demonstrated. As shown, loop 2114 passes over course 2108, minimally interfering or interacting with course 2108. The lack of interaction with the course 2108 indicates a float loop for purposes of the description. Loop 2114 floats over course 2108. Further, other loops within knitted component 2116 may be of similar construction. In the embodiment shown, loop 2118 extends across course 2110 with minimal interaction with the yarn.

Float loops may be used in different orientations or patterns. In FIG. 21 an alternating float loop pattern is depicted. Comparing wale 2170 and wale 2180, the loops in each of the wales do not occur on the same strand. For example, loop 2114 passes over course 2108 while loop 2118 interacts with course 2108, and is created from course 2108. Likewise, loop 2118 passes over course 2110 with which loop 2114 interacts. In this manner, knit structure 2140 may incorporate an alternating float loop stitch. In drawings shown, there is a space between each of the wales. This space is created by not engaging a needle in that location during the knitting process. The knitting process is discussed in more detail below.

FIG. 21 illustrates enlarged portions of knitted component 2116, knit structure 2140 and knit structure 2142. Knit structure 2140 and knit structure 2142 may be formed using a single gap alternating float loop. The alternating float loop orientation and configuration may be altered in amount of spacing between the wales. In some cases, there may be five spaces or gaps between wales. In other cases, there may be seven spaces between the wales.

In some embodiments a stitch may be used to increase stretch-resistance. In some embodiments, a stitch may be used to increase stretch resistance along the knitting direction. In other embodiments, a stitch may be used to increase stretch-resistance along a direction orthogonal to the knitting direction. In still further embodiments, a stitch may be used to increased stretch-resistance along both the knitting direction and a direction orthogonal to the knitting direction. In some embodiments, a stepped-alternating float loop stitch may be utilized.

Figure 22:
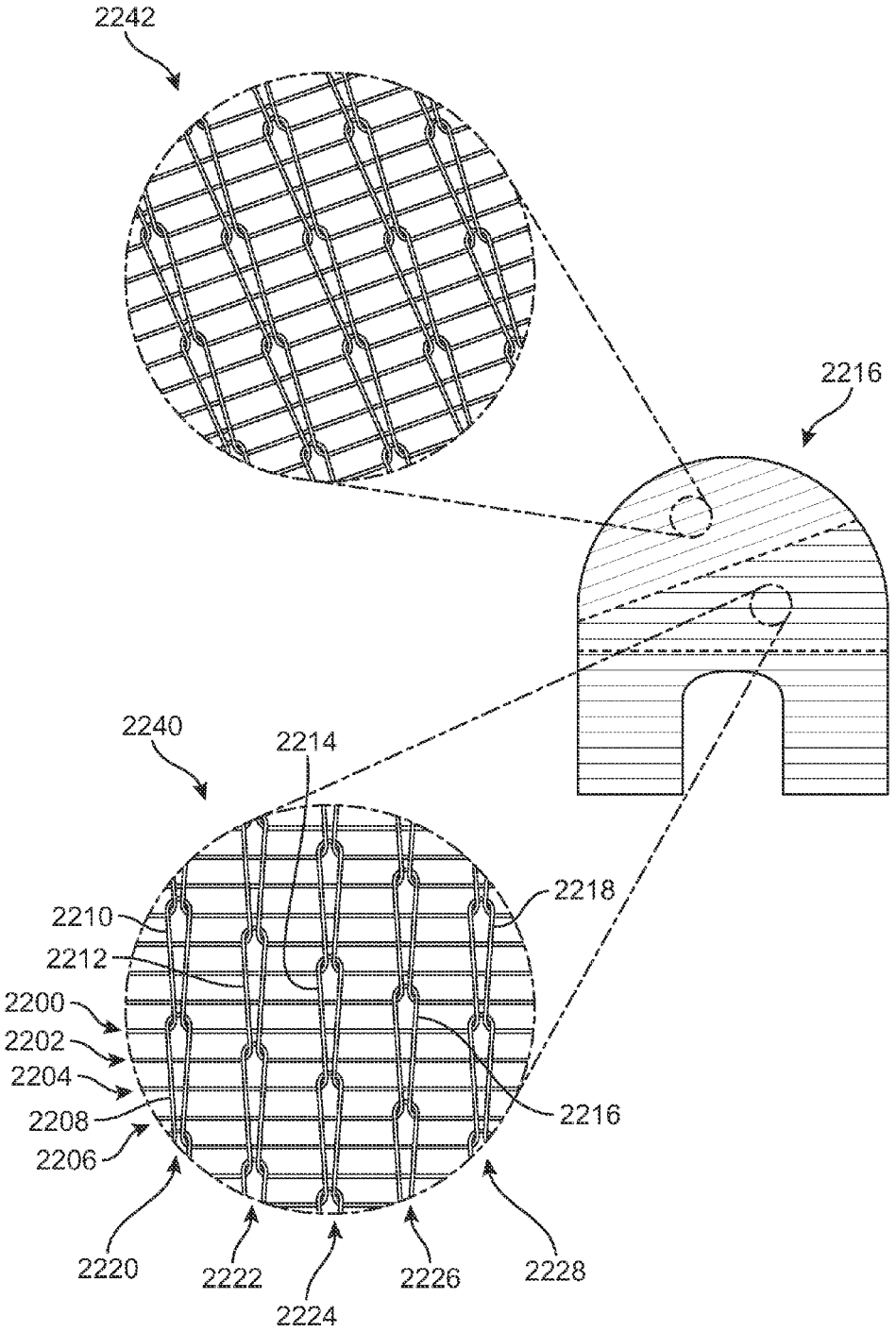
FIG. 22 is a representation of another alternate embodiment of a knitted component with an enlarged view of the embodiment using a modified alternating float loop.

FIG. 22 illustrates enlarged portions of knitted component 2216, depicted as knit structure 2240 and knit structure 2242. Knit structure 2240 and knit structure 2242 each include an alternating float loop stitch configuration. As shown, the alternating float loop configuration includes a stepped alternating float loop stitch. In a stepped alternating float loop stitch, an initial course includes connected loops along the same wale that spans across multiple adjacent courses and the adjacent courses each similarly include connected loops along adjacent wales that are different from the wale having the connected loops from the initial course and also span across multiple adjacent courses. The resulting knit structure has a plurality of connected loops that are located in each next successive wale and each next successive course in a step or stair like configuration.

Referring to knit structure 2240, loop 2210 is created from yarn of course 2200 in wale 2220. Course 2200 does not supply yarn to a loop until loop 2218 is created in wale 2228. Between wale 2220 and wale 2228 a stepped pattern of loops is created. Course 2202 supplies yarn to loop 2212 in wale 2222. Course 2204 supplies yarn to loop 2214 in wale 2224. Course 2206 supplies yarn to loop 2216 in wale 2226. As such, each course passes through three wale locations before creating another loop. While the depictions shows that a course passes through three wale locations, it should be recognized that other configurations may include courses that pass through more or fewer wale locations before creating a loop.

Each loop as discussed above further floats over three courses. For example, loop 2208 passes over course 2206, course, 2204 and course 2202. In other embodiments, the number of courses which each loop passes over may be higher or lower. In some embodiments, the number of courses that each loop passes over may correlate to the number of wales each course passes through. For example, course 2200 passes through three wale locations before another loop is created. Likewise, loop 2212 passes over three courses.

The construction of knit structure 2240 and knit structure 2242 may allow for greater stretch resistance than knit structure 2140 and knit structure 2142. The larger amount of gaps depicted in the knit structures in FIG. 22 allow for a greater portion of knit structure 2240 and knit structure 2242 to be in a generally straight line orientation, that is, a generally lateral direction along the knitting direction. Further, knit structure 2240 and knit structure 2242 may include fewer loops in each course as compared to the knit structures in knitted component 2116. The use of fewer loops in the course may increase the stretch resistance of knit structure 2240 and knit structure 2242.

Further, the orientation of the stepped alternating float loops may allow for stretch resistance in the longitudinal direction or along the wale direction.

In some cases, the gaps between wales may be inconsistent. For example, knit structure 2140 in FIG. 21 has one gap that is located between the wales at gap 2120 and gap 2122. In some embodiments, the gaps may be an inconsistent or fluctuating number. In some embodiments, the gap may be one needle width for a portion of the knit structure and three needle widths in another area. The gap amount may vary from wale to wale in order to impart properties to the knit structure. For example, a knit structure with more gaps between the wales may be less stretchable than a knit structure with fewer gaps between the wales.

Further, the float or skip amount may change from loop to loop. As depicted in FIG. 21, the float loops skip one course. In some cases, loops may skip multiple courses. In other cases, each loop may skip one course. In further cases, some loops may skip less while others skip more within the same knit structure. A knit structure may be manufactured in order to take advantage of the particular properties, such as less stretchability, of a knit structure utilizing differing float or skip amounts. Larger skips may be used in certain cases within a knitted component and smaller skips may be used in other areas within the same knitted component in order to accommodate the different forces that a knitted component may experience in different areas. The amount of skips in a knit structure may be placed particularly in order to accommodate the different forces.

Figure 23A:
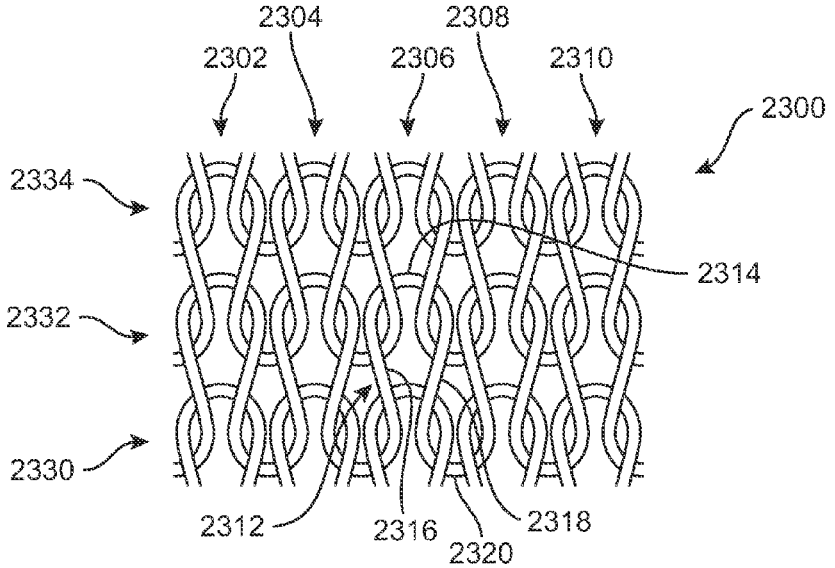
FIGS. 23A-23B are enlarged views of a jersey stitch exposed to a tension force.

The structural composition of the knit structure may impact the properties and/or performance of the knitted component. Referring to FIGS. 23 and 24, two different knit structures are depicted. FIG. 23A depicts a jersey knit stitch within knit structure 2300 in a natural state. FIG. 24A depicts an embodiment of an alternating float loop stitch within knit structure 2400 in a natural state. FIG. 23A depicts a knit structure 2300 including three courses: course 2330, course 2332, and course 2334. Further, knit structure 2300 includes five wales: wale 2302, wale 2304, wale 2306, wale 2308 and wale 2310. Further included are loops at each course and wale location. There may be an interaction between loops from one course to another course. Particularly, for explanatory purposes, FIG. 23A includes a loop 2312. Loop 2312 may include a head 2314, leg 2316, leg 2318, and sinker 2320. Each loop within knit structure 2300 may generally include the same components.

Figure 23B:
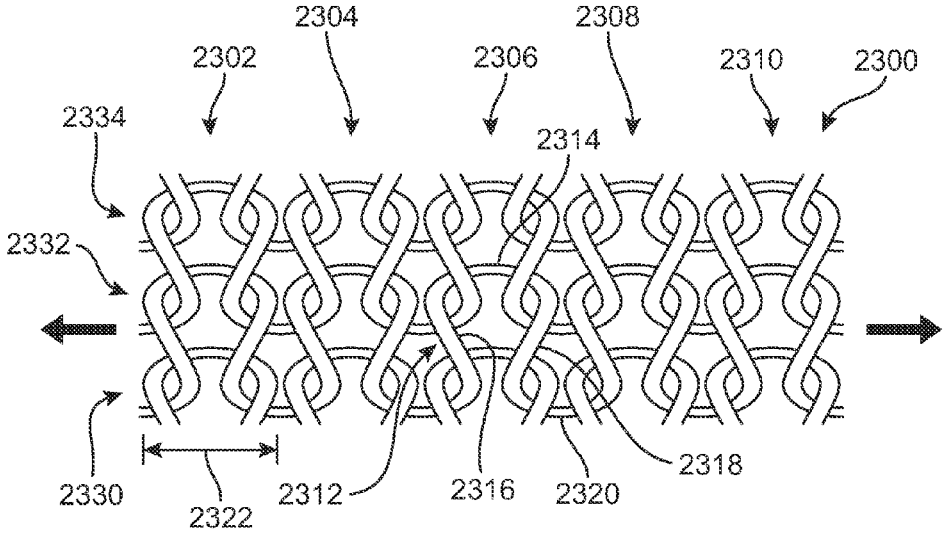
Figure 24A:
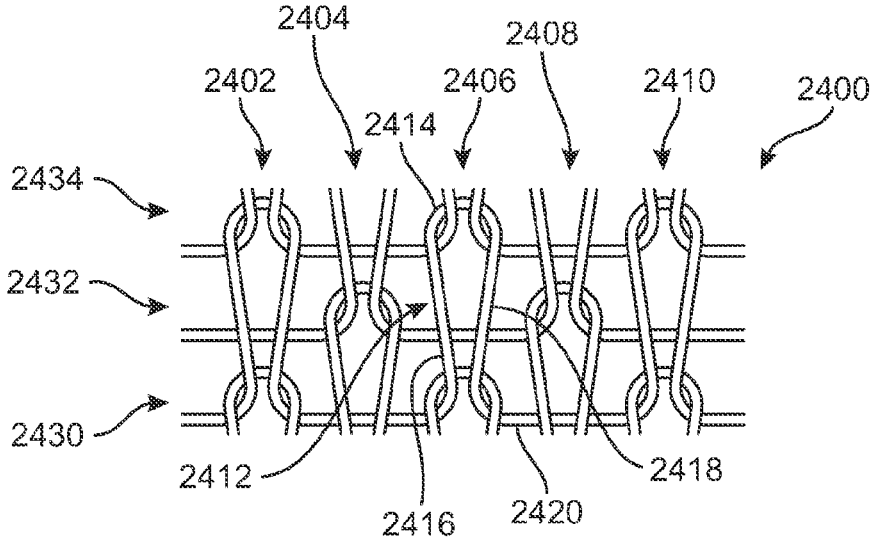
FIGS. 24A-24B are enlarged views of an embodiment of an alternating float loop stitch exposed to a tension force.

FIG. 23B depicts knit structure 2300 when a tensile force is applied along the course direction. Knit structure 2300 is a representative illustration of an exemplary knit structure undergoing a tensile force along the course direction. Loop 2312 is described; however, other loops may experience the same or similar types of changes or alterations. In FIG. 23B the distance 2322 illustrates an exemplary amount knit structure 2300 may change when exposed to a tensile force. Distance 2322 is not meant to be a precise depiction and is used primarily as a means for comparison and to be visually clear. In the depictions of knit structure 2300, loop 2312 may change in appearance. For example, as knit structure 2300 is pulled, each course may start to straighten, as is the natural tendency for a yarn with loops. As the yarn is pulled, leg 2316 and leg 2318 may shorten. The yarn from the legs may be accommodated by either or both of head 2314 and sinker 2320. The acceptance of leg 2316 and leg 2318 yarn may cause the overall knit structure to widen. In the embodiment shown, there are five loops in each course. Each of the five loops on a course includes two legs, for a total of ten leg lengths. The leg length amounts may then be spread among the head and sinkers in each course. The spreading of the leg length amounts may cause knit structure 2300 to stretch a significant amount. Knit structure 2300 may be considered a relatively stretchable configuration.

FIG. 24A depicts a knit structure utilizing an alternating float loop design. In this embodiment, knit structure 2400 of FIG. 24A includes three courses: course 2430, course 2432, and course 2434. Further, knit structure 2400 includes five wales: wale 2402, wale 2404, wale 2406, wale 2408, and wale 2410. Loops are located, in this depiction, at every-other wale and course location in the knit structure 2400. That is, each loop is a float loop. In this particular embodiment, knit structure 2400 includes two loops that interact with course 2432 and three loops that interact with course 2434. For purposes of example, loop 2412 may be described. Loop 2412 may include a head 2414, leg 2416, leg 2418, and sinker 2420. The other loops of knit structure 2400 may generally include the same or similar components.

Figure 24B:
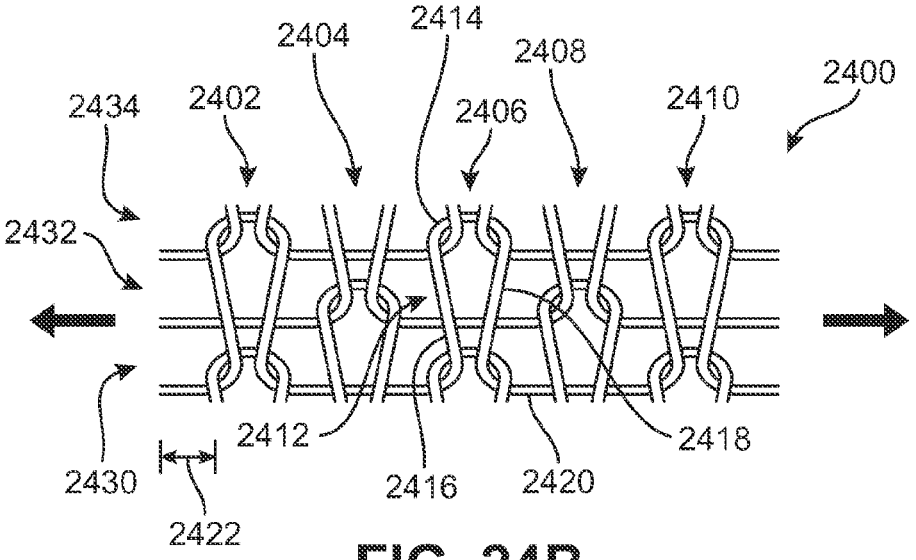

FIG. 24B depicts knit structure 2400 when subjected to tensile force along the course direction. As knit structure 2400 experiences the forces exerted on it, knit structure 2400 may begin to widen along the direction of the tensile force. The courses may attempt to revert to a straight line orientation. That is, the loops may "flatten," or decrease in size. Leg 2416 and leg 2418 may shorten and be accommodated by one of or both head 2414 and sinker 2420. The acceptance of yarn from the legs may cause the overall knit structure 2400 to widen in the course direction by a distance 2422. In this case, there are three loops that interact with course 2434. Each loop contains two legs for a total of six legs. In comparison to knit structure 2300 of FIG. 23B, about half of the length of legs may be accommodated by each loop in knit structure 2400 of FIG. 24B.

Further, in some cases, the configuration of knit structure 2400 may allow for loops to be of an overall smaller size than the loops of knit structure 2300. The sinker 2420, which does not interact with loops created from other courses, may leave the course undisturbed. Sinker 2420, by not disturbing the course, may allow for a closer construction of courses. The courses may run in a tighter formation, and occupy less space than in other configurations. The smaller size of loops in knit structure 2400 may cause the legs to be shorter. In this case, the shorter legs may also allow for a lesser amount of yarn that is transferred to heads and sinkers. The lesser amount of yarn transferred to the heads and sinkers may allow for distance 2422 to be further less than distance 2322 of knit structure 2300. With this arrangement, knit structure 2400 may have less stretchability than knit structure 2300.

Moreover, in some embodiments of a knit structure with an alternating float loop configuration, every wale position may not be occupied. As discussed in FIGS. 21-22 above, there may be gaps between loops along each course. The gaps may be filled with sinkers. Sinkers, in these Figures, may be oriented in generally a straight, or uncurved line along the knitting direction until connecting with a leg of a loop. In comparison to a jersey knit structure in which each wale and course position includes a loop, an alternating float loop structure of similar design to knit structure 2140 in FIG. 21 may include three less loops over a four wale distance. Referring to FIG. 21, gap 2120 and gap 2122 contribute to the length of sinkers. As shown the sinker 2458 is of a straight or uncurved line along the gaps in course 2104. In a jersey stitch, these spaces may be filled with more loops. More loops may add more length to the yarn in each course and thereby allow the knit structure to extend when subjected to force. In knit structure 2140 of FIG. 21, one quarter the amount of loops are utilized over a four space area, and therefore knit structure 2140 may extend by up to or more than four times less than a similar knit structure using a jersey stitch configuration. The particular knit stitch may be used due to the ability of the knit structure utilizing alternating float loops to more closely retain its shape when exposed to tensional forces. Other embodiments may allow for more spaces throughout the knit structure such as knit structure 2240 shown in FIG. 22. By utilizing more spaces within each knit structure, the amount of deformation along the course direction may be limited.

Figure 25:
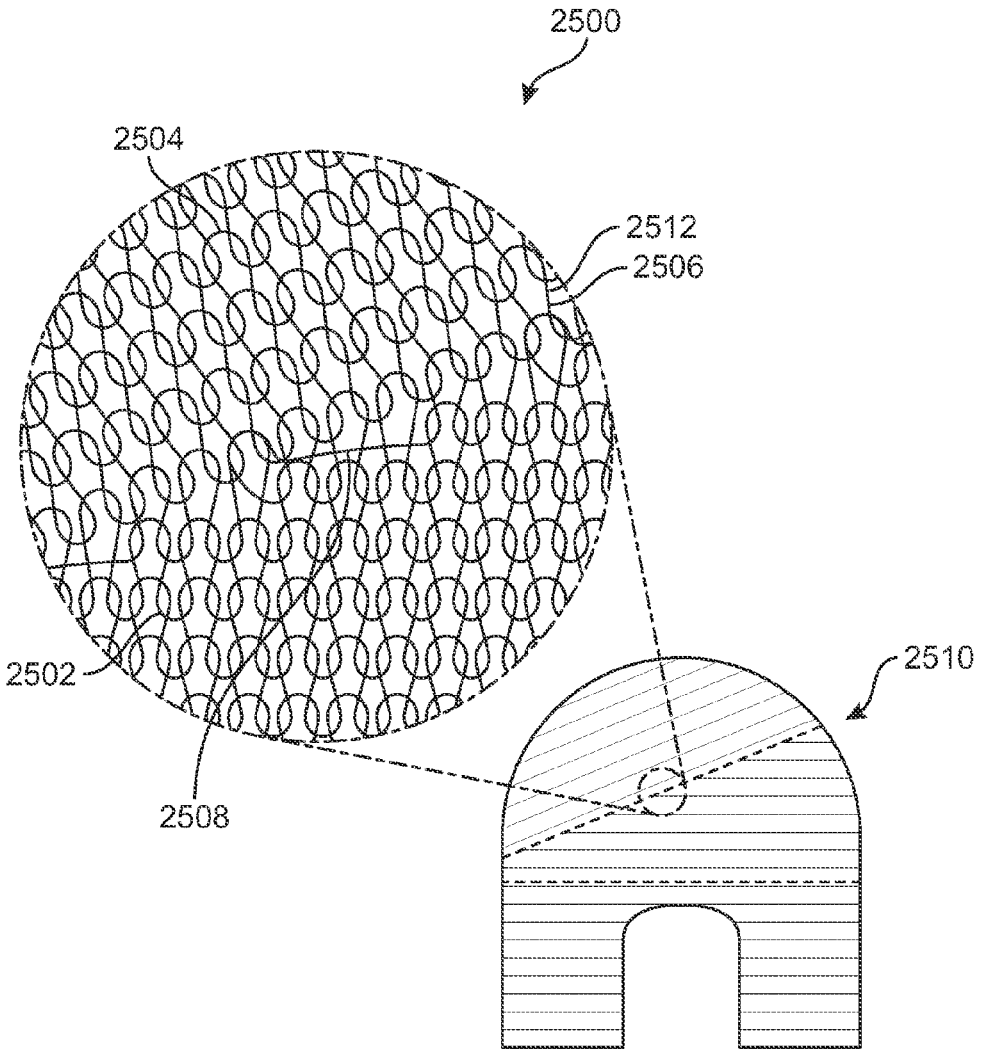
FIG. 25 is a view of an exemplary embodiment of a knitted component with an enlarged view of a transition zone utilizing jersey stitch.
Figure 26:
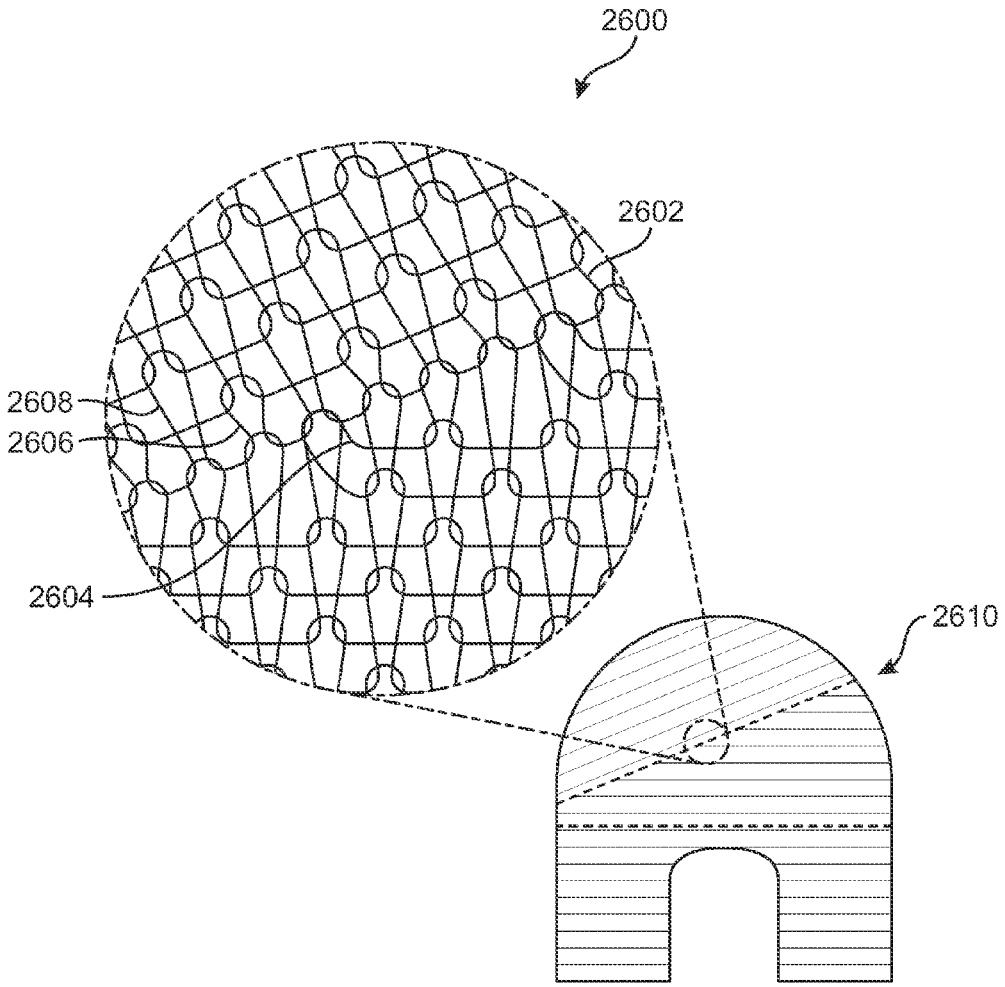
FIG. 26 is a view of an exemplary embodiment of a knitted component with an enlarged view of a transition zone utilizing an alternating float stitch.

FIGS. 25-26 demonstrate a possible orientation for a junction between two knitting directions. FIG. 25 shows a portion of knitted component 2510, knit structure 2500. For purposes of example and clarity, a plain jersey stitch configuration is utilized in knit structure 2500. As depicted, knit structure 2500 includes two discrete knitting directions. Knitting direction 2502 corresponds to courses that are generally horizontal. Knitting direction 2504 corresponds to courses that are at an angle within knit structure 2500. Each course along knitting direction 2502 may diminish in size as the knit structure 2500 is created. In this sense, courses along knitting direction 2502 may represent transition courses and part of a gore. First course 2506, created along knitting direction 2504, may connect and interloop with courses in knitting direction 2502. As such, a gore may be created and interact with secondary courses. A final course 2512 (the same course as first course 2506) may be used to connect the courses constructed along knitting direction 2502 and knitting direction 2504.

FIG. 26 depicts a portion of knitted component 2610, knit structure 2600. Knit structure 2600 depicts the junction of courses with of two different knitting directions within knit structure 2600 that further utilize an alternating float loop stitch. Knit structure 2600 and transition area of knitted component 2610 largely aligns with knit structure 2500 and transition area of knitted component 2510. In this embodiment, courses that include alternating float loops may diminish in length as knit structure 2600 is created. At final course 2602, some of the loops within structure 2600 may deviate from the alternating float loop design or pattern. For example, in final course 2602, loop 2608 is a float loop, while loop 2608 is not a float loop. Both loop 2608 and loop 2606 originate from final course 2602. In the pattern of the alternating float loop stitch as illustrated in loops of knit structure 2600 that do not interact with final course 2602, loop 2606 would be a float loop and would not originate from course 2602. In knit structure 2600, however, the courses and loops more readily align in the configuration shown, breaking the pattern of alternating float loops as depicted in other areas of knit structure 2600. In some embodiments, the pattern of an alternating float loop may be able to be maintained throughout the knit structure depending on the length of transition courses. Further, loops may extend over more or less than one course in order to achieve the connection of the courses aligned along each of the knitting directions.

In both FIG. 25 and FIG. 26, a continuation strand is utilized to complete each knit structure. In knit structure 2500 continuation strand 2508 passes behind three loops in order to continue the knit structure. In knit structure 2600 continuation strand 2604 passes behind one loop. In other embodiments continuation strand may pass over or behind more or less loops than depicted. Further, in some embodiments, the courses that align along different knitting directions may be connected using different techniques.

Figure 27:
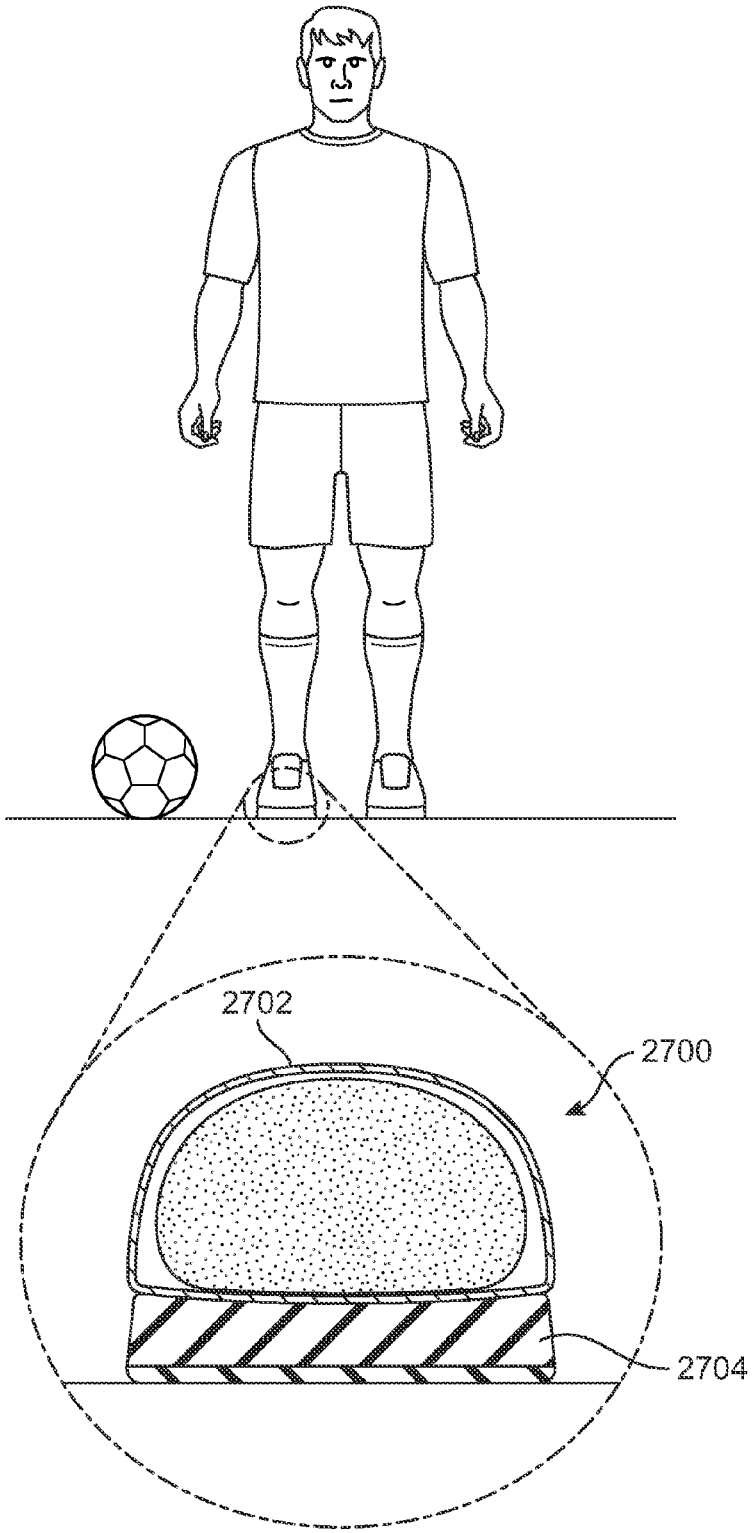
FIG. 27 is a representation of an athlete standing with an enlarged cross-sectional view of a forefoot portion of an embodiment of an article.
Figure 28:
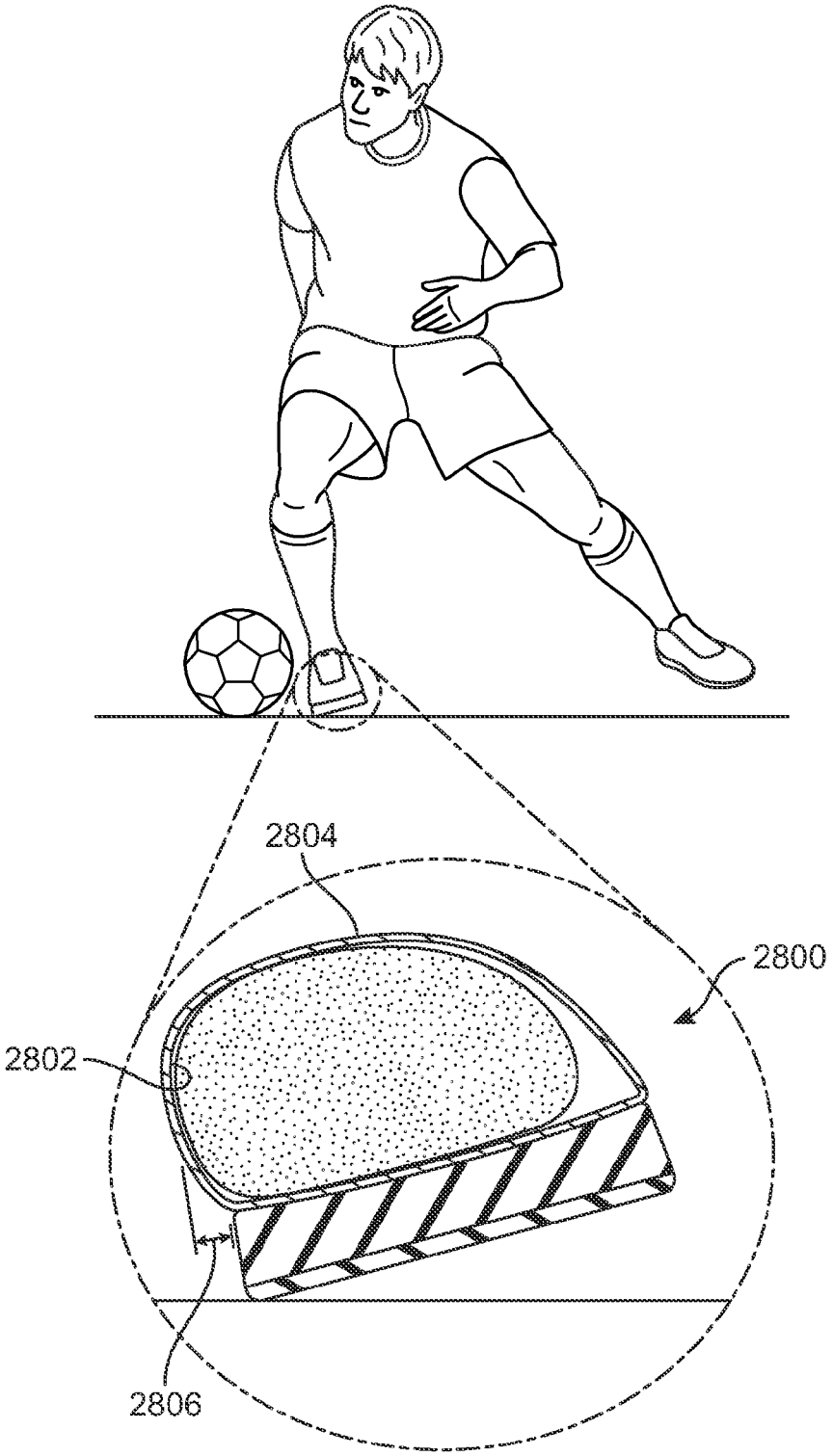
FIG. 28 is a representation of an athlete making a lateral maneuver with an enlarged cross sectional view of a forefoot portion of an article of footwear.
Figure 29:
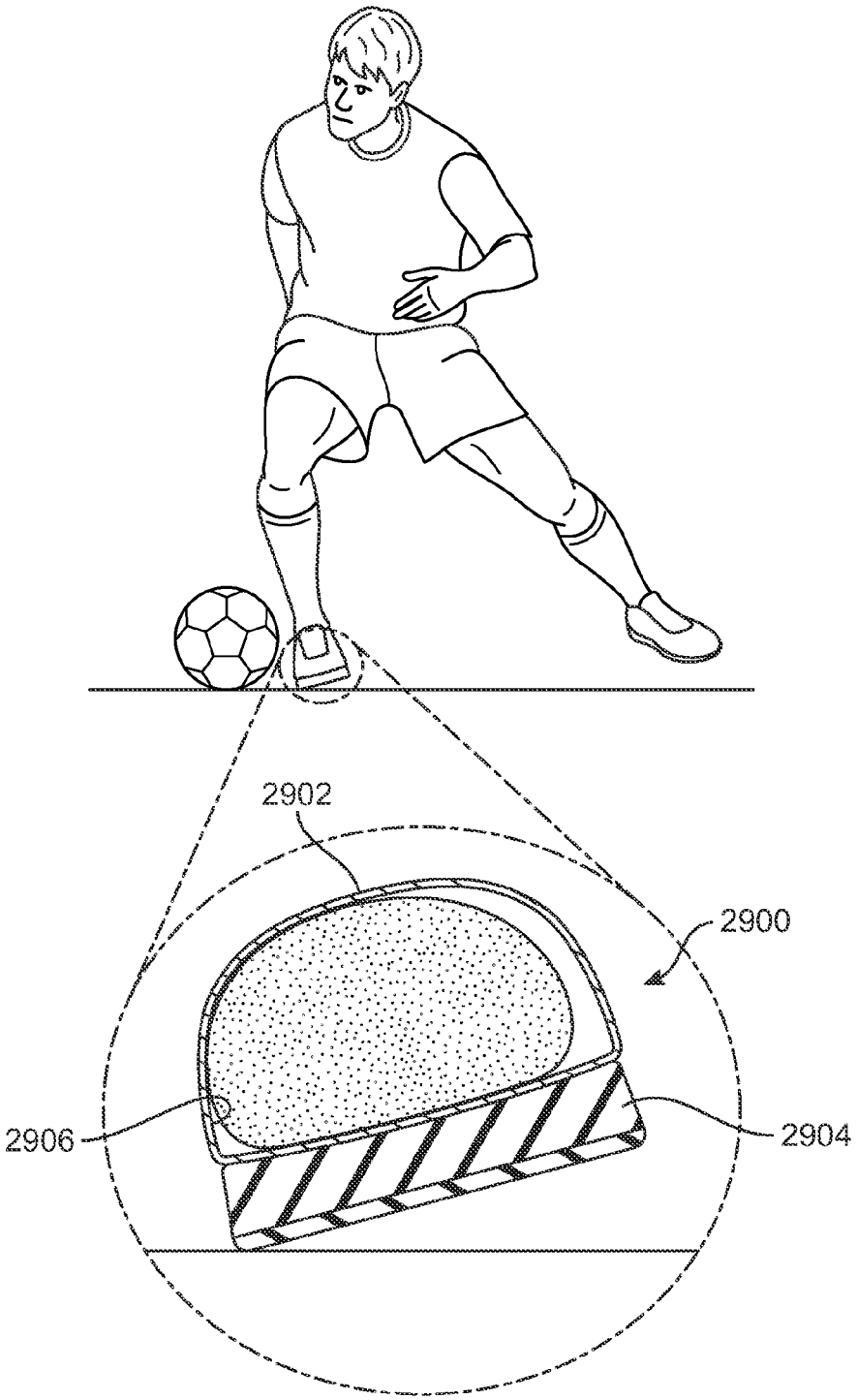
FIG. 29 depicts an athlete making a lateral maneuver with an enlarged cross-sectional view of a forefoot portion of an exemplary embodiment of an article of footwear.

Referring to FIGS. 27 through 29, representative views of an article of footwear including an upper and a sole structure is shown in use. FIG. 27 depicts an athlete wearing an article of footwear 2700. Article 2700 may include an upper 2702 incorporating a knitted component and a sole structure 2704. As shown in FIGS. 27 through 29, a cutaway of the forefoot portion of the article of footwear includes the forefoot portion of an athlete's foot. Referring to FIG. 27, the athlete's foot may comfortably be located within article 2700. FIG. 27 illustrates the athlete in a relaxed or non-moving state. While article 2700 may experience force on the sole structure 2704 in this state, minimal force may be exerted to portions of the upper 2702 of article 2700.

Referring to FIGS. 28 and 29, the athlete is shown performing a sport or athletic activity. In this embodiment, the athlete is shown performing a typical motion for soccer, in particular, making a cutting motion. During such a cutting motion, lateral force may be exerted along portions of the upper of an article of footwear. As depicted in FIG. 28, article of footwear 2800 includes an upper 2804 that does not include provisions for distributing or reducing forces from a sport or athletic activity. In this embodiment, upper 2804 of article of footwear 2800 may incorporate a knitted component that does not include courses that have been selectively oriented to correspond with the direction of the typical forces associated with the athletic activities of the athlete wearing article of footwear 2800. In contrast, FIG. 29 illustrates an exemplary embodiment of an article of footwear 2900 that includes provisions for distributing or reducing forces from a sport or athletic activity in accordance with the embodiments discussed herein. In an exemplary embodiment, article of footwear 2900 includes an upper 2902 that incorporates a knitted component having gores and specific knit structures described in the various embodiments disclosed above to provide courses that are selectively oriented to correspond with the direction of the typical forces associated with the athletic activities of the athlete wearing article of footwear 2900.

FIG. 28 shows a cutaway view of article of footwear 2800 when subjected to a cutting motion by an athlete. Generally, athletes do not always cut, or move in a lateral motion, in a direct manner. Usually, when an athlete seeks to change lateral orientation, the athlete may be running forward or backpedaling in reverse. This may cause the forces exerted by an athlete's foot to an article of footwear to be in a diagonal manner. FIG. 28 shows a foot pressing against interior surface 2802 of upper 2804. As depicted, upper 2804 may deform by a distance 2806 due to the force exerted on upper 2804 by an athlete's foot. In some cases, this configuration may cause less stability and traction between article 2800 and the ground. Further, an athlete may have less control due to the deformation of article 2800.

FIG. 29 shows an exemplary embodiment of article of footwear 2900. Article of footwear 2900 may include an upper 2902 and a sole structure 2904. Upper 2902 may be constructed using a knitted component. In an exemplary embodiment, article 2900 includes provisions for distributing or reducing forces from a sport or athletic activity in accordance with the embodiments discussed herein. In an exemplary embodiment, article of footwear 2900 includes an upper 2902 that incorporates a knitted component having gores and specific knit structures described in the various embodiments disclosed above to provide courses that are selectively oriented to correspond with the direction of the typical forces associated with the athletic activities of the athlete wearing article of footwear 2900.

The knitted component of upper 2804 may utilize stitch configurations discussed within the description. In particular, in one embodiment, the knitted component may utilize an alternating float loop stitch. Further, the knitted component may utilize gores to change course angle in a gradual manner. In some embodiments, gores may be used to align courses with the direction that forces may be exerted upon knitted component by a user's foot. As depicted, article of footwear 2900 may form a less elastic structure than article 2800. The foot, in this case, may press against interior surface 2906. In this case, however, the knitted component may better hold its shape than in article 2800. The knitted component may have courses aligned with where a foot may press against interior surface 2906, limiting the stretch and creating channels, or paths for the force to run along. In many cases the channels or paths may be courses. Further, the particular knit stitch may limit the stretch of the knitted component as well. This may allow for better stability and control in article 2900 than in the article 2800 of FIG. 28.

Figure 30:
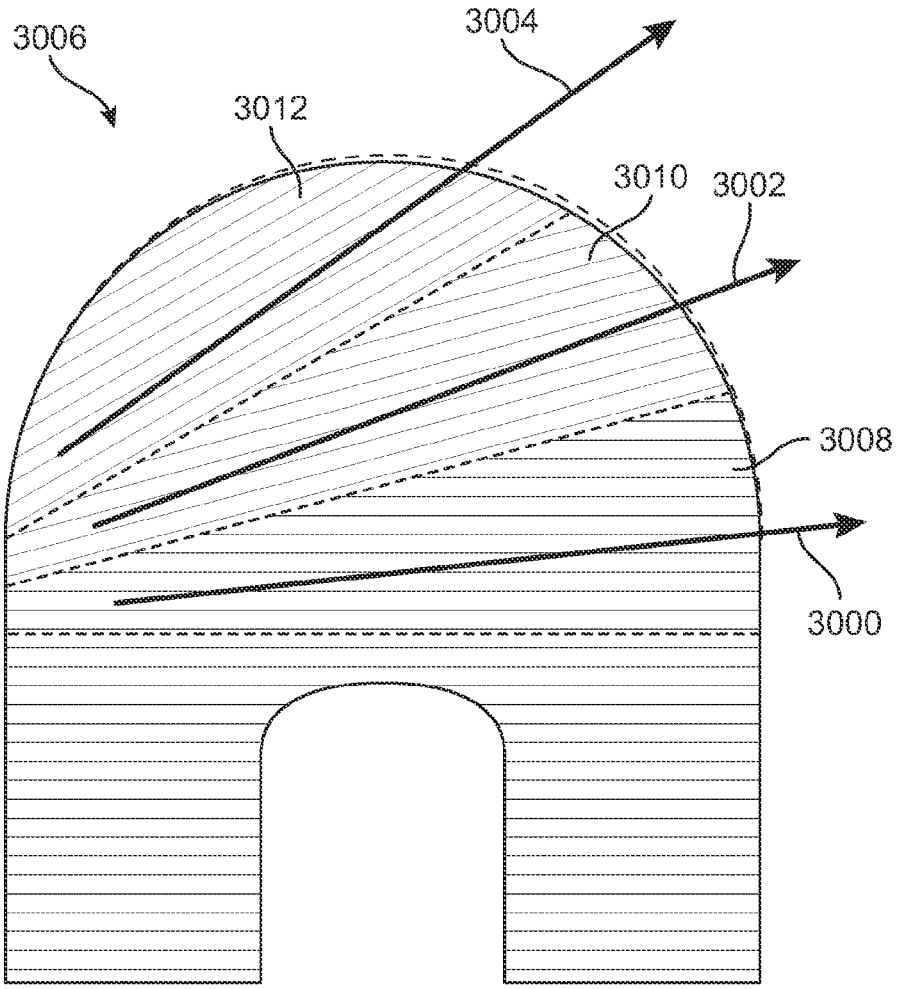
FIG. 30 illustrates a force acting on an exemplary embodiment of a knitted component.
Figure 31:
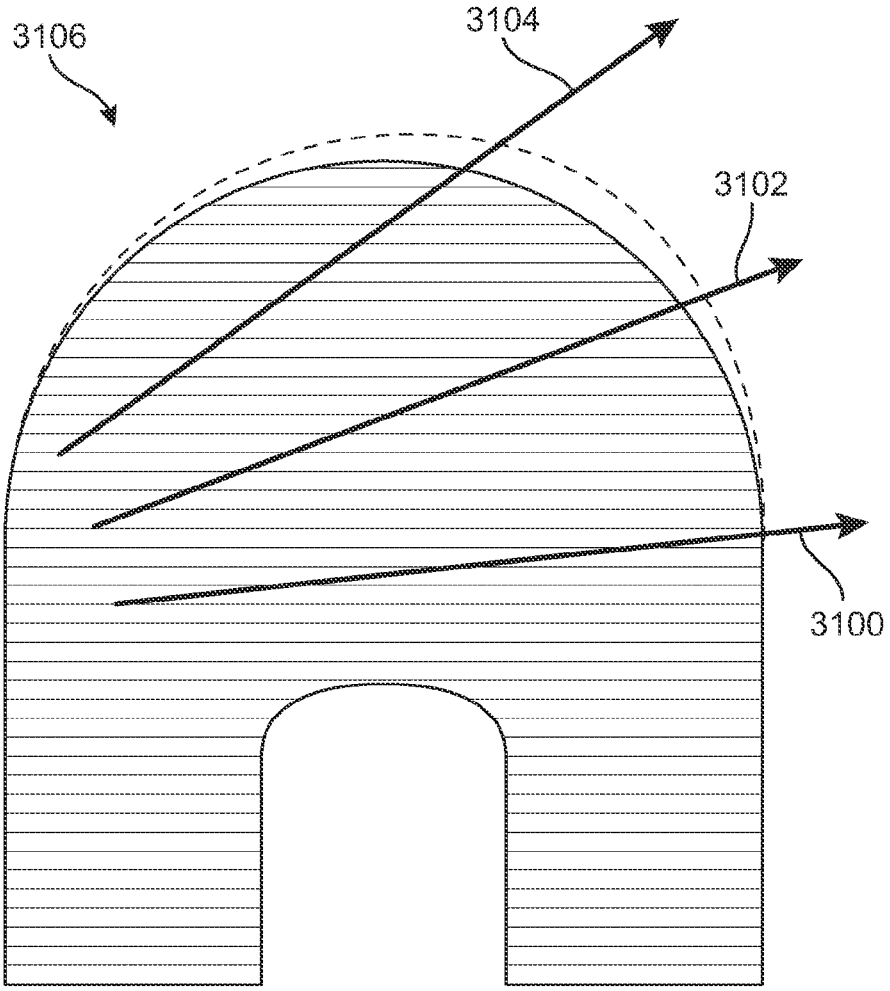
FIG. 31 illustrates a force acting on a knitted component that does not include a shifted knitting direction.
Figure 32:
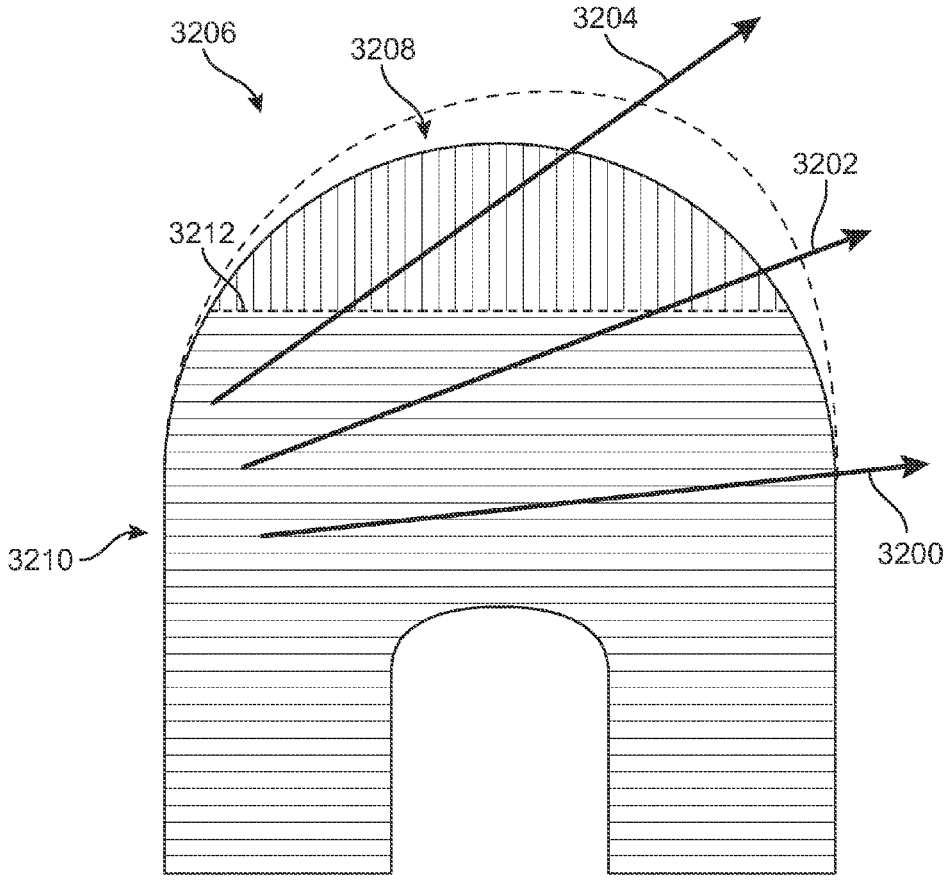
FIG. 32 illustrates a force acting on a knitted component with perpendicular knitting directions

FIGS. 30 through 32 illustrate a representative view of how forces may act upon courses of different knitting direction within a knitted component. Knitted component 3006 of FIG. 30 utilizes multiple gores to change the knitting direction of the courses in knitted component 3006.

Knitted component 3006 includes three areas of courses with different knitting directions: area 3008, area 3010, and area 3012. Multiple forces may be exerted on knitted component 3006 along the arrows (arrow 3000, arrow 3002, and arrow 3004). The forces may interact with the courses within each area. The force along arrow 3000 may interact with the courses in area 3008, the force along arrow 3002 may interact with the courses in area 3010, and the force along arrow 3004 may interact with the courses in area 3012. As shown, the force along each arrow may be approximately parallel to the courses in each area of knitted component 3006.

The courses in each area may be of an alternating float loop configuration. As illustrated in FIGS. 24A-24B the alternating float loop configuration of a knit structure is relatively non-stretchable along the course direction. Because of the non-stretchable nature of the alternating float loop configuration in the course direction, forces exerted on a knitted component along the course direction may have little impact on the shape of knitted component 3006. Although the forces that act along the arrows do not exactly line up with the courses in each area, many advantages of the alternating float loop configuration may be realized. Further, as the force acts along each of the arrows within the courses, the force may not encounter any sharp changes in course direction. The gradual shift of the courses may allow for the courses within the knitted component to transfer the force in a more even fashion than other designs. The orientation may allow for the force to dissipate allowing for a better feel during use of an article of footwear.

FIG. 31 depicts a knitted component 3106 that does not utilize gores or any means for changing the knitting direction of the courses of knitted component 3106. An article incorporating knitted component 3106 may be assumed to use an alternating float loop for purposes of comparison with other embodiments. As depicted a force is shown acting along three arrows: arrow 3100, arrow 3102, and arrow 3104. The arrows are a representation of the direction that forces may act upon knitted component 3106 during a cutting motion. While the arrows are shown as particular lines, force may be distributed throughout knitted component 3106. In this depiction, arrow 3100 generally aligns with the courses of the structure. Arrow 3102 and arrow 3104, however, run across many courses. In an alternating float loop configuration of a knitted component the force distribution may cause courses to spread apart from one another. Other knit stitches may have different properties in the course and wale direction. The force may only partially run along the course (where the knit structure is its strongest) and run also along the wales (a direction in which the knit structure is not strongest). These forces may cause knitted component 3106 to stretch or deform in areas where the force runs in the wale direction.

FIG. 32 depicts a knitted component 3206 that utilizes two different knitting directions. Knitted component 3206 uses a knitting direction of the courses in the toe area 3208 that runs perpendicular to the other knitting direction of the courses in vamp area 3210. This transition between the courses of different knit directions is a sharp or discontinuous change in direction. As shown, forces act along three arrows: arrow 3200, arrow 3202, and arrow 3204. Arrow 3200 may substantially align with the courses of knitted component 3206. The courses that experience the force along arrow 3200 may be able to accommodate the force as the force aligns with the courses, the strongest direction for an alternating float loop knit structure. The force acting along arrow 3202 may cross between courses of two knitting directions. As the force that acts along arrow 3202 travels from toe area 3208 to vamp area 3210 the force along arrow 3202 may encounter transition stitch 3212. The forces that act upon the article of footwear in a longitudinal direction from the heel region to the toe region orientation may encounter transition stitch 3212 and cause the stitch to stretch away from the courses in vamp area 3210. Further, the component of force along arrow 3202 acting in the lateral direction between the lateral and medial sides of knitted component 3206 may cause the courses in toe area 3208 to stretch. Transition stitch 3212 may encounter forces from both the lateral direction and the longitudinal direction which may cause transition stitch 3212 to experience a great amount of force. The great amount of force may cause failure or discomfort in some cases. In other cases, knitted component 3206 may stretch leading to poor performance and feel. The force acting along arrow 3204 may interact with knitted component 3206 in largely the same manner as the force acting along arrow 3202, however, the force may cause the vamp area 3210 to stretch to a greater degree.

The configuration of knitted component 3006 of FIG. 30 may result in reduced distortion or alteration of shape as compared to knitted component 3106 of FIG. 31, and knitted component 3206 of FIG. 32. Knitted component 3006 aligns the courses of knitted component with typical forces more closely than both knitted component 3106 and knitted component 3206. The closer alignment of the courses with typical forces allows knitted component 3006 to distribute, absorb, and dissipate the forces with little distortion to knitted component 3006. Knitted component 3006 also has gradual shifts in knitting direction as opposed to knitted component 3206. The gradual shift of courses in knitted component 3006 may result in fewer areas of concentrated force, in contrast to transition stitch 3212 of knitted component 3206. The gradual shift of courses in knitted component 3006 may increase performance and durability, as well as increase a user's comfort and feel as compared to knitted component 3106 and knitted component 3206.

Knitting Machine Configuration

Figure 33:
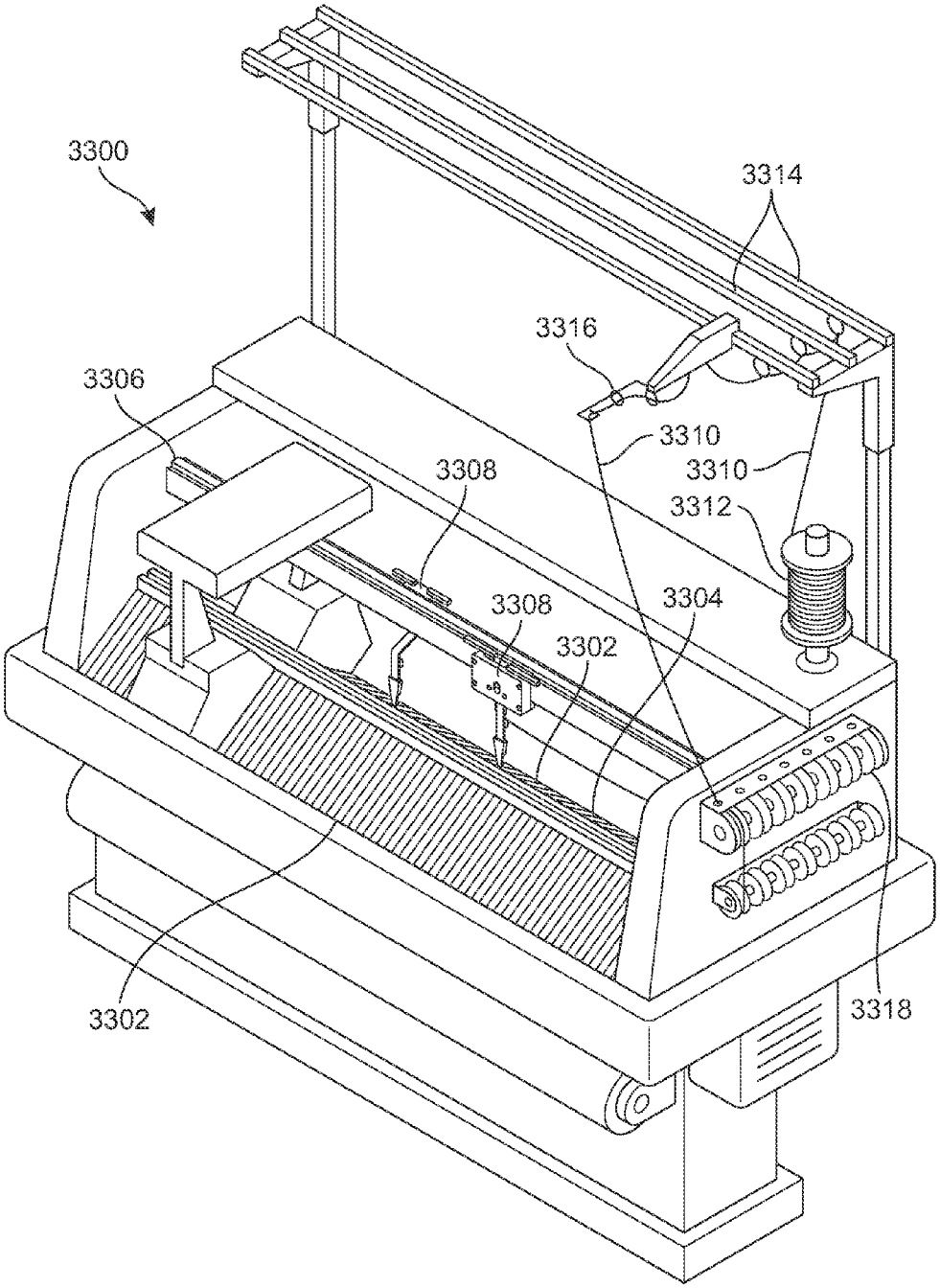
FIG. 33 is a perspective view of an embodiment of a knitting machine.

Although knitting may be performed by hand, commercial manufacturing of knitted components is generally performed by knitting machines. An example of a knitting machine capable of producing a knitted component, including any of the embodiments of knitted components described herein, is depicted in FIG. 33. Knitting machine 3300 is configured as a v-bed flat knitting machine; however, other types of knitting machines may be suitable for construction of the knitted component. For example, a flatbed flat knitting machine may also be utilized in some instances.

In some embodiments, knitting machine 3300 may include two needle beds 3302. In some cases, needle beds 3302 may be angled thereby forming a v-bed. Each needle bed 3302 contains a plurality of individual needles 3304 that lay on a common plane. That is, needles 3304 of one needle bed 3302 lie in one plane while needles 3304 of the other needle bed 3302 lie in a different plane. The first plane and second plane are angled such that the intersection of the planes extends along a majority of the width of the knitting machine 3300. As described in further detail below, needles 3304 may have a first position where they are retracted, a second position where they are extended, and a third position where they are partially extended. In the first position the needles are spaced from the intersection point. In the second position the needles may pass through the intersection point. In the third position the needles are located between the first position and the second position.

A rail 3306 extends above and parallel to the intersection of needle beds 3302. The rail may provide attachment points for feeders 3308. The feeders 3308 may supply yarn 3310 to needles 3304 in order for the needles 3304 to manipulate yarn 3310. Due to the action of a carriage, feeders 3308 may move along the rail 3306 and needle bed 3302, thereby supplying yarn 3310 to needles 3304. In FIG. 33, a yarn 3310 is provided to feeder 3308 by a spool 3312. More particularly, yarn 3310 extends from spool 3312 to various yarn guides 3314, a yarn take-back spring 3316 and a yarn tensioner 3318. The feeder 3308 has the ability to supply a yarn that needles 3304 may manipulate to knit, tuck and float. Some machines may have multiple spools from which feeder 3308 may receive yarn 3310. The multiple yarns may be utilized in the knit structure.

The manner in which knitting machine 3300 operates to manufacture a knitted component will now be discussed in detail. Moreover, the following discussion will demonstrate certain knit combinations as well as gore creation.

Figure 34:
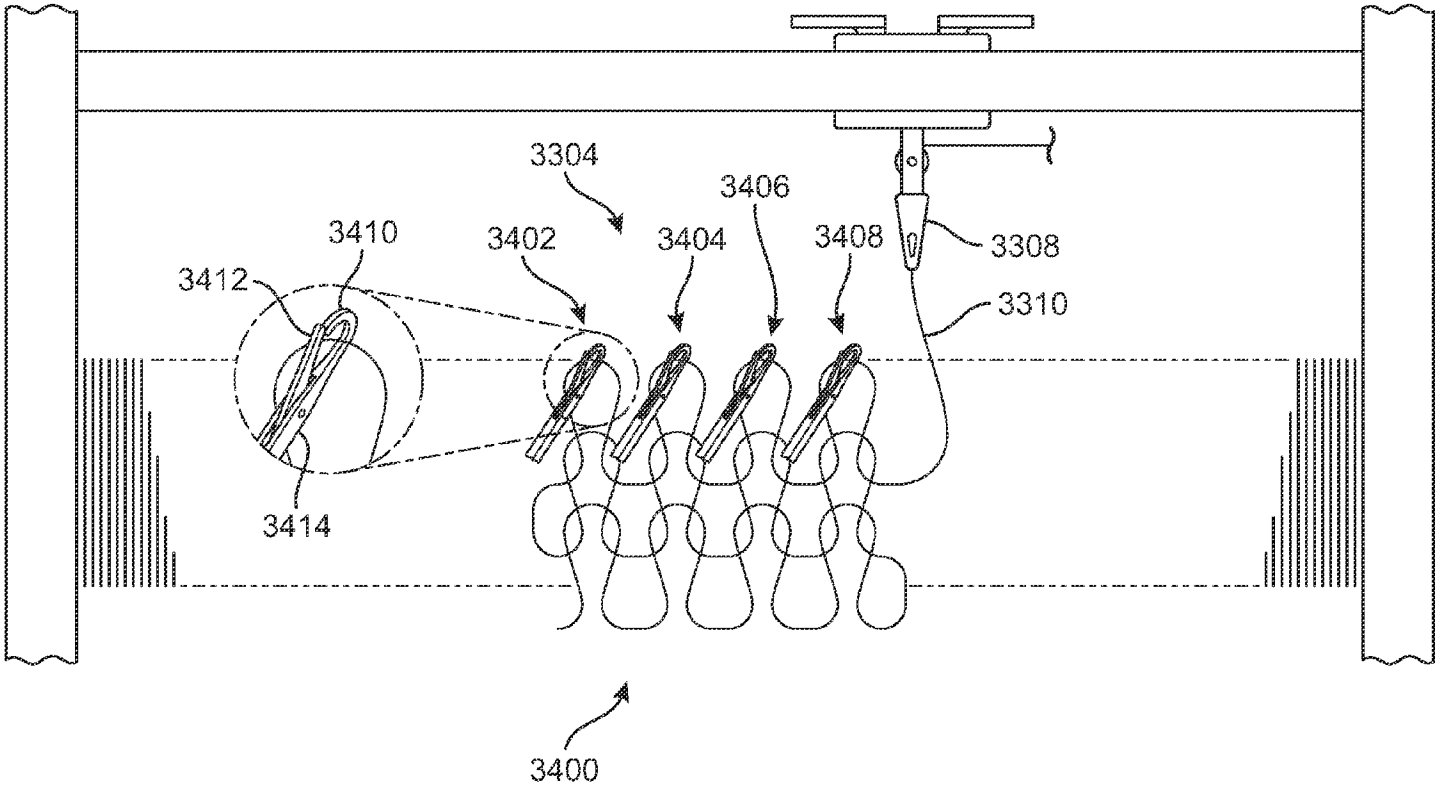
FIG. 34 is a schematic view of an exemplary embodiment of a knitted component during an aspect of the knitting process.

FIGS. 34 through 43 depict a knit element in the process of being manufactured. FIG. 34 depicts a plain jersey knit configuration for a portion of knit element 3400. The feeder 3308 passes yarn 3310 to accepting needles 3304 which may retract and extend to form knit element 3400. Needles 3304 are shown in the retracted position. In this position needles 3304 accepted yarn 3310 and formed loops. For purposes of clarity, needles 3304 may include fewer needles than on a typical knitting machine 3300. Needles 3304 may include: needle 3402, needle 3404, needle 3406, and needle 3408.

Each of the individual needles within needles 3304 may include a hook portion 3410, arm 3412, and stem 3414. Yarn 3310 may pass into hook portion 3410 when arm 3412 is in an open position. Arm 3412 may be considered in an open position when arm 3412 is pivoted away from hook portion 3410. After a loop is formed using needles 3304, the loop may be passed out of hook portion 3410 and onto stem 3414. Needles 3304 may move into an extended position. As needles 3304 move, yarn 3310 may press against arm 3412, moving arm 3412 from a closed position to an open position. The open position of arm 3412 allows the loop of yarn 3310 to travel out of hook portion 3410, over arm 3412 and onto stem 3414.

Figure 35:
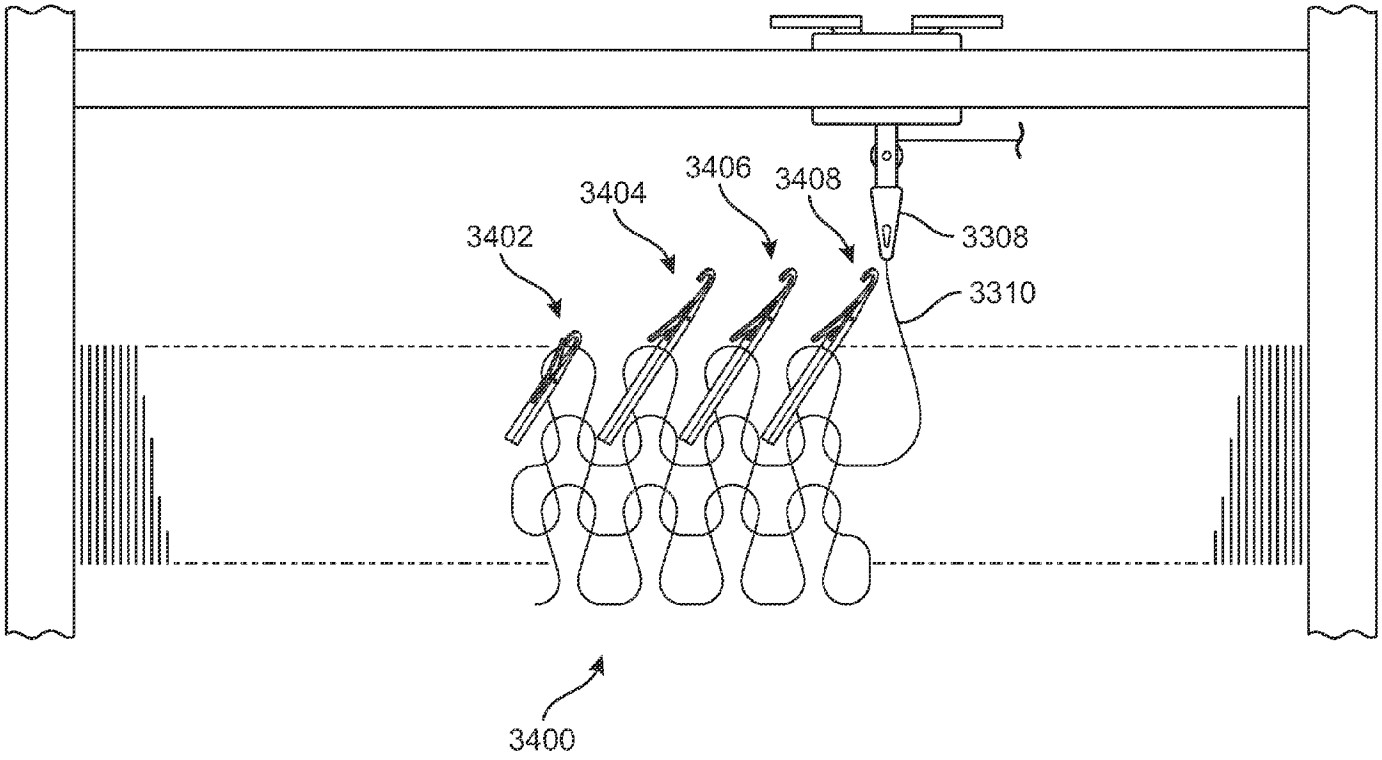
FIG. 35 is a schematic view of an exemplary embodiment of a knitted component during another aspect of the knitting process.

In FIG. 35, needle 3404, needle 3406, and needle 3408 fully extend to accept a new part of yarn 3310. The fully extended needles pass off the loop which each was holding. Needle 3402 stays in the retracted position and does not pass a loop off of arm 3412.

Figure 36:
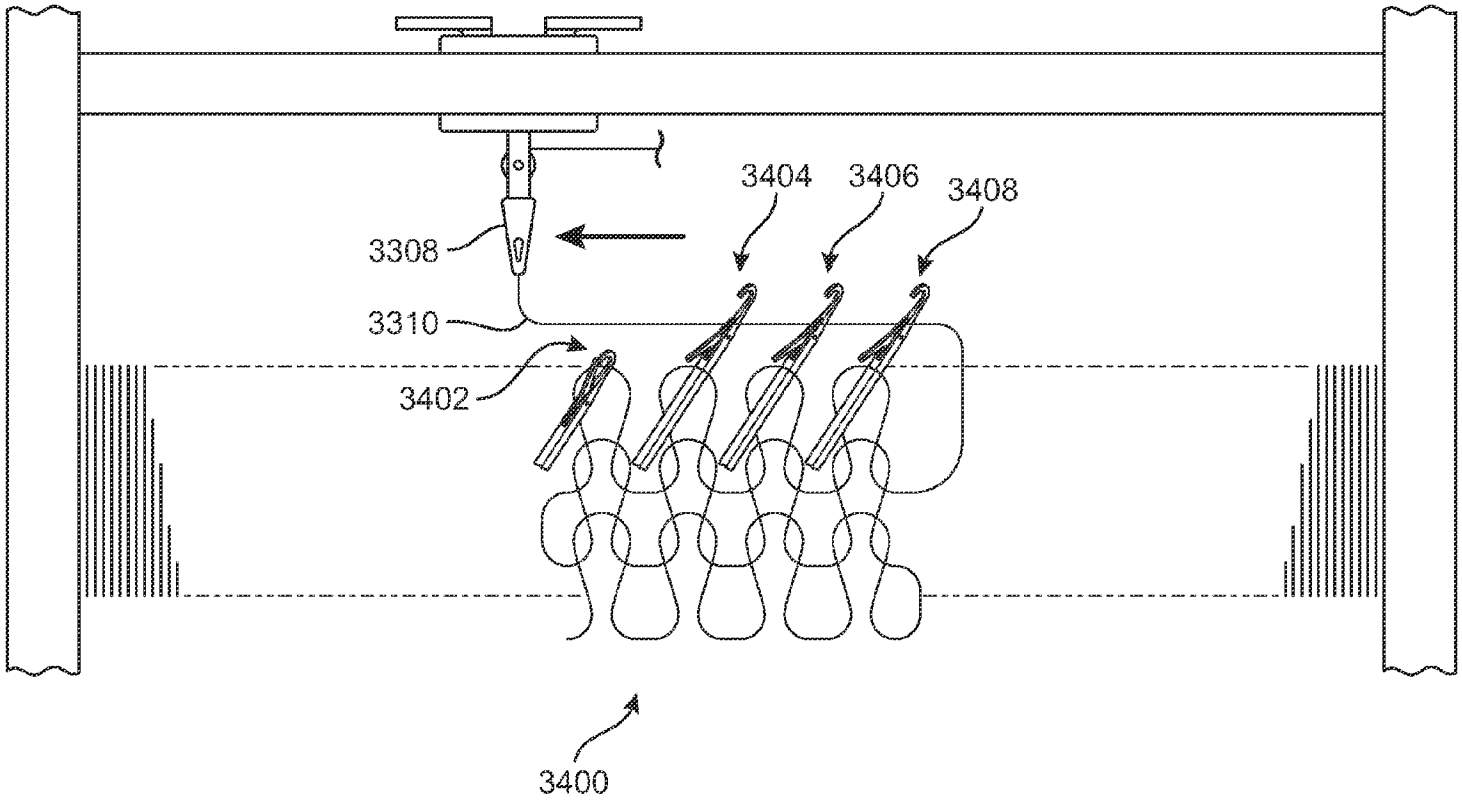
FIG. 36 is a schematic view of an exemplary process of the feeder passing yarn to the needles.
Figure 37:
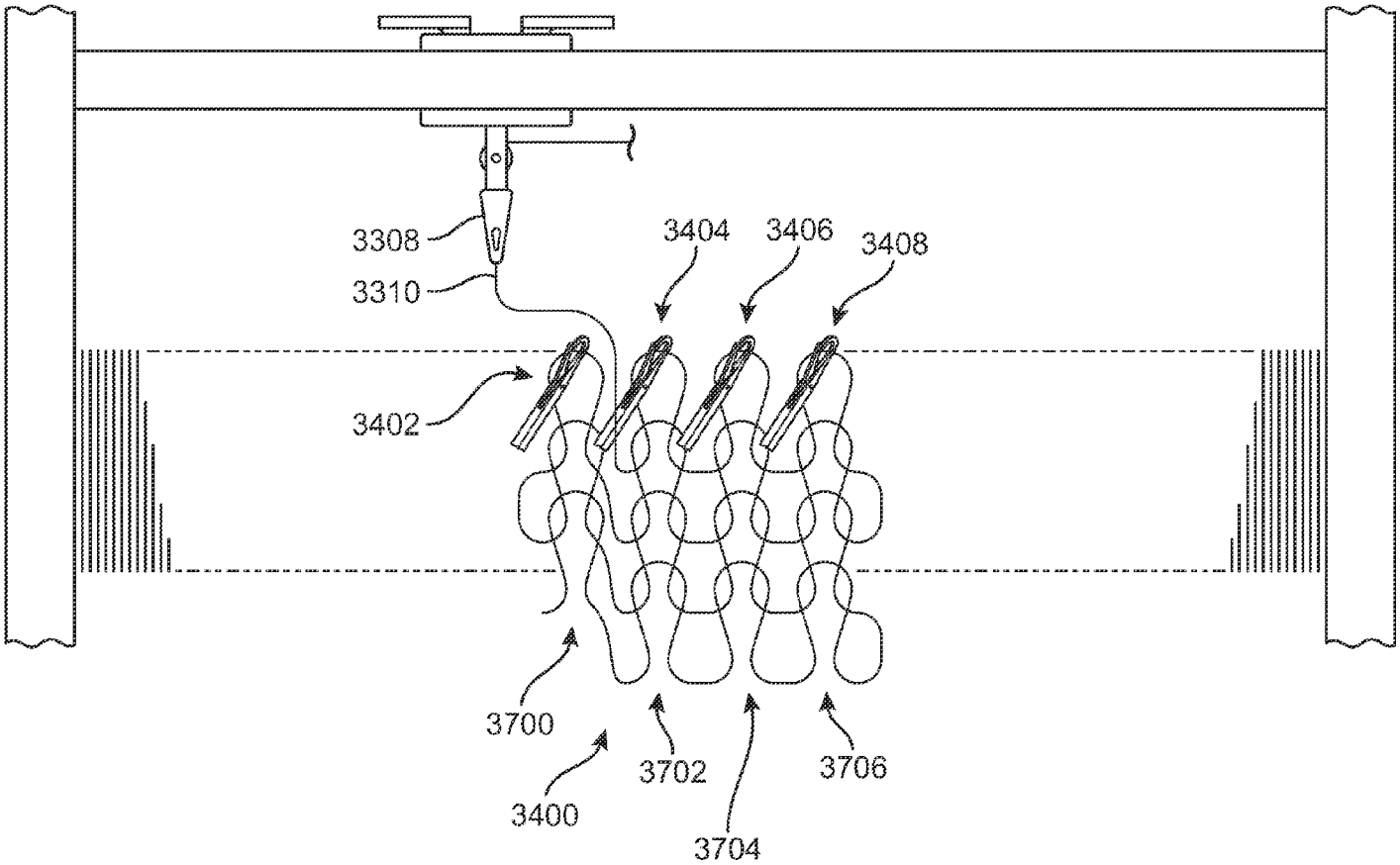
FIG. 37 is a schematic view of an exemplary process of needles intertwining the yarn with loops.

In FIG. 36 the feeder 3308 has passed over the extended needles and deposited yarn 3310 within the hooks of the fully extended needles and partially extended needle 3402. The fully extended needles, needle 3404, needle 3406 and needle 3408, retract and interact with yarn 3310 in order to create new loops, as shown in FIG. 37. Needle 3402 does not pass off the loop and also does not accept new yarn from feeder 3308. In FIG. 37, the number of loops in wale 3700 of knit structure 3400 is three in the current depiction. The number of loops in wale 3702, wale 3704, and wale 3706 is four in the current depiction. Because needle 3402 did not pass of the loop on needle 3402, there are fewer loops in wale 3700 than the other wales.

Figure 38:
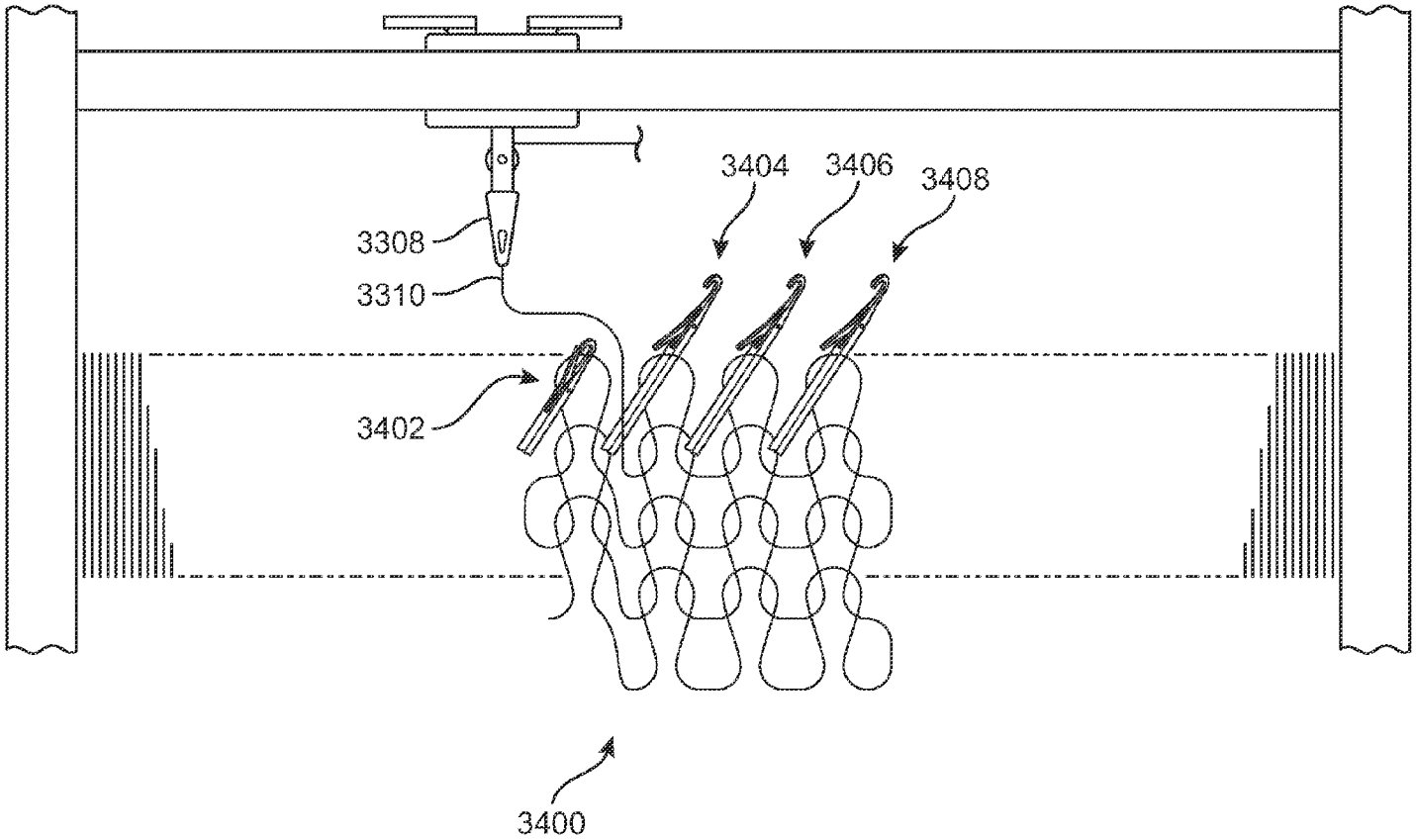
FIG. 38 is a schematic view of an exemplary process of a plurality of needles extending to accept yarn.
Figure 39:
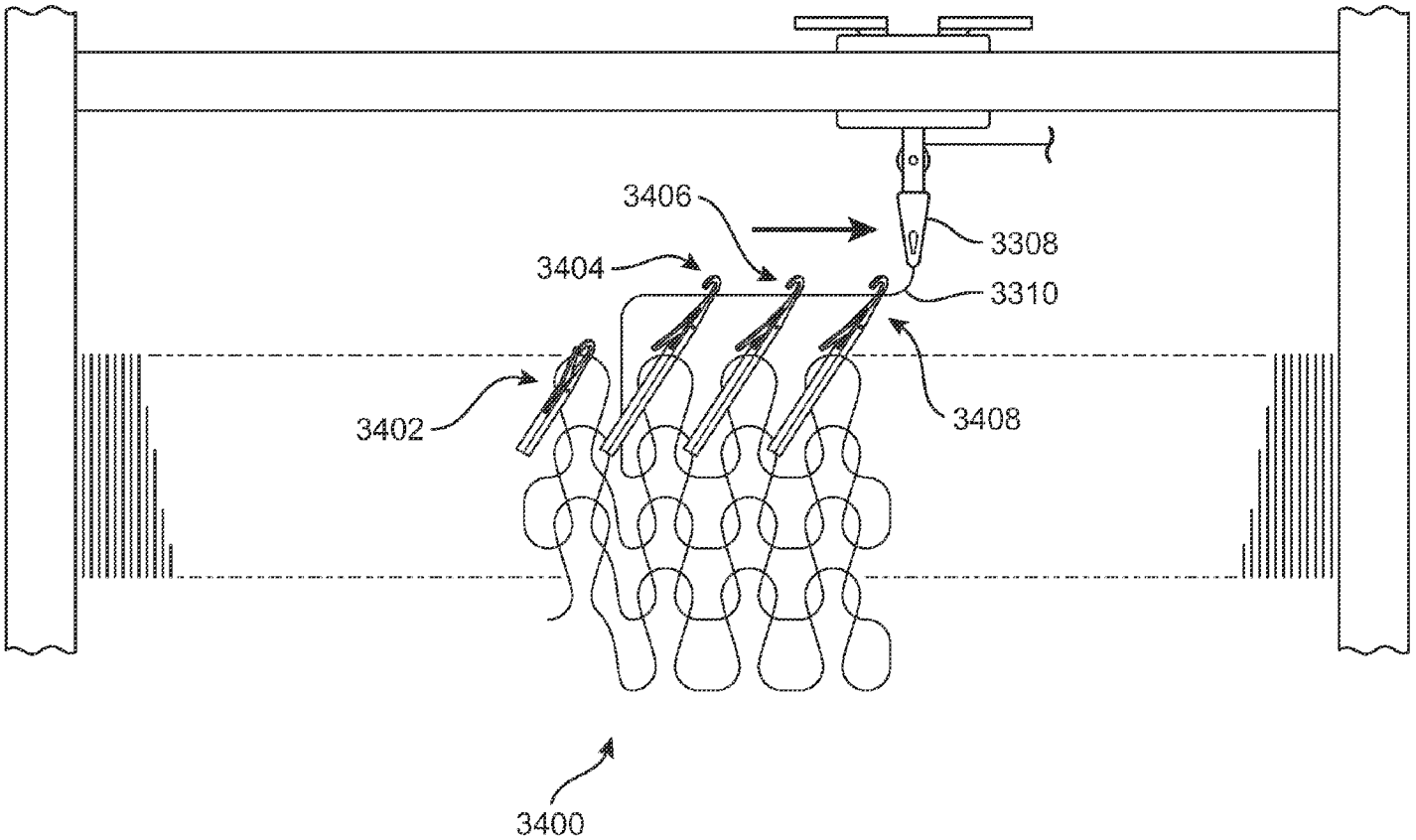
FIG. 39 is a schematic view of an exemplary process of extended needles accepting yarn from the feeder.

FIG. 38 shows needle 3404, needle 3406, and needle 3408 in an extended position in order to accept yarn 3310 from feeder 3308. In this case, needle 3402 stays in the retracted position. FIG. 39 depicts feeder 3308 depositing yarn 3310 in needle 3404, needle 3406 and needle 3408.

Figure 40:
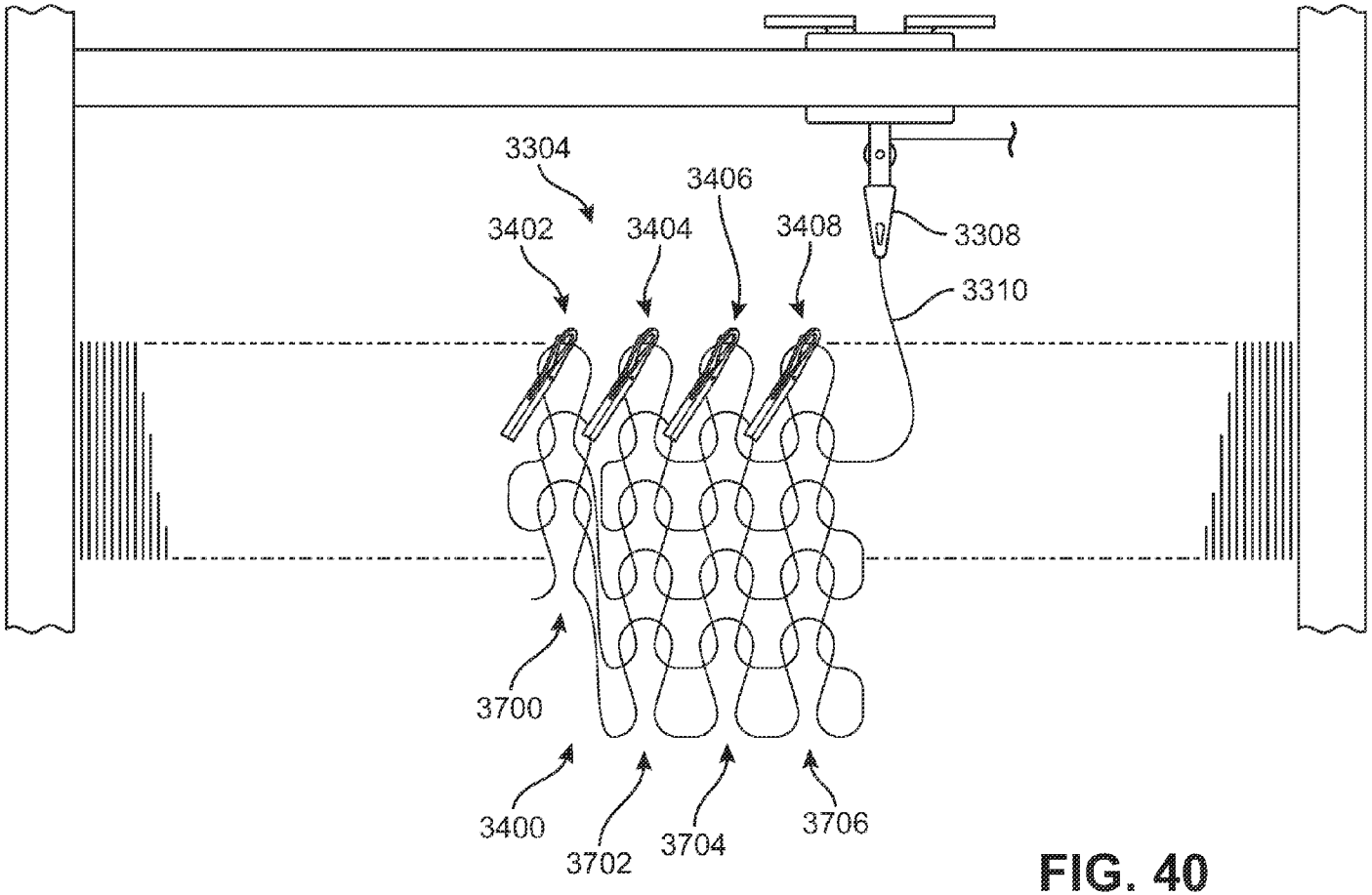
FIG. 40 is a schematic view of an exemplary process of needles retracting and intertwining the yarn with the previous intermeshed loops.

FIG. 40 shows the needles 3304 in retracted position. From FIG. 39, needle 3404, needle 3406 and needle 3408 retract. Needle 3402 remains in the retracted position as in FIG. 39. Note that the knit element created below the needles may begin to angle as knit element 3400 increases in size. The angle is created due to not all of the needles accepting the same amount of yarn. In the depiction shown, needle 3402 twice did not create a new loop. This creates two fewer loops within wale 3700 than the other wales. Because more loops are being created on one side, while the other side is being held, the knit element may curve.

Figure 41:
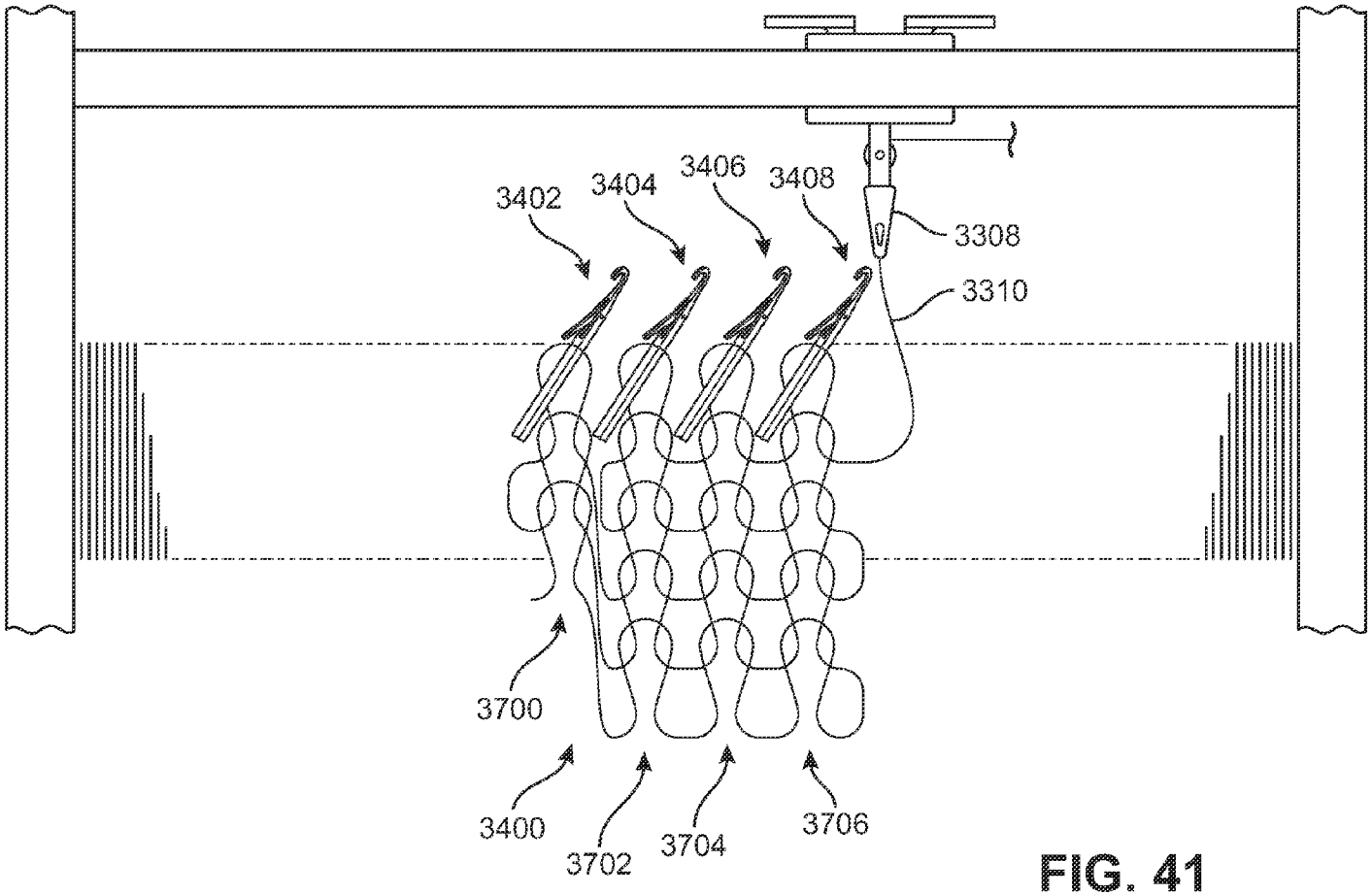
FIG. 41 is a schematic view of an exemplary process of a plurality of needles extending to accept yarn.
Figure 42:
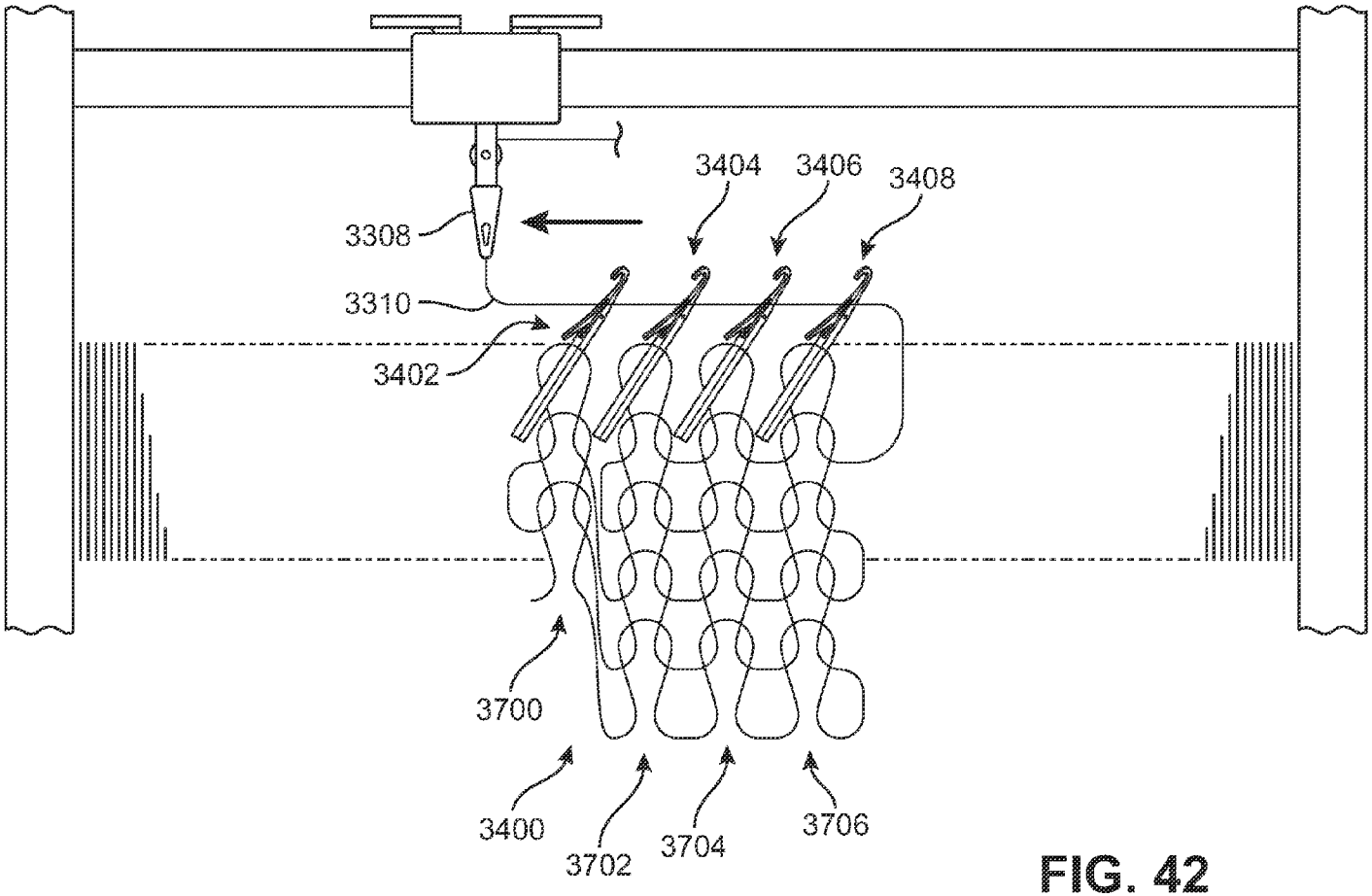
FIG. 42 is a schematic view of an exemplary process of extended needles accepting yarn from the feeder.
Figure 43:
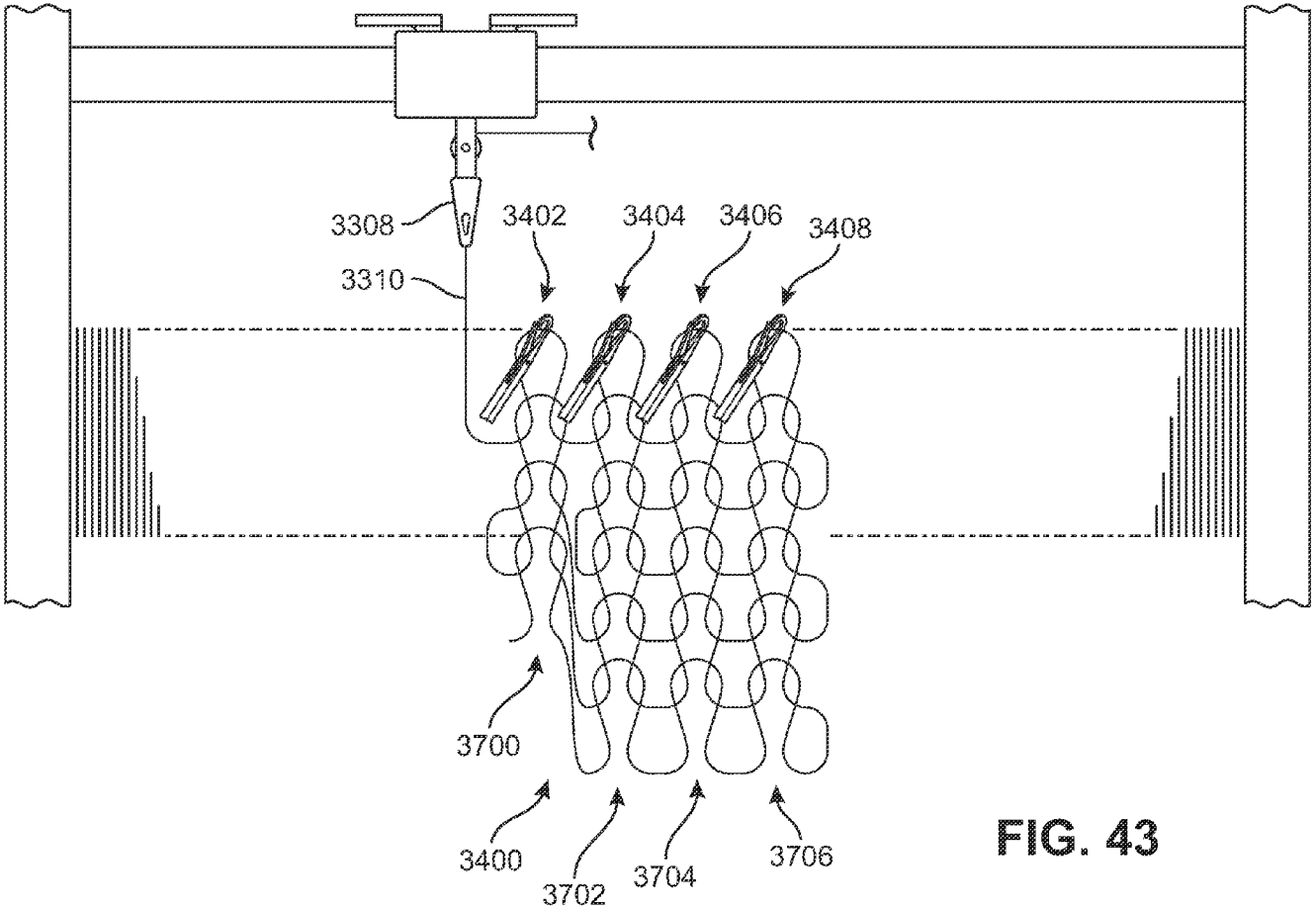
FIG. 43 is a schematic view of an exemplary process of needles retracting and intertwining the yarn with the previous intermeshed loops.

FIG. 41 depicts needles 3304 in the extended position in order to accept yarn. FIG. 42 shows yarn 3310 passing over each of the extended needles and depositing yarn 3310 within each of the extended needles. FIG. 43 depicts needle 3302, needle, 3404, needled 3406, and needle 3408 in the retracted position. In this position each of the needles has created a new loop. Wale 3700 of knit element 3400 is now connected to wale 3702 by yarn 3310 between needle 3402 and needle 3404.

Figure 44:
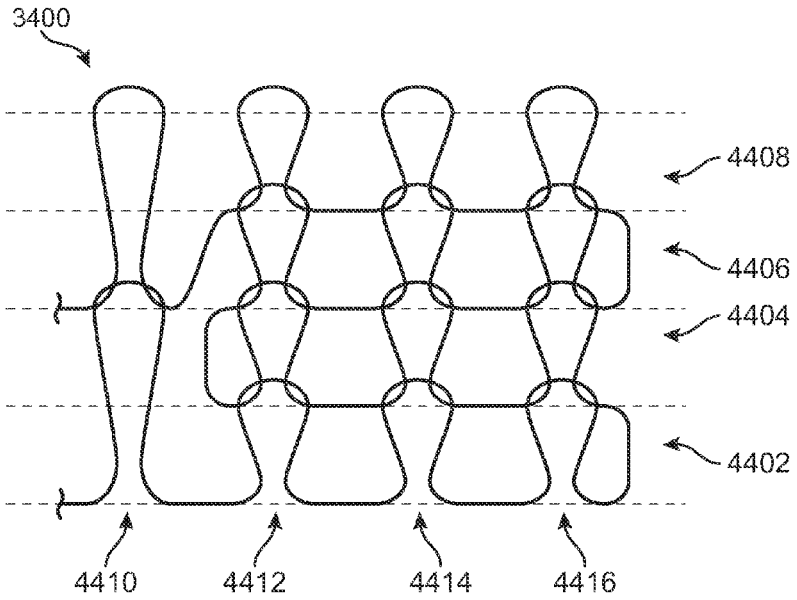
FIG. 44 is a representation of an exemplary embodiment of a knit textile formed using the knitting process on the knitting machine.
Figure 45:
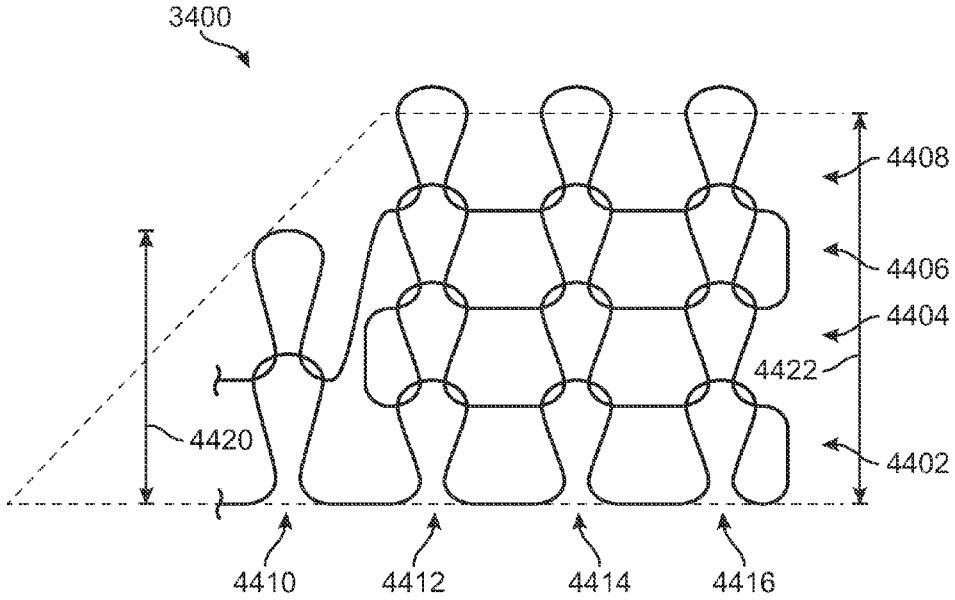
FIG. 45 is another representation of an exemplary embodiment of a knit textile formed using the knitting process on the knitting machine.

FIGS. 44 and 45 depict a portion of knit element 3400 manufactured in FIGS. 34-43. FIG. 44 depicts a portion of knit element 3400 as knit element 3400 may appear while attached to needles. As shown, knit element 3400 includes four rows, row 4402, row 4404, row 4406, and row 4408. Further, knit element includes four columns, column 4410, column 4412, column 4414, and column 4416. As clearly depicted column 4410 includes fewer loops than the other columns. Also, the loops within column 4412, column 4414, and column 4416 within row 4404 and row 4406 do not interact with the loops in column 4410. The lack of interaction with the loops in column 4410 is indicative of short-row knitting. In this case, a gore is shown to be formed.

FIG. 45 depicts a portion of knit element 3400 after it has been removed from the needles. As shown, a wedge-type shape may emerge. Due to there being fewer loops in column 4410 than in other columns, the loops may occupy a smaller longitudinal distance than the longitudinal distance occupied by the other columns. For example, distance 4420 may extend through a portion of row 4406. Distance 4422 may extend throughout all of the rows depicted. In this case, distance 4422 is greater than distance 4420. The difference between the distances may create a wedge shaped gore.

In some cases, a stitch other than jersey stitch may be utilized. In some cases, an alternating float loop stitch may be used. In some cases, an alternating float loop configuration may be used throughout the knit element forming the knitted component. In some cases, the needles may not exactly continue the every-other float loop configuration. That is, in some cases, the alternating float loop configuration may call for a "skip" or held loop at the gore-defining edge. Therefore, in some cases, the configuration of every-other float loop may not be continuous at the gore-defining edge. The knit element of a knitted component may not include alternating float loops for a portion of the knit element in order to connect courses of different knitting directions together within a knitted component.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. As used in the claims, "any of" when referencing the previous claims is intended to mean (i) any one claim, or (ii) any combination of two or more claims referenced.

What is claimed is:

1. A method of knitting a knitted component for incorporating into an upper of an article of footwear, the method comprising:

knitting a first portion of the knitted component with at least one course aligned along a first knitting direction;

knitting a plurality of transition courses, at least one transition course being continuous with at least one course of the first portion, the plurality of transition courses including multiple short-row courses; and knitting a second portion of the knitted component with at least one course aligned along a second knitting direction, the second knitting direction being different than the first knitting direction;

wherein the first knitting direction is oriented at an angle of less than ninety degrees from the second knitting direction.

2. The method of claim 1 further comprising:

knitting a connection course that joins loops of the short-row courses to at least one course of the second portion.

3. The method of claim 1, wherein at least one of the knitting of the first portion, the knitting of the plurality of transition courses, and the knitting of the second portion comprises knitting using an alternating float loop stitch.

4. The method of claim 1 further comprising:

increasing the number of transition courses between the knitting of the first portion and the knitting of the second portion to increase the angle between the first knitting direction and the second knitting direction.

5. The method of claim 1, wherein at least one of the knitting of the first portion, the knitting of the plurality of transition courses, and the knitting of the second portion comprises knitting using a jersey stitch.

6. The method of claim 1, wherein the knitting of the plurality of transition courses comprises knitting multiple courses having varying lengths.

7. A method of knitting a knitted component, the method comprising:

knitting a first portion of the knitted component comprising at least one course aligned along a first knitting direction;

knitting a second portion of the knitted component comprising a plurality of courses, wherein at least one course of the plurality of courses is aligned along the first knitted direction and at least one course of the plurality of courses is aligned along a second knitting direction, wherein the second knitting direction is different than the first knitting direction, and wherein the first knitting direction is oriented at an angle of less than ninety degrees from the second knitting direction; and knitting a third portion of the knitted component comprising at least one course aligned along the second knitting direction;

wherein the second portion is disposed between the first portion and the third portion.

8. The method of claim 7 further comprising:

knitting a fourth portion of the knitted component comprising at least one course aligned along a third knitting direction, wherein the third knitting direction is different than the first knitting direction and the second knitting direction, and wherein the second knitting direction is oriented at an angle of less than ninety degrees.

9. The method of claim 7, wherein knitting the plurality of courses of the second portion of the knitted component comprises knitting a plurality of transition courses, and wherein the plurality of transition courses comprises a plurality of short-row courses.

10. The method of claim 9 further comprising:

knitting a connection course that joins loops of the plurality of short-row courses to at least one course of the third portion.

11. The method of claim 7, wherein at least one of the knitting of the first portion, the knitting of the second portion, and the knitting of the third portion comprises knitting using an alternating float loop stitch.

12. The method of claim 7 further comprising:

increasing the number of courses between the knitting of the first portion and the knitting of the third portion to increase the angle between the first knitting direction and the second knitting direction.

13. The method of claim 8 further comprising:

increasing the number of courses between the knitting of the second portion and the knitting of the fourth portion to increase the angle between the second knitting direction and the third knitting direction.

14. The method of claim 7, wherein at least one of the knitting of the first portion, the knitting of the second portion, and the knitting of the third portion comprises knitting using a jersey stitch.

15. The method of claim 7, wherein the knitting of the plurality of courses of the second portion comprises knitting multiple courses having varying lengths.

16. A method of knitting a knitted component for incorporating into an upper, the method comprising:

knitting a first portion of the knitted component comprising at least one course aligned along a first knitting direction, wherein the first knitting direction is aligned approximately along a lateral direction across the upper;

knitting a second portion of the knitted component comprising a plurality of courses that transition from the first knitting direction at a first location adjacent to the first portion to a second knitting direction at a second location adjacent to a third portion of the knitted component, wherein the second knitting direction is different than the first knitting direction, and wherein the second knitting direction is oriented at an angle of less than ninety degrees from the lateral direction of the upper; and knitting the third portion of the knitted component comprising at least one course aligned along the second knitting direction.

17. The method of claim 16 further comprising:

knitting a fourth portion of the knitted component comprising at least one course aligned along a third knitting direction, wherein the third knitting direction is different than the first knitting direction and the second knitting direction, and wherein the second knitting direction is oriented at an angle of less than ninety degrees.

18. The method of claim 16, wherein knitting the plurality of courses of the second portion of the knitted component comprises knitting a plurality of transition courses, and wherein the plurality of transition courses comprises a plurality of short-row courses.

19. The method of claim 16, wherein at least one of the knitting of the first portion, the knitting of the second portion, and the knitting of the third portion comprises knitting using an alternating float loop stitch.

20. The method of claim 16, wherein at least one of the knitting of the first portion, the knitting of the second portion, and the knitting of the third portion comprises knitting using a jersey stitch.

* * * * *